US008931594B2

(12) United States Patent
Kreller

(10) Patent No.: US 8,931,594 B2
(45) Date of Patent: Jan. 13, 2015

(54) PROP FOR A THREE-DIMENSIONAL FRAMEWORK, CONNECTING ASSEMBLY FOR A RAILING DEVICE, AND METHOD FOR ATTACHING A RAILING DEVICE TO A PROP

(75) Inventor: Helmut Kreller, Bad Rappenau (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 505 days.

(21) Appl. No.: 12/587,986

(22) Filed: Oct. 15, 2009

(65) Prior Publication Data

US 2010/0089697 A1 Apr. 15, 2010

Related U.S. Application Data

(63) Continuation-in-part of application No. PCT/DE2008/000538, filed on Mar. 27, 2008.

(30) Foreign Application Priority Data

Apr. 18, 2007 (DE) ..... 10 2007 018 314

(51) Int. Cl.

| | |
|---|---|
| ***E04G 7/22*** | (2006.01) |
| ***E04G 1/14*** | (2006.01) |
| ***E04G 5/14*** | (2006.01) |
| ***E04G 7/30*** | (2006.01) |

(52) U.S. Cl.

CPC .. *E04G 7/22* (2013.01); *E04G 1/14* (2013.01); *E04G 5/14* (2013.01); *E04G 7/307* (2013.01)

USPC ..... 182/186.8; 182/113; 182/186.7

(58) Field of Classification Search

USPC ..... 182/112, 113, 114, 115, 116, 117, 118, 182/119, 123, 126, 130, 152, 222, 223, 182/186.7, 186.8; 256/65.02, 65.03, 65.04, 256/65.05, 65.06; 403/49, 397

See application file for complete search history.

(56) References Cited

U.S. PATENT DOCUMENTS

| | | | | |
|---|---|---|---|---|
| 427,180 | A * | 5/1890 | MacLaurin | 403/49 |
| 1,351,053 | A * | 8/1920 | Macklem | 182/119 |

(Continued)

FOREIGN PATENT DOCUMENTS

| | | |
|---|---|---|
| AU | 518 442 | 10/1981 |
| CH | 439 679 | 7/1967 |

(Continued)

OTHER PUBLICATIONS

International Search Report.

(Continued)

*Primary Examiner* — Katherine Mitchell

*Assistant Examiner* — Colleen M Chavchavadze

(74) *Attorney, Agent, or Firm* — Collard & Roe, P.C.

(57) ABSTRACT

The invention relates to a prop (32.1, 32.3) for a three-dimensional framework, particularly a scaffold (20), comprising a fastening mechanism (38) for attaching a railing device (28) to the prop (32.1, 32.3). The invention also relates to a connecting assembly for a railing device (28), comprising at least one prop (32.1, 32.3) for a three-dimensional framework, especially a scaffold (20), and a railing device (28) which can be attached to the prop (32.1, 32.3) with the help of a fastening mechanism (38). Also disclosed is a method for attaching a railing device (28) to a prop (32.1, 32.3) for a three-dimensional framework, especially a scaffold (20), with the help of a fastening mechanism (38). The fastening mechanism (38) encompasses a locking element which can be swiveled about a swivel pin. In the locked position, the locking surface of the locking element lies across from a bearing surface (43) of a support element that is mounted on the prop (32.1, 32.3). Furthermore, in the locked position and in the operational position of the prop (32.1, 32.3), the locking surface of the locking element is disposed at a vertical distance above the bearing surface of the support element, and/or in the operational position of the prop (32.1, 32.3), the swivel pin is placed at a vertical distance above the locking surface that is in the locking position, preferably also at a vertical distance above the bearing surface of the support element.

26 Claims, 28 Drawing Sheets

(56) References Cited

U.S. PATENT DOCUMENTS

| | | | | | |
|---|---|---|---|---|---|
| 1,359,452 | A | * | 11/1920 | Walker | 182/222 |
| 1,890,029 | A | * | 12/1932 | Delfs | 182/119 |
| 2,561,938 | A | * | 7/1951 | Meng et al. | 403/49 |
| 2,665,950 | A | * | 1/1954 | Johnson | 52/637 |
| 2,674,476 | A | * | 4/1954 | Del Grosso | 403/49 |
| 2,708,606 | A | * | 5/1955 | Schumacher | 403/49 |
| 2,726,902 | A | * | 12/1955 | Borgman et al. | 403/49 |
| 2,813,759 | A | | 11/1957 | Braun | |
| 2,814,535 | A | * | 11/1957 | Jagiel | 403/49 |
| 2,845,307 | A | * | 7/1958 | Holmes | 403/49 |
| 2,849,258 | A | * | 8/1958 | Crook | 403/49 |
| 2,891,820 | A | * | 6/1959 | Schoeneberg | 403/376 |
| 2,941,616 | A | * | 6/1960 | Grover et al. | 182/115 |
| 2,971,786 | A | | 2/1961 | May | |
| 3,017,208 | A | * | 1/1962 | Wyse | 403/49 |
| 3,122,385 | A | * | 2/1964 | Levizzani | 403/49 |
| 3,174,779 | A | * | 3/1965 | Moritz | 403/49 |
| 3,221,837 | A | * | 12/1965 | Fisher | 182/115 |
| 3,302,751 | A | * | 2/1967 | Ahlberg | 182/118 |
| 3,360,287 | A | * | 12/1967 | Wyse | 403/217 |
| 3,454,131 | A | * | 7/1969 | Johnson et al. | 182/115 |
| 3,551,011 | A | * | 12/1970 | Alley | 403/49 |
| 3,565,212 | A | * | 2/1971 | Johnson | 182/222 |
| 3,751,081 | A | * | 8/1973 | Schimmel et al. | 403/49 |
| 3,752,262 | A | * | 8/1973 | Helms | 182/113 |
| 3,807,884 | A | | 4/1974 | Juculano | |
| 3,837,427 | A | * | 9/1974 | Mattinson | 182/115 |
| 3,867,043 | A | * | 2/1975 | Plough | 403/49 |
| 4,388,982 | A | * | 6/1983 | Yonahara | 182/82 |
| 4,401,186 | A | * | 8/1983 | Dobersch | 182/113 |
| 4,493,394 | A | * | 1/1985 | Karlsen | 182/186.8 |
| 4,830,144 | A | * | 5/1989 | Werner | 182/178.5 |
| 4,909,483 | A | * | 3/1990 | van Herpen | 256/59 |
| 5,040,916 | A | * | 8/1991 | Morgan | 403/387 |
| 5,127,757 | A | * | 7/1992 | Langer | 403/49 |
| 5,145,030 | A | * | 9/1992 | Pavlescak et al. | 182/113 |
| 5,263,550 | A | * | 11/1993 | Jines et al. | 182/113 |
| 5,427,465 | A | * | 6/1995 | Sato | 403/49 |
| 6,027,276 | A | * | 2/2000 | Schworer | 403/49 |
| 6,039,150 | A | * | 3/2000 | Palmer | 182/113 |
| 6,045,287 | A | * | 4/2000 | Busch | 403/49 |
| 6,062,341 | A | * | 5/2000 | Frank et al. | 182/113 |
| 6,422,345 | B1 | * | 7/2002 | Schworer | 182/179.1 |
| 6,732,836 | B2 | * | 5/2004 | Ono | 182/113 |
| 6,932,195 | B1 | * | 8/2005 | Hayman et al. | 182/178.1 |
| 6,976,557 | B2 | * | 12/2005 | Becker | 182/113 |
| 7,032,712 | B2 | * | 4/2006 | Schworer | 182/178.1 |
| 7,077,239 | B1 | * | 7/2006 | Hayman et al. | 182/178.1 |
| 7,448,819 | B1 | * | 11/2008 | Fu | 403/49 |
| 7,954,598 | B2 | * | 6/2011 | Wallther | 182/113 |
| 7,975,803 | B2 | * | 7/2011 | Schwoerer | 182/178.1 |
| 8,104,579 | B1 | * | 1/2012 | Fu | 182/186.8 |
| 2011/0088973 | A1 | * | 4/2011 | Shih | 182/115 |

FOREIGN PATENT DOCUMENTS

| | | |
|---|---|---|
| DE | 90 210 | 5/1972 |
| DE | 27 57 189 | 6/1979 |
| DE | 31 08 020 | 9/1982 |
| DE | 31 39 980 | 4/1983 |
| DE | 87 11 664 | 12/1987 |
| DE | 38 32 480 | 3/1990 |
| DE | 42 34 473 | 4/1993 |
| DE | 44 06 732 | 1/1995 |
| DE | 195 04 038 | 8/1996 |
| DE | 196 33 092 | 2/1998 |
| DE | 197 03 558 | 8/1998 |
| DE | 198 27 284 | 12/1999 |
| DE | 199 19 358 | 7/2000 |
| DE | 100 10 229 | 8/2001 |
| DE | 20 2004 007 550 | 7/2004 |
| DE | 10 2004 055 394 | 7/2005 |
| DE | 20 2006 015 586.4 | 2/2008 |
| EP | 1 262 611 | 12/2002 |
| EP | 06021346.9 | 4/2008 |
| FR | 2 516 141 | 5/1983 |
| GB | 2 011 008 | 7/1979 |
| GB | 2 093 900 | 9/1982 |
| RU | 2 160 813 | 12/2000 |
| WO | WO 02/066765 | 8/2002 |

OTHER PUBLICATIONS

German Examination Report dated Nov. 29, 2007 with an English translation of the relevant parts.

EPC Communication dated Feb. 4, 2009 regarding an Extended Partial European Search Report with English translation of the relevant parts.

* cited by examiner

PROP FOR A THREE-DIMENSIONAL FRAMEWORK, CONNECTING ASSEMBLY FOR A RAILING DEVICE, AND METHOD FOR ATTACHING A RAILING DEVICE TO A PROP

CROSS REFERENCE TO RELATED APPLICATIONS

Applicant claims priority under 35 U.S.C. 119 of German Application No. 10 2007 018 314.5 filed Apr. 18, 2007. Applicant also claims priority under 35 U.S.C. 120 of International Application No. PCT/DE2008/000538 filed Mar. 27, 2008. This application is a by-pass continuation-in-part application of said International Application No. PCT/DE2008/000538 filed Mar. 27, 2008. The International Application under PCT Article 21(2) was not published in English. The disclosure of the aforesaid International Application and German application are incorporated by reference.

BACKGROUND OF THE INVENTION

1. Field of the Invention

The invention relates to a prop for a three-dimensional framework with a fastening device for fastening a railing device to the prop as well as to a connecting arrangement for a railing device, which comprises at least one prop for a three-dimensional framework and a railing device, which is fastenable to the prop with the help of a fastening device, and further relates to a method for fastening a railing device to a prop for a three-dimensional framework with the help of a fastening device.

2. The Prior Art

A number of fastening devices for fastening railing devices to props for three-dimensional frameworks, particularly to vertical scaffolding posts, have become known from practice in the past.

A particularly simple fastening construction has become known from, for example, CH-A-439679. This relates to a building scaffolding with vertical support frames, the vertical prop tubes of which are provided with U-shaped insertion eyes, into which insert ends, which are bent over downwardly at right angles, of handrail bars of railing frames are inserted. These railing frames are not secured against lifting up in upward direction, which from safety aspects is not acceptable.

Another railing fastening has become known from FR-A-25 16 141. There, scaffolding frames with vertical posts are provided, to which transverse bolts extending away therefrom are fastened. These have upwardly projecting dogs at the free ends thereof, so that these bolts form a kind of hook. The ends of a double railing or of a railing frame are hung in these hooks, for which purpose the upper two end straps of the double railing or railing frame are provided with downwardly open receiving openings forming a kind of counter-hook. The lower two end straps are provided with slots which extend in vertical direction, of which one slot is securable by a withdrawal securing means, which is pivotable about a horizontal axis, against withdrawal in the direction of the bolt of the associated hook of one of the scaffolding posts. These railings are similarly not secured against lifting off in upward direction. FR-A-25 16 141 also discloses L-shaped longitudinal bars used for connecting and fastening two adjacent scaffolding standing frames, on which L-shaped supports are supported, the supports being provided with a transverse bar on which scaffolding boards of wood can be supported in an intermediate position between the cross beams of adjacent scaffolding standing frames. These L-shaped longitudinal bars have two vertically spaced end limbs at their L-limb and a third end limb at their other end extending perpendicularly away from the L-limb. This third end limb has a downwardly open hook which can be hung in place on an upwardly open hook bolt of the post of one of the standing frames. The third end limb additionally has a hook-shaped pivot shackle which is pivotable about a transverse axis and which, when the third end limb is hung in place at the hook bolt, pivots under the hook bolt due to gravitational force and in this manner makes possible securing against lifting off in vertical direction at this end of the L-shaped longitudinal bar. Apart from the fact that faulty functioning in the case of dirtying can arise with this pivot shackle, which is not acceptable from safety aspects, this means an increased risk of injury at pivot shackles, which are fastened to the end of the L-shaped longitudinal bar, during handling of the L-shaped longitudinal bar.

Due to the aforesaid reasons other solutions have been developed by which it has been sought to avoid the aforedescribed disadvantages. These solutions can be essentially divided into two main groups.

A first main group relates to constructions in which the railing devices are secured in force-locking manner by clamping forces against lifting-off from the mounts of the supports. For that purpose, U-shaped wedge cases are usually fastened to the vertical scaffolding tube uprights by their limbs, into which straps, which are bent over downwardly at right angles, of railings are inserted and fastened thereat by means of a wedge. This has to be knocked in by a hammer in order to achieve compressing of a strap of a railing against the tubular upright or of two straps, which are hung in the same wedge case, of two railings against one another and against the tubular upright in order to thus fasten the railing or railings to be secure against vertical lifting-off in upward direction. In order to dismantle the scaffolding the wedges have to be knocked out by a suitable tool, so that the assembly and disassembly of scaffolding of that kind is only possible with a comparatively high degree of effort by means of a tool. Constructions of that kind have become known from, for example, DE-A-27 57 189, DE-A-38 32 480, DE-A-31 08 020, DE-A-198 27 284 and DE-U-20 2004 007 550 under the name 'Layher-Blitz-Gerust-System'. For specific instances of use the wedge cases can also be detachably connectible with the scaffolding posts, as disclosed in, for example, WO 02/066765 A2.

Other clamping connections by which it is sought, by a force-locking connection, to prevent or impede lifting-off of the railing in upward direction have become known from, for example, DE-PS-100 10 229 or DE-PS-199 19 358. However, due to the comparatively limited clamping forces, lifting-off of the railing in upward direction cannot be securely prevented.

Further clamping connections in which, through a frictional clamping of one or two insertion straps, which are inserted into a U-shaped stirrup, of railings to the scaffolding post, a fastening of the railing to the scaffolding post also against vertical lifting-off is achievable have become known from, for example, DE-A-42 34 473 and DE-A-195 04 038. In these constructions the clamping of the railing strips, which are bent over downwardly at right angles, relative to the scaffolding post is achieved with the help of an eccentric lever pivotable about a horizontal transverse axis. In these clamping constructions comparatively large clamping forces have to be applied in order to secure the railings against lifting off in upward direction, which requires correspondingly high operating forces during locking and unlocking. Moreover, the use possibilities of these constructions are confined to horizontal scaffolding attachments in which the railings can be installed only from the same scaffolding tier, which can mean a safety risk.

A second main group of railing fastening constructions concerns solutions in which the railings are connected with the scaffolding posts in purely mechanically positive manner.

In a first subgroup, for this purpose cross bolts onto which the railings provided with matching passage holes are plugged are fastened to the vertical scaffolding props to produce transversely to the longitudinal axes thereof. The first subgroup can be subdivided into two further groups:

In a first group of this first subgroup of the second main group use is made of cylinder bolts which have at the free ends thereof a vertical slot in which a tilt pin strap is arranged to be pivotable about a horizontal transverse axis. For fastening of a railing to the scaffolding posts the tilt pin straps have to be transferred into an unlocking setting enabling introduction of the railing strips, which are provided with matching passage holes, onto the cylinder bolts. After the introduction and plugging on of the apertured railing strips the respective tilt pin strap has to be transferred back into a vertical locking setting, which in principle is achieved by itself with gravitational force assistance. However, if—as frequently occurs in practice—the free ends of the cylinder bolts are contaminated, for example by paint, faulty functions can arise so that the tilt pin straps concerned then have to be laboriously locked again by hand. This means an unacceptably high amount of effort or, for the case of inattention, a significant safety risk. Constructions of that kind have become known from, for example, DE-U-87 11 664, DE-A-31 39 980, DE-A-197 03 558 and DE-A-10 2004 055 394.

A second group of the first subgroup of the second main group concerns similar constructions which are thus based on the same fundamental principle, namely fastening to scaffolding posts transversely protruding bolts onto which railings provided with passage holes are plugged. However, in these constructions, such as have become known from, for example, DE-A-196 33 092 or EP-A-1 262 611, use is not made of pivotable tilt pin straps. In these fastening constructions the inner contour of the passage holes of the railings and the outer contour of the bolts receiving these are formed to be matched to one another in such a manner that plugging of the railings onto the bolts is possible only obliquely from below, i.e. from the scaffolding tier disposed thereunder, in that the railing is plugged from below onto the bolt at an angle of less than 90 degrees relative to the longitudinal axis of the scaffolding post. Subsequently, through pivoting of the railing upwardly into a horizontal use or installation setting a mechanically positive locking of the railing relative to the scaffolding post also in the direction of the longitudinal axis of the plug-on bolt is achieved at the same time. A horizontal mounting of railings from the same scaffolding tier is not possible with these constructions.

An intermediate variant of the second main group has become known from DE-A-10 2004 055 394 already mentioned in the foregoing. In this construction, which is now again provided with tilt pivot straps, the railing ends are provided with slots which extend radially outwardly from the plug-through opening for the cylinder bolts and are arranged at specific angles relative to the longitudinal axis of the railing and which enable insertion of tilt pin straps and plugging-on of the railing end also from the scaffolding tier disposed thereunder. After plugging of the railing from below onto the tilt pin straps and onto the cylinder bolts a mechanically positive locking also in the direction of the transverse bolt is again, achieved by pivoting the railing upwardly into its horizontal use or installation setting.

All these constructions associated with the first subgroup and the intermediate variants of the second main group have, however, the disadvantage that when the ends of two railings are plugged onto the bolts the rearward railing, thus that lying closer to the scaffolding post, cannot be demounted without the front railing, thus that lying further away from the scaffolding post, also being demounted beforehand.

Another construction concerning a railing fastening, which can be associated with a second subgroup of the second main group, in which the railings are similarly connected in purely mechanically positive manner with the scaffolding posts, has become known from DD 90 210 A. In that case a strap is welded to a tubular post which, with formation of a receptacle for railing strips to be inserted vertically, is profiled in L-shaped manner and bent over upwardly as well as open upwardly. In the region of the upper free end of the L-strap this is provided with a vertical slot. Projecting through this vertical slot is a nose of a drop latch which is pivotable about a horizontal pivot axis and which is rotatably mounted on a horizontal pin. The pin is welded to the L-strap with bridging-over of the vertical slot thereof. For the purpose of fastening two railing strips or in a given case also only one railing strip to the tubular post these are or this is introduced, vertically from above, vertically downwardly into the receptacle formed by the L-strap. The nose of the drop latch is thereby pivoted away into a release setting. In the course of a further introduction of the respective railing strip this is introduced vertically downwardly until the nose of the drop latch pivots, under gravitational force, back into its initial setting. Then or thereafter the respective railing strip comes to rest on the lower L-limb of the L-strap. For removal of the two railing strips or in a given case also only one of the railing strips the drop latch has to be manually pivoted upwardly about its pivot axis into a release setting making it possible to pull out the respective railing strip vertically upwardly, whereupon the respective railing strip can be pushed vertically upwardly out of the railing receptacle formed by the L-strap.

In this railing fastening it is necessary, due to the construction, to provide between the upper edges of the railing strips to be secured and the nose—which secures these against vertical lifting-off—of the drop latch an appropriately large gap enabling pivotation of the nose of the drop latch. As a result, the railing strips can be fastened only very loosely and with considerable vertical play, which means a safety risk. Moreover, this construction, due to the drop latch protruding laterally in the locking setting, requires a comparatively large amount of space and the risk exists that persons are caught at the drop latch. Finally, the risk exists that the upwardly open L-strap under the rough conditions in practice twists outwardly away from the tubular post so that then the railing strips are no longer secured against vertical lifting off. This means a significant safety risk.

SUMMARY OF THE INVENTION

It is an object of the invention to provide a prop for a three-dimensional framework with a fastening device or with a railing-device fastening device for fastening a railing device to the prop and a connecting arrangement for a railing device, which comprises at least one prop for a three-dimensional framework and a railing device, which with the help of a fastening device or a railing-device fastening device is fastenable to the prop, and also to provide a method of fastening a railing device to a prop, by which or with which, with maintenance of as many as possible of the advantages that have become known from the prior art, the disadvantages described in the foregoing are avoided, particularly by which or with which advantageous possibilities for securing or locking the railing device and/or for mounting and/or for demounting the railing device, as well as for a particularly stable construction, are created. It is further an object of the invention to be able to produce a prop of that kind with a fastening device or with a railing-device fastening device and a connecting arrangement of that kind simply and economically. Moreover, it is an object of the invention to provide a connecting arrangement which can be assembled and disassembled simply and quickly. A further object of the invention is to provide a prop with a fastening device and a connecting arrangement which enable advantageous possibilities for installation and removal of a railing device not only from the same scaffolding tier, but also from below as an advance railing. Finally, it is an object of the invention to provide a connecting arrangement in which demounting of a railing device is possible without requiring demounting of a neighbouring railing device.

This object or these objects are preferably fulfilled by the features according to the invention.

According to a first solution concept or according to a first invention group there can be provided a prop, particularly a vertical post, of metal for scaffolding, particularly for facade scaffolding, a stage, a staircase or like three-dimensional framework, with a fastening device for fastening at least one railing device, particularly a single or double railing, preferably a railing rod, to the prop, wherein the fastening device comprises a mount for the railing device, wherein the mount is fastened, preferably captively, in particular permanently, for example by welding, to the prop, and wherein the mount comprises a rest element, which extends in a first direction transversely, preferably perpendicularly, to the longitudinal axis of the prop away therefrom, with a rest surface, which is horizontal in use setting of the prop, for vertical support of the railing device, wherein the fastening device further comprises a locking element, which is firmly, preferably captively, connected with the prop and preferably formed with or as a locking lever, with a locking surface for mechanically positive locking in a locking setting, preferably free of clamping force, of the railing device against vertical removal thereof in upward direction when the prop is in use setting, wherein the locking element is pivotable, preferably manually, about a pivot axis from an unlocking setting into the locking setting and conversely wherein the locking surface of the locking element in the locking setting lies opposite the rest surface of the rest element and in the locking setting as well as in use setting of the prop is arranged at a vertical spacing above the rest surface of the rest element and/or that the pivot axis in use setting of the prop is arranged at a vertical spacing above the locking surface disposed in the locking setting, preferably also at a vertical spacing above the rest surface of the rest element. For preference, the mount has a passage opening, which is closed or surrounded at the whole circumference or entirely or substantially at the whole circumference, for insertion of an end of the at least one railing device, particularly the railing rod, the opening being bounded by a support element—which extends at a transverse spacing from the prop and preferably parallel to the longitudinal axis of the prop, particularly upwardly in the use setting thereof, and which is connected, preferably integrally, with the rest element—of the mount for lateral support of a rest part of the railing device.

Due to the fact that the mount has a passage opening, which is closed or surrounded at the whole circumference or entirely or substantially at the whole circumference, for insertion of an end of the at least one railing device, particularly the or a railing rod, which opening is bounded by a support element—which extends at a transverse spacing from prop and is preferably parallel to the longitudinal axis of the prop, particularly upwardly in the use setting thereof, and which is connected, preferably integrally, with the rest element—of the mount for lateral support of a rest part of the railing device, there is made possible not only simple and economic production, but also a particularly stable construction of the mount, whereby the locking element is fastenable and storable particularly stably and securely. By a passage opening which is "closed or surrounded at the whole circumference or entirely or substantially at the whole circumference" there can be understood in the sense of this protective right a passage opening bounded by wall parts which form one or more bodies surrounding the passage body at the whole circumference or entirely or substantially at the whole circumference.

According to a second solution concept or according to a second invention group or according to an advantageous embodiment there can be provide a prop, particularly a vertical post, of metal for scaffolding, a stage, a staircase or like three-dimensional framework, with a fastening device for fastening at least one railing device, particularly a single or double railing, preferably a railing rod, to the prop, wherein the fastening device comprises a mount for the railing device, wherein the mount is permanently fastened, preferably by welding, to the prop, and wherein the mount comprises a rest element, which extends in a first direction transversely, preferably perpendicularly, to the longitudinal axis of the prop away therefrom, with a rest surface, which is horizontal in use setting of the prop, for vertical support of the railing device, wherein the fastening device further comprises a locking element, which is firmly, preferably captively, connected with the prop and preferably formed with or as a locking lever, with a locking surface for mechanically positive locking in a locking setting, preferably free of clamping force, of the railing device against vertical removal thereof in upward direction when the prop is in use setting, wherein the locking element is pivotable, preferably manually, about a pivot axis from an unlocking setting into the locking setting and conversely, wherein the locking surface of the locking element in the locking setting lies opposite the rest surface of the rest element and in the locking setting as well as in use setting of the prop is arranged at a vertical spacing above the rest surface of the rest element and wherein on pivotation of the locking element about the pivot axis from an unlocking or open setting into the locking or closed setting the locking surface of the locking element is pivoted downwardly when the prop is in use setting.

Through the foregoing measures a particularly simple or easy and secure locking as well as a particularly simple or easy unlocking or release can be carried out by a user. Moreover, through this measure it is possible to achieve a secure locking or a high degree of security against unintended unlocking.

In both solution concepts or invention groups the locking element can be fastened preferably with the help of a fastening means containing the pivot axis, particularly a rivet or a bolt or a pin, particularly a dowel pin—which is preferably slotted—or a grooved pin, to the prop or to the mount, preferably to the support element, or not to the mount or not to a part of the mount containing the receiving element of the mount or not to a or the support element of the mount for lateral support of a rest part of the railing device, but to the prop or to another part of the prop, preferably to a separate fastening body fastened to the prop, preferably permanently, particularly by welding, and preferably at a spacing from the mount.

According to a further solution concept or according to a third invention group or according to an alternative or additional embodiment there can be provided a prop, particularly a vertical post, of metal for scaffolding, a stage, a staircase or like three-dimensional framework, with a fastening device for fastening at least one railing device, particularly a single or double railing, preferably a railing rod, to the prop, wherein the fastening device comprises a mount for the railing device, wherein the mount is permanently fastened, preferably by welding, to the prop, and wherein the mount comprises a rest element, which extends in a first direction transversely, preferably perpendicularly, to the longitudinal axis of the prop away therefrom, with a rest surface, which is horizontal in use setting of the prop, for vertical support of the railing device, wherein the fastening device further comprises a locking element, which is firmly, preferably captively, connected with the prop and preferably formed with or as a locking lever, with a locking surface for—in a locking setting—mechanically positive locking, preferably free of clamping force, of the railing device against vertical removal thereof in upward direction when the prop is in use setting, wherein the locking element is pivotable, preferably manually, about a pivot axis from an unlocking setting into a locking setting and conversely, wherein the locking surface of the locking element in the locking setting is opposite the rest surface of the rest element and in the locking setting as well as in use setting of the prop is arranged at a vertical spacing above the rest surface of the rest element and wherein the locking element is fastened, preferably with the help of a fastening means containing the pivot axis, particularly a rivet or a bolt or a pin, particularly a—preferably slotted—dowel pin or a grooved pin, not to the mount or not to a part of the mount containing the receiving element of the mount or not to a or the support element of the mount for lateral support of a rest part of the railing device, but to the prop or to another part of the prop, preferably to a separate fastening body fastened, preferably permanently, particularly by welding, and preferably at a spacing from the mount, to the prop.

Through these measures it is possible to achieve a particularly stable construction or fastening possibility for the locking element. A construction of that kind can equally be produced particularly simply and economically. Moreover, advantageous suspension possibilities for the railing device can be achieved by the aforesaid measures.

In the second and/or third solution alternative or in the second and/or third invention group it can be provided that the mount has a passage opening, which is closed or surrounded at the whole circumference or entirely or substantially at the whole circumference, for insertion of an end of the at least one railing device, particularly the railing rod, which is bounded by a support element—which extends at a transverse spacing from the prop and preferably parallel to the longitudinal axis of the prop, particularly upwardly in the use setting thereof, and which is connected, preferably integrally, with the rest element—of the mount for lateral support of the rest part of the railing device. This makes possible not only a simple and economic product ion, but also a particularly stable construction of the mount.

In all three solution alternatives or invention groups, optionally also in combinations of two or all three of these solution alternatives or invention groups, provision can be made for the pivot axis to extend transversely, preferably perpendicularly, to the longitudinal axis of the prop or transversely, preferably perpendicularly, to the first direction.

However, it is of particular advantage if the pivot axis extends transversely, preferably perpendicularly, to the longitudinal axis of the prop and also transversely, preferably perpendicularly, to the first direction.

In addition, it can be provided that the mount is formed with a receiving profile, which is upwardly open in use setting of the prop, for reception of a rest part of the railing device, which is constructed with a support element—which extends at a transverse spacing from the prop and preferably parallel to the longitudinal axis of the prop, particularly upwardly in the use setting thereof, and is connected, preferably integrally, with the rest element and fastened thereto—of the mount for lateral support of the rest part of the railing device, wherein a passage opening for reception of the rest part of the railing device is formed between the support element and the prop.

In that case it is of advantage if the receiving profile is formed as a half U-profile, half C-profile or half V-profile or as a J-profile or as a U-profile, C-profile or V-profile.

Moreover, it is a advantage if the opening edge of the passage opening s pans a vertical opening plane in use setting of the prop.

It is of particular advantage if the passage opening in use setting of the prop is formed as a vertical receiving slot extending in the direction of, preferably parallel to, the longitudinal axis of the prop.

According to a particularly simply and economically producible variant of embodiment it can be provided that the mount is formed with or as a stirrup, preferably of a flat material, which has or bounds a passage opening for reception of a rest part of the railing device.

In that case it can be provided that the stirrup extends in the direction of, preferably parallel to, the longitudinal axis of the prop.

With preference it can be provided that the mount is a punched, cast or forged part of metal.

Moreover, provision can be made for the locking element, which is preferably formed with a locking lever or formed as a locking lever, to be fastened to the prop or to the mount, preferably to the support element.

Furthermore, it can be provided that the locking element or the locking lever is fastened to the prop or to the mount, preferably to the support element, with the help of a fastening means containing the pivot axis, preferably a rivet.

For preference it can be provided that the locking element is formed as or with a locking lever which is manually actuable or to be manually actuated and which preferably consists of plastics material or of metal.

Provision can be made for the locking lever to have an actuating part which, in the locking setting, protrudes beyond the edge of the mount which is lower when the prop is in the use setting. This makes possible a particularly simple opening or unlocking of the locking lever by hand, particularly by a finger of the hand of a user.

Moreover, it can be provided that the locking lever has an actuating part which extends transversely, preferably perpendicularly, away from the pivot axis and which is preferably elongate. This can have a length which is greater, particularly very much greater, than the width of the actuating part or of the locking lever overall. Particularly as a result and, in a given case, in conjunction with a conspicuous coloration of the locking element it is clearly apparent whether the locking lever is disposed in its locking setting and thus whether or not the railing device suspended there is actually secured.

In that case it can be provided that the locking lever has a longitudinal slot, which extends preferably transversely, particularly perpendicularly, to the pivot axis and in which in the locking setting a part of the vertical support element of the mount is received. In this manner the projection beyond the prop and also the risk of injury in the locking setting are minimised.

Moreover, it can be provided that the locking lever and the mount are formed to be so matched to one another that the locking lever in the locking setting is releasably detented at the mount or at a counter-body fastened thereto so that the locking lever is pivotable from the locking setting to an open setting or to the unlocking setting only by application of an increased opening force. As a result, the point from which the locking lever is disposed in a secure locking setting is made particularly clear to the user, this being made noticeable on the one hand in the case of actuation by hand through a diminishing of the closing force and on the other hand by a clearly audible noise on folding closed or locking of the locking lever.

In addition, provision can be made for the locking element to comprise a pressing body which on pivotation of the locking element from the unlocking setting to the locking setting comes into engagement or stands in engagement with a counter-body, which is firmly fastened, preferably permanently, to the prop or to the mount, preferably to the support element, and/or which is formed by a part of the prop, wherein the pressing body and the counter-body are formed to be so matched to one another that on pivotation of the locking element from the unlocking setting to the locking setting a pressing force opposing unintended unlocking of the locking element is formed between the pressing body and the counter-body and/or that in the locking setting a pressing force opposing unintended unlocking of the locking element is formed between the pressing body and the counter-body.

In that case it can be provided that the pressing body and/or the counter-body is or are constructed as an eccentric body.

For preference, provision can be made for the pressing body to be formed as an eccentric body arranged eccentrically to the pivot axis.

In a preferred embodiment it can be provided that the counter-body is formed as a, preferably cylindrical, pin or bolt which is fastened firmly, preferably non-detachably, to the prop or to the mount, preferably to the support element.

In that case it can be provided that the longitudinal axis of the pin or bolt extends transversely, preferably perpendicularly, to the longitudinal axis of the prop or extends transversely, preferably perpendicularly, to the first direction. However, in a particularly advantageous embodiment provision can be made for the longitudinal axis of the pin or bolt to extend transversely, preferably perpendicularly, to the longitudinal axis of the prop and transversely, preferably perpendicularly, to the first direction.

Moreover, it can with advantage be provided that the locking lever has a detent recess in which the pin or bolt, which is fastened to the prop or to the mount, preferably to the support element, engages in detenting manner in the locking setting.

Furthermore, it can be provided that the locking lever on pivotation about its pivot axis is pivotable, preferably upwardly, from the closing or locking setting into an or the open or unlocking setting only through a maximum opening angle which is limited by an abutment and which is smaller than 60 degrees, preferably smaller than or equal to approximately 45 degrees. As a result, the risk of a person being caught at the locking lever protruding in its open or unlocking setting can be reduced.

In that case it can be provided that the abutment is formed with a lug which is provided in the region of the, preferably upper, end of the mount and is connected, preferably integrally, with the mount. This construction can be realised or produced particularly simply and economically.

Moreover, provision can be made for the locking lever in the maximum open or unlocking setting, which is preferably limited by an or the abutment, to not project into a or the passage opening, which serves for insertion of an end of the at least one railing device, of the mount. In other words, it can be provided that—in the maximum open or unlocking setting, which is preferably limited by an or the abutment, of the locking lever—a or the passage opening, which serves for insertion of an end of the at least one railing device, of the mount does not cover or conceal the passage opening or the opening cross-sectional area thereof of the locking lever or of parts of the same. As a result, during insertion or hanging in place and placing as well as during removal and withdrawal or unhanging of the railing device collisions with the locking lever do not occur, which simplifies mounting and demounting of the railing device.

Moreover, it can be provided that the locking lever in the maximum open or unlocking setting, which is preferably limited by an or the abutment, bears by a or the pressing body against a or the counter-body, which is fastened to the mount and preferably formed as a bolt or pin, so that a downward pivotation, which is induced by gravitational force, of the locking lever about its pivot axis is prevented. It is thereby in turn ensured that the passage opening of the mount remains free of the locking lever, which is disposed in the unlocking or open setting, or of parts thereof.

The invention also relates also to a connecting arrangement for a railing device, which comprises at least one prop for scaffolding, particularly facade scaffolding, a stage, a staircase or like three-dimensional framework, according to at least one of claims 1 to 31, and a railing device, which is formed particularly as a single or double railing and is preferably formed with or as a railing rod and which is fastenable to the prop with the help of the fastening device.

It can be characteristic for a connecting arrangement of that kind that the locking surface of the locking element in the locking setting is opposite the rest surface of the rest element and in the locking setting as well as in use setting of the prop is arranged above the rest surface of the rest element at a vertical spacing which is greater than the height of a rest part, which rests on the rest surface of the rest element of the mount, of the railing element and/or that the pivot axis in use setting of the prop is arranged at a vertical spacing above the locking surface—which is disposed in the locking setting—preferably also at a vertical spacing above the rest surface of the rest element, which is greater than the height of a or the rest part, which rests on the rest surface of the rest element of the mount, of the railing device.

The invention further relates to a connecting arrangement for a railing device, which comprises at least one prop, particularly a vertical post, of metal for scaffolding, particularly facade scaffolding, a stage, a staircase or like three-dimensional framework, and at least one railing device, which is formed as, in particular, a single or double railing and preferably formed with or as a railing rod and which is fastenable with the help of a fastening device to the prop, wherein the prop comprises a mount for the railing device, wherein the mount is fastened, preferably captively, in particular permanently, for example by welding, to the prop, and wherein the mount comprises a rest element, which extends in a first direction transversely, preferably perpendicularly, to the longitudinal axis of the prop away therefrom, with a rest surface, which is horizontal in use setting of the prop, for vertical support of the railing device, on which a rest part, which is preferably arranged in the region of an end of the railing device or the railing rod, of the railing device can be supported and wherein the fastening device further comprises a locking element, which is firmly, preferably captively, connected with the prop, with a locking surface for mechanically positive locking, preferably free of clamping force, of the railing device against vertical removal thereof in upward direction when the prop is in use setting, wherein the locking element is pivotable, preferably manually, about a pivot axis from an unlocking setting, in which the railing device can rest on the rest surface of the rest element of the mount or is removable from the mount, into a locking setting and conversely, in which the railing device is locked by means of the locking element against removal from the mount at least in one direction and in which the railing device is secured against removal in any directions from the mount, wherein the locking element is transferrable from a locking setting, in which the railing device is mechanically positively locked, preferably free of clamping force, by means of the locking element against withdrawal from the mount upwardly in the direction of, preferably parallel to, the longitudinal axis of the prop when the prop is in use setting, to an unlocking setting, and conversely, in which the railing device is removable from the mount, without previous lifting off in the first direction from the rest surface of the rest element, at least horizontally in a second direction transversely, preferably perpendicularly, to the longitudinal axis of the prop when the prop is in use setting and also transversely, preferably perpendicularly, to the first direction, preferably after previous lifting off from the rest surface of the rest element in upward direction.

In that case it can be provided that the fastening device and the railing device are formed to be so matched to one another that the railing device, although the locking device is disposed in the locking setting, is placeable from below, particularly obliquely from below, on the rest surface of the rest element of the mount, or can be suspended there, when the prop is in use setting and, starting from this setting, is pivotably upwardly and transferrable to an installation setting in which the railing device is secured against removal from the mount in any directions.

Moreover, it can be provided that the mount is formed with a receiving profile, which is upwardly open in use setting of the prop, for reception of a rest part of the railing device, in which the rest part of the railing device is at least partly received while being supported on the rest surface of the rest element, wherein the receiving profile is formed with a support element, which extends at a transverse spacing from the prop and preferably parallel to the longitudinal axis of the prop, particularly upwardly in the use setting thereof, and which is connected, preferably integrally, with the rest element and fastened thereto, for lateral support of the rest part of the railing device, wherein a passage opening for reception of the rest part of the railing device, which passes horizontally through the passage opening in use setting of the prop, is formed between the support element and the prop.

Furthermore, provision can be made for the mount to have a passage opening, which is closed entirely or substantially at the full circumference, for insertion of an end of the at least one railing device, particularly of the railing rod, through which opening the end of the railing device or of the railing rod is inserted.

Finally, in a preferred embodiment it can be provided that the passage opening in use setting of the prop is formed as a vertical receiving slot, which extends in the direction of, preferably parallel to, the longitudinal axis of the prop and into or through which the rest part of the railing device, preferably the end of the railing device or of the railing rod, is inserted.

In that case it can be provided that the receiving slot has a height which is greater than the width or the height of at least one end of the ends of the railing device or of the railing rod.

Moreover, it can provided that the passage opening has a width which is greater than the thickness or width of the rest part of the railing device. In a preferred embodiment it can be provided that the passage opening has a width which greater than twice the thickness or width of the rest part of the railing device. In this manner at least two railing devices can, by the rest parts thereof, be placed on one and the same mount or hung in one and the same mount.

Furthermore, provision can be made for the ends, which are intended for support on the rest element of the mount of the railing device, which is preferably formed as or with a railing rod, to be formed to be flattened.

Moreover, it can be provided that the railing device has in the region of at least one end of its, preferably flattened, ends an outwardly open first recess, which extends in the direction of, preferably parallel to, the longitudinal axis of the end or of the railing rod and is bounded by the rest part for support on the rest surface of the rest element of the mount and which is bounded by a first wall part, particularly a lug, extending transversely, preferably perpendicularly, to the longitudinal axis of the end or of the railing rod.

In that case provision can be made for at least one wall part of the wall parts, which laterally bound the first recess in the direction of the longitudinal axis of the end or of the railing rod, to be formed on the side of the recess to be radiussed, particularly concavely radiussed, and/or chamfered, for example with an entry chamfer. This enables a better or easier lowering of the railing device.

Moreover, it can be provided that a second recess adjoins the first wall part or the lug in the region of the first recess and is bounded by a rest surface, which extends in the direction of, preferably parallel to, the longitudinal axis of the end or of the railing rod and is deepened relative to the first recess or the rest surface thereof, of the rest part and by two support surfaces, which are preferably parallel and have a support surface spacing from one another and which extend transversely, preferably perpendicularly to the longitudinal axis of the end of the railing device or of the railing rod, wherein the support surface spacing is greater than the width of the rest element of the mount in the region of the rest surface thereof. As a result, a defined detenting and rest position of the railing device on the rest element of the mount is defined and advantageous possibilities for a mechanically positive connection of these elements result.

In that case it can be provided that the support surface spacing is approximately 1.5 to 3 times the width of the rest element in the region of the rest surface thereof. The play of the railing device relative to the rest element of the mount or the rest elements of the mounts can thereby be minimised with consideration of production and assembly tolerances.

In addition, it can be provided that the length of the first recess extending in the direction of the longitudinal axis of the end or of the railing rod is greater than the spacing, measured in the same direction, between the support surface—which is associated with the free end of the railing device or of the railing rod—of the second recess and this free end of the railing device or of the railing rod.

Moreover, it can be provided that the railing rod inclusive of its ends is formed as a straight rod, thus without the ends being bent over and/or angled. This enables a particularly simple and economic production as well as a particularly simple and space-saving storage of a railing rod of that kind.

It is of particular advantage if the spacing between the rest surface of the rest element and the locking surface of the locking element in the locking setting is greater than the spacing, preferably the greatest spacing, between the surface, which faces away from the free end of the railing device or of the railing rod and which bounds the first recess, of the first wall part or the lug and this free end of the railing device or of the railing rod, in particular is greater than the greatest spacing between the support surface, which faces away from the free end of the railing device or of the railing rod and which bounds the second recess, and this free end of the railing device or of the railing rod. As a result, in this way the railing device—even when the locking element is disposed in its locking setting or despite the locking element being disposed in its locking setting—can be placed or hung in place from below, particularly from a scaffolding tier disposed thereunder, at or in the rest element and can be subsequently pivoted upwardly into its horizontal installation or use setting without the locking element having to be transferred from its locking setting to an open or unlocking setting, wherein then in this installation or use setting a fastening of the railing device to the prop with mechanically positive securing against vertical lifting off in upward direction is already guaranteed in any directions without further measures.

The invention also relates to a vertical frame element with at least one prop and/or with at least one connecting arrangement, which is additionally formed in accordance with the subject, in particular according to at least one of the claims, of European Patent Application No 06021346.9 or of German Utility Model Application No 20 2006 015 586.4.

The invention further relates to a scaffolding frame, particularly scaffolding standing frame, with at least one prop and with at least one transverse arm, which is fastened, preferably captively, in particular permanently, for example by welding, at least to the at least one prop.

The invention additionally relates to a scaffolding frame, particularly scaffolding standing frame, with at least one connecting arrangement, wherein at least one transverse element is fastened, preferably captively, in particular permanently, for example by welding, to the at least one prop.

Finally, the invention also relates to scaffolding, particularly building scaffolding, preferably facade scaffolding, with at least four vertical props, at which preferably at least one covering unit, particularly a scaffolding floor, horizontal rod elements and/or at least one diagonal element for stiffening the scaffolding, are mounted, and with at least one prop and/or with at least one connecting arrangement and/or with at least one vertical frame element and/or with at least one scaffolding frame.

The invention also relates to a method of fastening at least one railing device with the help of a fastening device to a prop for scaffolding, particularly facade scaffolding, a stage, a staircase or like three-dimensional framework, wherein the fastening device comprises a mount for the railing device and wherein the mount is fastened, preferably captively, in particular permanently, for example by welding, to the prop, in particular to a vertical post, of metal, and wherein the mount comprises a rest element, which extends in a first direction transversely, preferably perpendicularly, to the longitudinal axis of the prop away therefrom, with a rest surface, which is horizontal in use setting of the prop, for vertical support of the railing device, which is formed in particular as a single or double railing and preferably with or as a railing rod and which preferably forms a part of a connecting arrangement, wherein a rest part, which is preferably arranged in the region of an end of the railing device or of the railing rod, of the railing device can be supported on the rest surface of the rest element, and wherein the fastening device further comprises a locking element, which is firmly, preferably captively, connected with the prop and preferably formed with or as a locking lever, with a locking surface for mechanically positive locking, preferably free of clamping force, of the railing device against vertical removal thereof in upward direction when the prop is in use setting, and wherein the locking element is pivotable, preferably manually, in particular in downward direction in use setting of the prop, about a pivot axis from an unlocking setting, in which the railing device can be placed on the rest surface of the rest element of the mount or removed from the mount, into a locking setting, and conversely, in which the railing device is locked by means of the locking element against removal from the mount at least in one direction and in which the railing device is secured against removal in any directions from the mount, wherein the railing device is placed or plugged—before the locking element has be en transferred into its locking setting, or in unlocking setting—horizontally in a second direction transversely, preferably perpendicularly, to the longitudinal axis of the prop and also transversely, preferably perpendicularly, to the first direction on or onto the rest surface of the rest element of the mount and subsequently the locking element is transferred to its locking setting in which the railing device is mechanically positively locked, preferably free of clamping force, by means of the locking element against removal from the mount upwardly in the direction of, preferably parallel to, the longitudinal axis of the prop when the prop is in use setting.

In an advantageous embodiment of the afore-described method it can be provided that the railing device or the railing rod is initially placed in the region of a rest surface of the first recess of a first end of the ends thereof on the rest surface of the rest element of the mount of a first prop, preferably horizontally in the use setting thereof, wherein the locking element of the fastening device of the first prop is disposed in its unlocking setting and that subsequently the railing device or the railing rod is displaced in the direction of the mount of an adjacent second prop, until the respective rest surface of the respective second recess of the two ends of this railing device or of this railing rod comes to lie on the respectively associated rest surface of the respective rest element of the respective mount with format ion of a mechanically positive connection between the railing device and the two props, and that subsequently the locking elements of the fastening devices of the two props are pivoted into the locking setting thereof.

The invention further relates to a method of fastening at least one railing device with the help of a fastening device to a prop for scaffolding, particularly facade scaffolding, a stage, a staircase or like three-dimensional framework, wherein the fastening device comprises a mount for the railing device and wherein the mount is fastened, preferably captively, in particular permanently, for example by welding, to the prop, in particular to a vertical post, of metal, and wherein the mount comprises a rest element, which extends in a first direction transversely, preferably perpendicularly, to the longitudinal axis of the prop away therefrom, with a rest surface, which is horizontal in use setting of the prop, for vertical support of the railing device, which is formed in particular as a single or double railing and preferably with or as a railing rod and which preferably forms a part of a connecting arrangement, wherein a rest part, which is preferably arranged in the region of an end of the railing device or of the railing rod, of the railing device can be supported on the rest surface of the rest element, and wherein the fastening device further comprises a locking element, which is firmly, preferably captively, connected with the prop and preferably formed with or as a locking lever, with a locking surface for mechanically positive locking, preferably free of clamping force, of the railing device against vertical removal thereof in upward direction when the prop is in use setting, and wherein the locking element is pivotable, preferably manually, in particular in downward direction in use setting of the prop, about a pivot axis from an unlocking setting, in which the railing device can be placed on the rest surface of the rest element of the mount or removed from the mount, into a locking setting, and conversely, in which the railing device is locked by means of the locking element against removal from the mount at least in one direction and in which the railing device is secured against removal in any directions from the mount, wherein the railing device is—when the locking element is disposed in its locking setting and when the prop is in use setting—placed or hung in place on the rest surface of the rest element of the mount from below, particularly obliquely from below, in a direction transverse, preferably perpendicular, to the first direction, preferably approximately in a mounting plane containing a parallel to the longitudinal axis of the prop and a notional normal to the first direction, and is subsequently pivoted upwardly and transferred to a horizontal installation setting in which the railing device is mechanically positively locked, preferably free of clamping force, by means of the locking element against removal from the mount, upwardly in the direction of, preferably parallel to, the longitudinal axis of the prop when the prop is in use setting and in which the railing device is secured against removal in any directions from the mount.

According to a particularly advantageous variant of embodiment of the afore-described method or according to a further independent aspect of the invention there can be provided a method of fastening at least one railing device with the help of a fastening device to a prop for scaffolding, particularly facade scaffolding, a stage, a staircase or like three-dimensional framework, wherein the fastening device comprises a mount for the railing device and wherein the mount is fastened, preferably captively, in particular, permanently, for example by welding, to the prop, in particular to a vertical post, of metal, and wherein the mount comprises a rest element, which extends in a first direction transversely, preferably perpendicularly, to the longitudinal axis of the prop away therefrom, with a rest surface, which is horizontal in use setting of the prop, for vertical support of the railing device, which is formed in particular as a single or double railing and preferably with or as a railing rod and which preferably forms a part of a connecting arrangement, wherein a rest part, which is preferably arranged in the region of an end of the railing device or of the railing rod, of the railing device can be supported on the rest surface of the rest element, and wherein the fastening device further comprises a locking element, which is firmly, preferably captively, connected with the prop and preferably formed with or as a locking lever, with a locking surface for mechanically positive locking, preferably free of clamping force, of the railing device against vertical removal thereof in upward direction when the prop is in use setting, and wherein the locking element is pivotable, preferably manually, in particular in downward direction in use setting of the prop, about a pivot axis from an unlocking setting, in which the railing device can be placed on the rest surface of the rest element of the mount or removed from the mount, into a locking setting, and conversely, in which the railing device is locked by means of the locking element against removal from the mount at least in one direction and in which the railing device is secured against removal in any directions from the mount, wherein the railing device, which rests on the rest surface of the rest element of the mount in use setting of the prop, is removed from the mount after pivotation of the locking element into an or the unlocking setting, without previous removal of the railing device in the first direction from the rest element, in a second direction transversely, preferably perpendicularly, to the longitudinal axis of the prop and also transversely, preferably perpendicularly, to the first direction, preferably after previous lifting-off upwardly from the rest surface of the rest element.

BRIEF DESCRIPTION OF THE DRAWINGS

Further advantages, features and aspects of the invention can be inferred from the following description part, in which a preferred exemplifying embodiment of the invention is described on the basis of the figures, in which:

FIG. 7*a* shows a section along the centre longitudinal axis of the locking lever;

FIG. 7*b* shows a first view of the locking lever obliquely from below;

FIG. 7*c* shows a second view of the locking lever obliquely from below from a viewing direction different from FIG. 7*b;*

FIG. 7*d* shows a plan view of the locking lever obliquely from above;

FIG. 12*a* shows a section along the centre longitudinal axis of the locking lever;

FIG. 12*b* shows a first view of the locking lever obliquely from below;

FIG. 12*c* shows a second view of the locking lever obliquely from below from a viewing direction different from FIG. 7*b;*

FIG. 12*d* shows a plan view of the locking lever obliquely from above;

FIG. 20 two props according to the invention, set up at a horizontal distance from one another, whose locking elements are in an unlocking setting or open setting, in each instance, whereby a railing device according to the invention is set onto the mount of the prop shown on the left, in a horizontal direction, in an intermediate setting;

FIG. 21 a view of a connection arrangement corresponding to FIG. 20, whereby the railing device is shown in an installation setting, after horizontal displacement of the device from the intermediate setting shown in FIG. 20 to the right, and whereby the locking elements are still in their unlocking settings or open settings;

FIG. 22 a view of a connection arrangement corresponding to FIG. 21, whereby now, the locking elements of the props are pivoted from their unlocking settings or open settings shown in FIG. 21 into their locking setting, in each instance;

DETAILED DESCRIPTION OF PREFERRED EMBODIMENTS

Figure 1:
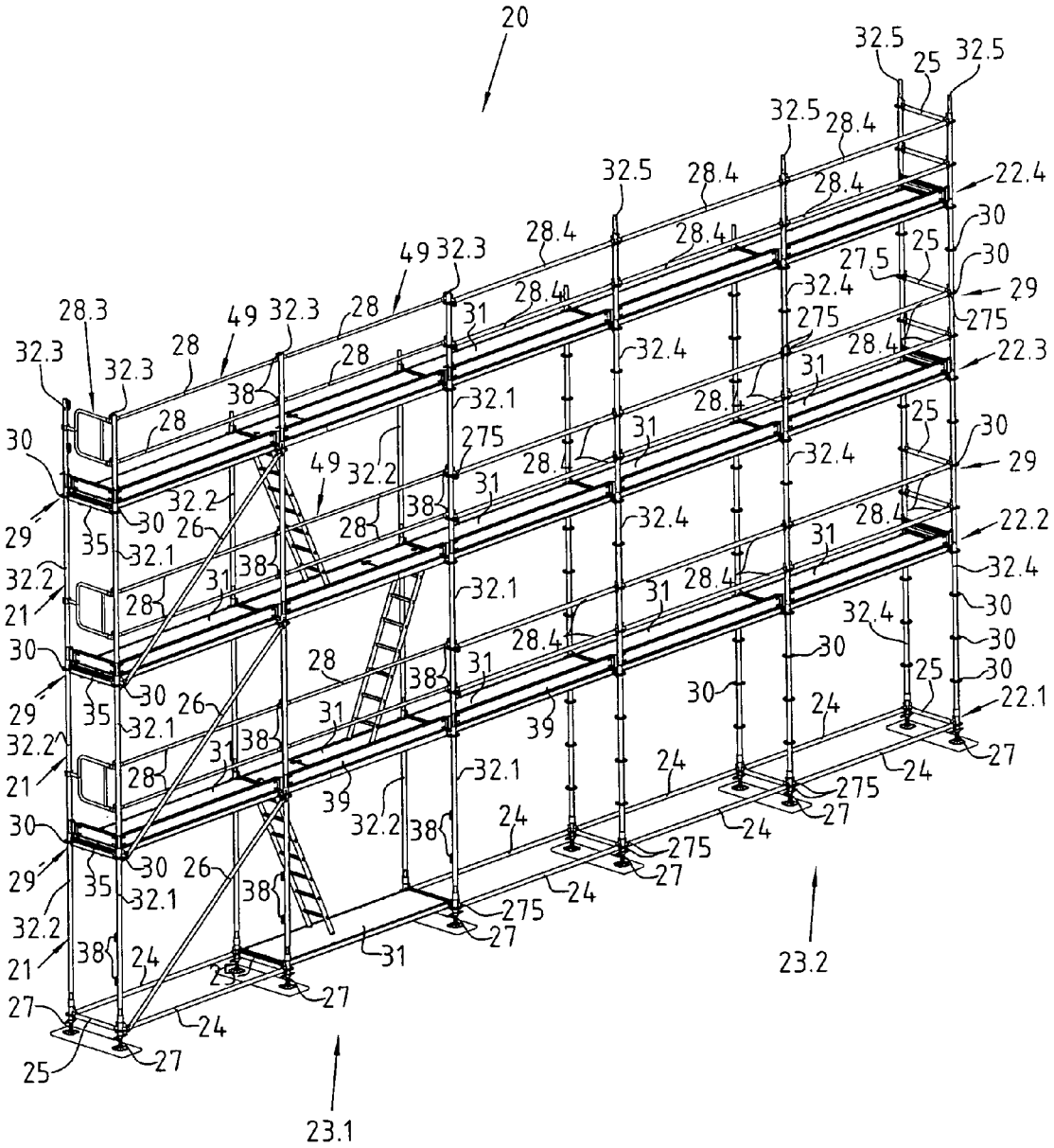
FIG. 1 shows a three-dimensional view of a facade scaffolding which extends over a four storeys or scaffolding tiers and which consists of a first scaffolding bay with props according to the invention and connecting arrangements according to the invention and of a second scaffolding bay, which is attached thereto, with scaffolding components of modular scaffolding.

The scaffolding 20 shown in FIG. 1 comprises two vertical scaffolding bays 23.1 and 23.3 which are attached to one another and which each comprise four scaffolding tiers or storeys 22.1 to 22.4. The first scaffolding bay illustrated on the left in FIG. 1 is constructed from scaffolding standing frames 21 according to the invention. Each scaffolding standing frame 21 consists of two props 32.1 and 32.2 which are constructed as vertical posts and which are permanently connected, here by welding, by a transverse arm 35 to be stiff in bending and torsion. The transverse arm 35 here extends perpendicularly to the longitudinal axes 33 of the two props 32.1 and 32.2 in the region of the respective upper ends 36.1 and 36.2 thereof, so that a U-shaped or H-shaped scaffolding standing frame 21; 21.1, 21.2, which is downwardly open in the use setting 34, is formed.

Figure 2:
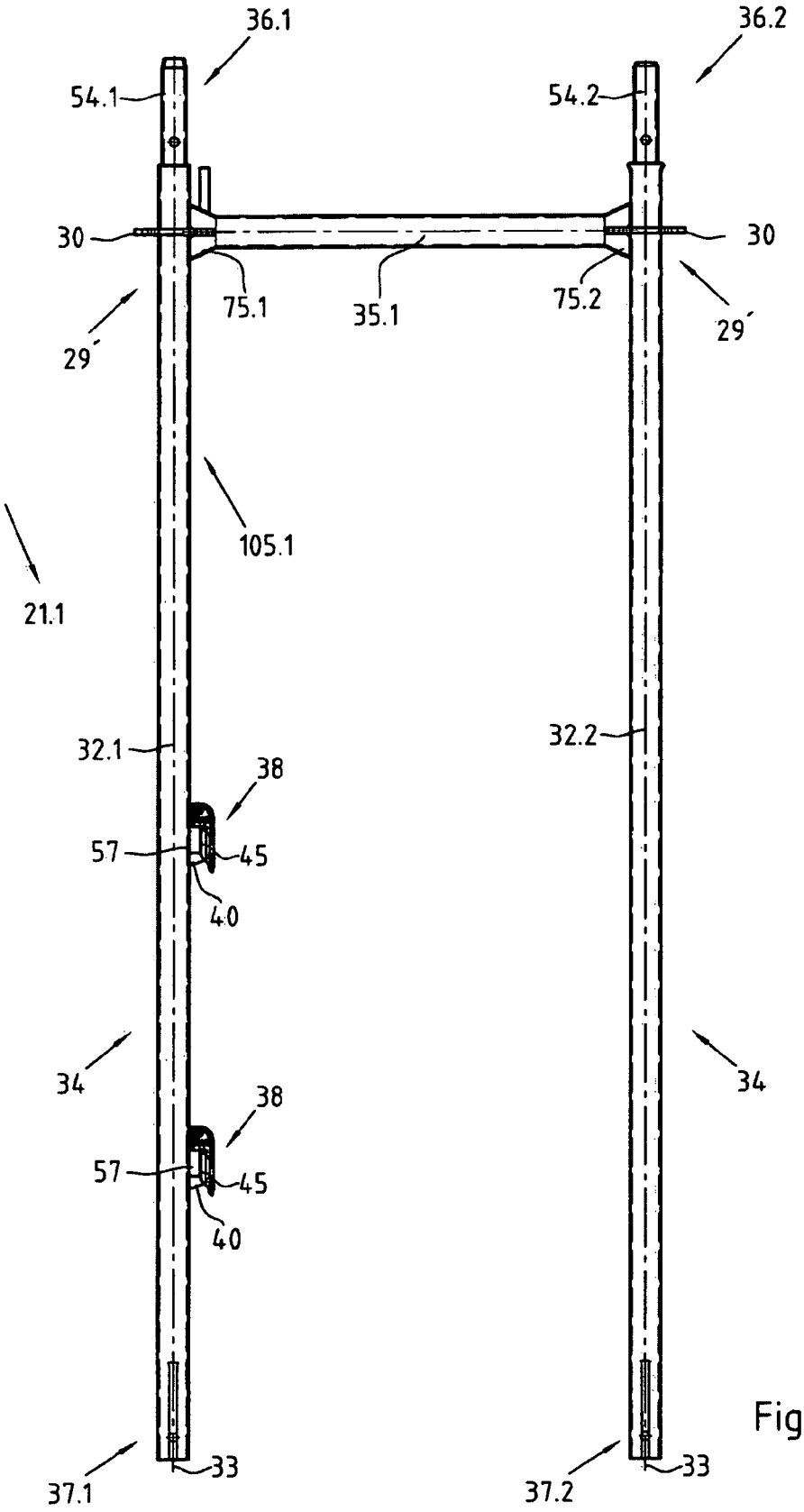
FIG. 2 shows a first exemplifying embodiment of a standing frame according to the invention, which is formed by two posts and a transverse arm which is permanently connected with the posts and formed by a round tube, wherein the post shown here on the left is constructed as a prop according to the invention.
Figure 3:
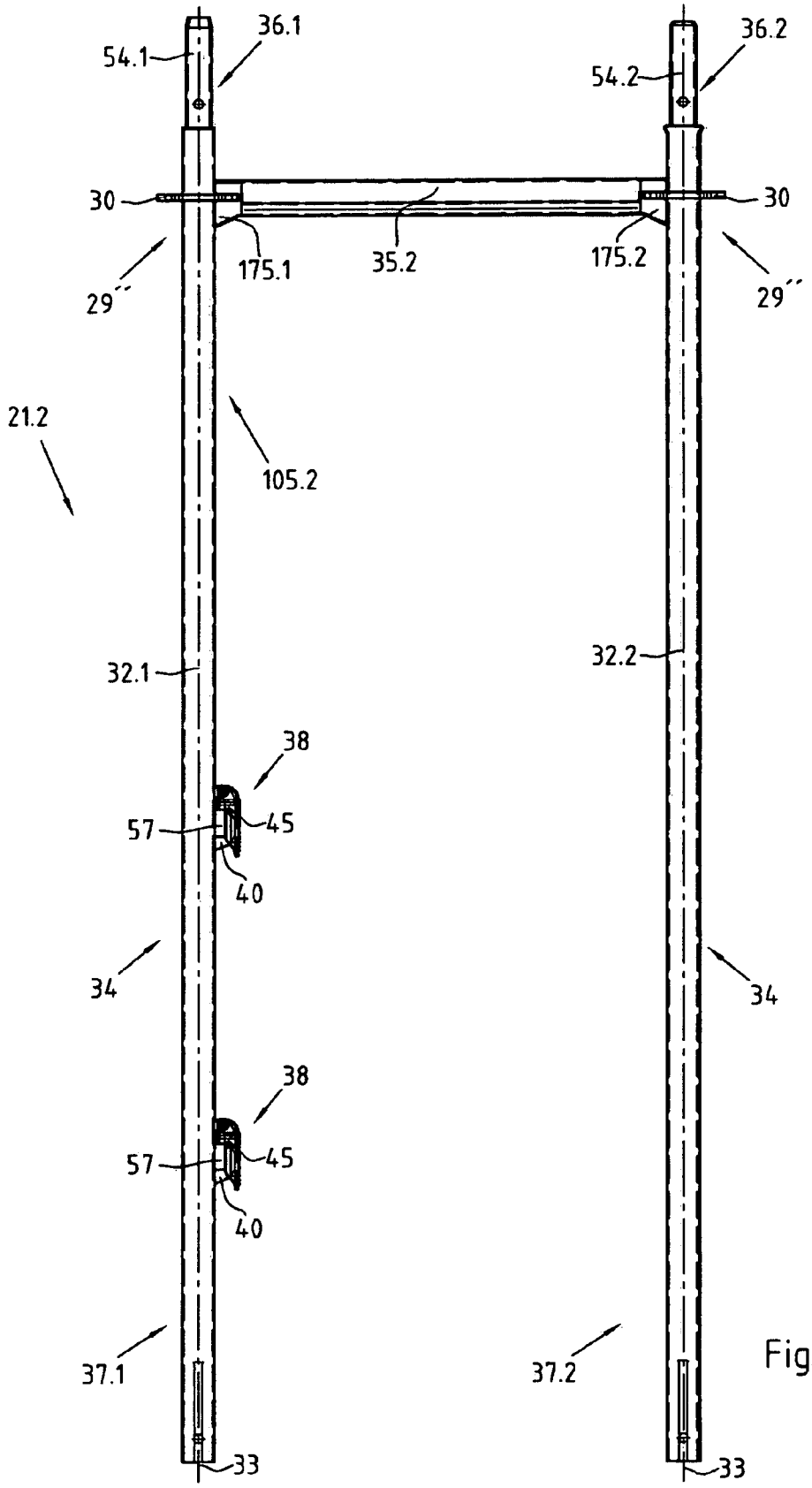
FIG. 3 shows a second exemplifying embodiment of a standing frame according to the invention, which differs from the standing frame shown in FIG. 2 only by the form of the transverse arm and the detail connection thereof to the two posts, wherein the transverse arm is here formed with an upwardly open U-shaped profiled tube.

In the exemplifying embodiments shown in, in particular, FIGS. 1 to 3 the scaffolding standing frames 21; 21.1, 21.2 are each designed with a prop 32.1 according to the invention, which is formed with a fastening device 38 according to the invention for fastening at least one railing device 28 according to the invention, here, in particular, in the form of railing rods 28.1, 28.2. In order to stiffen the scaffolding 20, at least two of the posts 32.1, 32.1 of two adjacent scaffolding frames 21, which are associated with a common storey 22.1 to 22.3, are stiffened by a preferably rod-shaped diagonal element 26. Each prop 32.1 according to the invention here has two fastening devices 38, which in use setting 34 of the prop 32.1 are arranged at a vertical spacing from one another, for connection of means for safeguarding against falling down, in the form of railing elements 28. In the illustrated exemplifying embodiment two respective substantially parallel railing rods 28.1, 28.2 are fastened to the fastening devices 38 of the props 32.1, which here are outer or remote from the wall, in the horizontal installation or use setting 49 of the railing devices 28. The other or inner posts 32.2 of the scaffolding standing frames 21 can, for example, be erected in the immediate vicinity of a wall (not shown), for example of a building, so that then on this side of the scaffolding 20, as shown in FIG. 1, the means for securing against falling down or the railing devices 28 can be eliminated.

Each prop 32; 32.1, 32.2; 32.4 of the lowermost scaffolding tier or storey 22.1 is here plugged onto a so-called starting member 27, which is usually formed by an upwardly pointing tubular support. The inner diameter of this tubular support is slightly larger than the outer diameter of the lower ends 37.1, 37.2 of the props 32; 32.1, 32.1, 32.4, so that the props 32; 32.1, 32.1, 32.4 can each be plugged into one of these tubular supports of the starting members 27. The starting members 27 are usually provided with a spindle and a spindle nut screwed thereon, whereby setting of the height or level of the props 32; 32.1, 32.1, 32.4 can be achieved. Each starting member 27 here has an apertured disc 30 provided with passages. The latter serve for wedge-fixing to the tubular supports of so-called horizontal rod elements 24, 25, particularly longitudinal rails and transverse rails, provided with connecting heads. These connecting points are also termed connecting junctions 29, 29'. Longitudinal rails 24 and transverse rails 25 are usually used as rod elements. The longitudinal rails 24 and the transverse rails 25 are in that case respectively wedge-fixed in pairs to the tubular supports of the starting members 27 in such a manner that a stable rectangular base frame is constructed from two parallel longitudinal rails 24 and two transverse rails 25, which are arranged perpendicularly thereto, but parallel to one another. Starting from this base frame, which is then constructed in a substantially horizontal plane, the scaffolding 20 is then built up to finished state. The props 32; 32.1, 32.1, 32.4, 32.5 are usually formed as tubes.

Covering units, preferably in the form of scaffolding floors 31, which are provided with tread and/or work surfaces and which horizontally bound the respective storey or scaffolding tier 22.1, 22.2, 22.3, 22.4 in downward direction and upward direction, are mounted on or at the transverse arms 35; 35.1, 35.2, 35.2 of the scaffolding standing frames 21; 21.1, 21.2.

Whilst the railing rods 28.1 and 28.2 offer protection against falling down on a longitudinal side, on the narrow transverse sides side railings 28.3—here extending perpendicularly thereto—are fastened between the props 32.1 and 32.2 of the scaffolding standing frame 21 according to the invention, as shown in FIG. 1 on the left.

The second scaffolding bay 23.2 shown in FIG. 1 on the right is constructed with scaffolding elements of a modular scaffolding of the so-called Layher all-round modular scaffolding system. This comprises separate props 32.4 which are constructed as vertical posts and which in longitudinal direction are provided with a number of apertured discs spaced apart at the same grid spacing, here in each instance with four apertured discs. Longitudinal rails 24 and transverse rails 25 as well as optionally diagonal rails (not shown) are in usual manner wedge-fixed to these apertured discs with the help of known wedge connecting heads 275. Each two of these posts 32.4 are connected in the region of the upper ends thereof with a horizontal rod element 25 which is typically a round bar or an upwardly open U-profile rail. Covering units in the form of scaffolding floors 31 can in turn be placed or hung on or at these transverse rails directly or, preferably, by way of suspension hooks.

The spacing of the apertured disc 30, which is uppermost in use setting, of the respective post 32.4 from the lower end thereof corresponds with the spacing of the apertured disc 30, which is fastened to the props 32.1 and 32.2 according to the invention of the scaffolding standing frames 21 according to the invention in the region of the upper ends 36.1, 36.2 thereof, from the lower ends 37.1, 37.2 of these props 32.1, 32.1. In this manner it is thus readily possible to connect a scaffolding or a scaffolding bay 23.1, which is formed by scaffolding standing frames 21; 21.1, 21.2 according to the invention or by props 32, 32.1, 32.2 according to the invention, with a scaffolding or a scaffolding bay 23.2 of a modular scaffolding without transition, so that a step-free transition between the covering units or scaffolding floors 31 of the first scaffolding bay 23.1 and the covering units or scaffolding floors 31 of the second scaffolding bay 23.2 is possible.

In the exemplifying embodiment shown in FIG. 1 the railing rods or railing rails 28.4 of the modular scaffolding forming the second scaffolding bay 23.2 are directly fastened in the region of the fastening devices 38 according to the invention of the props 32; 32.1, 32.2 according to the invention, for example with the help of clampable apertured discs. In this manner the railing rods 28.1, 28.2 of the first scaffolding bay 23.1 are, for example, arranged slightly above the railing rods 28.4 of the second scaffolding bay 23.2 of the modular scaffolding, wherein this vertical spacing is of such small size that it impairs neither the use nor the safety of a 'combination scaffolding' constructed in this manner.

A first exemplifying embodiment of a scaffolding standing frame 21.1 according to the invention is shown in FIG. 2. This consists of two props 32.1, 32.2, which are arranged to be parallel and in one plane and which in use setting 34 are constructed and arranged as vertical posts. In the region of their upper ends 36.1, 36.2 each prop 32.1, 32.2 has an apertured disc 30, which discs in known manner are formed with passages for wedge-fixing of scaffolding elements, provided with connecting heads with a wedge. These apertured discs 30 here surround the respective post tube of the respective prop 32.1, 32.2 at a whole circumference.

The upper ends 36.1, 36.2 of the props 32.1, 32.2 are each formed with a respective tube connector 54.1, 54.2, the outer diameter of which is slightly smaller than the inner diameter of the lower ends 37.1, 37.2 of the props 32.1, 32.2. In this manner several such props 32.1, 32.2 or standing frames 21 can, as shown in FIG. 1, be plugged onto one another.

Arranged at the level of the two apertured discs 30 of the two props 32.1, 32.2 of the standing frame 21.1 is a transverse arm 35.1 which is permanently fastened to the props 32.1, 32.2, here by welding, and the longitudinal axis of which extends perpendicularly to the longitudinal axes of the props 32.1, 32.2 in the same plane. This transverse arm 35.1 is here formed by a round tube, which is connected at it two ends, preferably integrally, with connecting heads 75.1 and 75.2 tapering in wedge shape towards the post and disc centre. These connecting heads or at least one of them is or are preferably produced by deforming the round tube. They have horizontal plug-on slots by which they are plugged onto the respective apertured disc 30 of the respective prop 32.1, 32.2 and then, in this plugged-on position, welded to the respective prop 32.1 and 32.2. This scaffolding standing frame 21.1 is formed by a vertical frame element 105.1 which is formed by one prop 32.1 and the transverse arm 35.1 permanently fixed thereto, preferably by welding. With respect to the constructional details of vertical frame elements of that kind and the scaffolding standing frames and/or scaffoldings able to be constructed therefrom reference can be made for the sake of simplicity to European Patent Application No 06021346.9 and German Utility Model Application No 20 2006 015 586.4, the content of which is for the sake of simplicity adopted in its entirety at this point, so that thus the entire disclosure content of these two protective right applications is equally the subject of the invention described here.

A second exemplifying embodiment of a scaffolding standing frame 21.2 according to the invention is shown in FIG. 3. This differs from the scaffolding standing frame 21.1 shown in FIG. 2 exclusively by the form of the transverse arm and the detail connection thereof to the two props 32.1 and 32.2, so that with respect to the remaining details reference can be made to the foregoing explanations concerning the scaffolding standing frame 21.1. Accordingly, in FIG. 3 the same elements are provided with the same reference numerals as in FIG. 2.

The transverse arm 35.2 of the scaffolding standing frame 21.2 shown in FIG. 3 is formed by an upwardly open U-profile tube or U-shaped transverse rail 35.2. This is connected at its two ends, here integrally, with a crush profile connecting head 175.1, 175.2. These connecting heads 175.1, 175.2 or at least one of them is or are also preferably produced by deforming the U-profile tube. Each of these connecting heads 175.1, 175.2 again has a horizontal plug-on slot by means of which the respective connecting head 175.1, 175.2 is plugged onto the respective apertured disc 30 of the respective prop 32.1, 32.2 and again welded there not only to the apertured disc, but also to the post to form a downwardly open U-shaped or H-shaped scaffolding standing frame 21.2 stiff in bending and torsion.

Each of the scaffolding standing frames 21; 21.1, 21.2 according to the invention thus comprises at least one prop 32.1 according to the invention of metal, which is designed as, in particular, a vertical post for scaffolding 20, particularly for facade scaffolding, a stage, a staircase or like three-dimensional framework. The prop 32.1 according to the invention has a fastening device 38 according to the invention for fastening at least one railing device 28, particularly a single or double railing, preferably a railing rod 28.1, 28.2, to the prop 32.1. This fastening device 38 comprises a mount 40 for the railing device 28. The mount 40 is connected, here permanently by welding, to the prop 32.1. The mount 40 comprises a rest element 42, which extends in a first direction 41 transversely, preferably perpendicularly, to the longitudinal axis 33 of the prop 32.1 and away therefrom, with a rest surface 43, which is horizontal in use setting 34 of the prop 32.1, for vertical support of the railing device 28.

The fastening device 38 further comprises a locking element 45, which is connected—preferably captively—with the prop 32.1 and here designed with or as a locking lever 70, with a locking surface 46; 46.1, 46.2 for—in a locking setting 47—mechanically positive locking, preferably free of clamping force, of the railing device 28 against vertical lifting-off of the same in upward direction when the prop 32.1 is in use setting 34. The locking element 45 is pivotable, preferably manually, about a pivot axis 50 from an open or unlocking setting 48 (FIGS. 4 and 5) into a locking setting 47 (FIGS. 1, 2, 3 and 6), here in downward direction when the prop 32.1 is in use setting 34.

In the locking setting 47 the locking surface 46 of the locking element 45 is opposite the rest surface 43 of the rest element 42. In both the locking setting 47 and use setting 34 of the prop 32.1 the locking surface 46 is arranged at a vertical spacing 51 above the rest surface 43 of the rest element 42. Alternatively or, as here, additionally the pivot axis 50 in use setting 34 of the prop 32.1 is arranged at a vertical spacing 52 above the locking surface 46, which is disposed in the locking setting 47, and, preferably, here also at a vertical spacing 53 above the rest surface 43 of the rest element 42.

Figure 4:
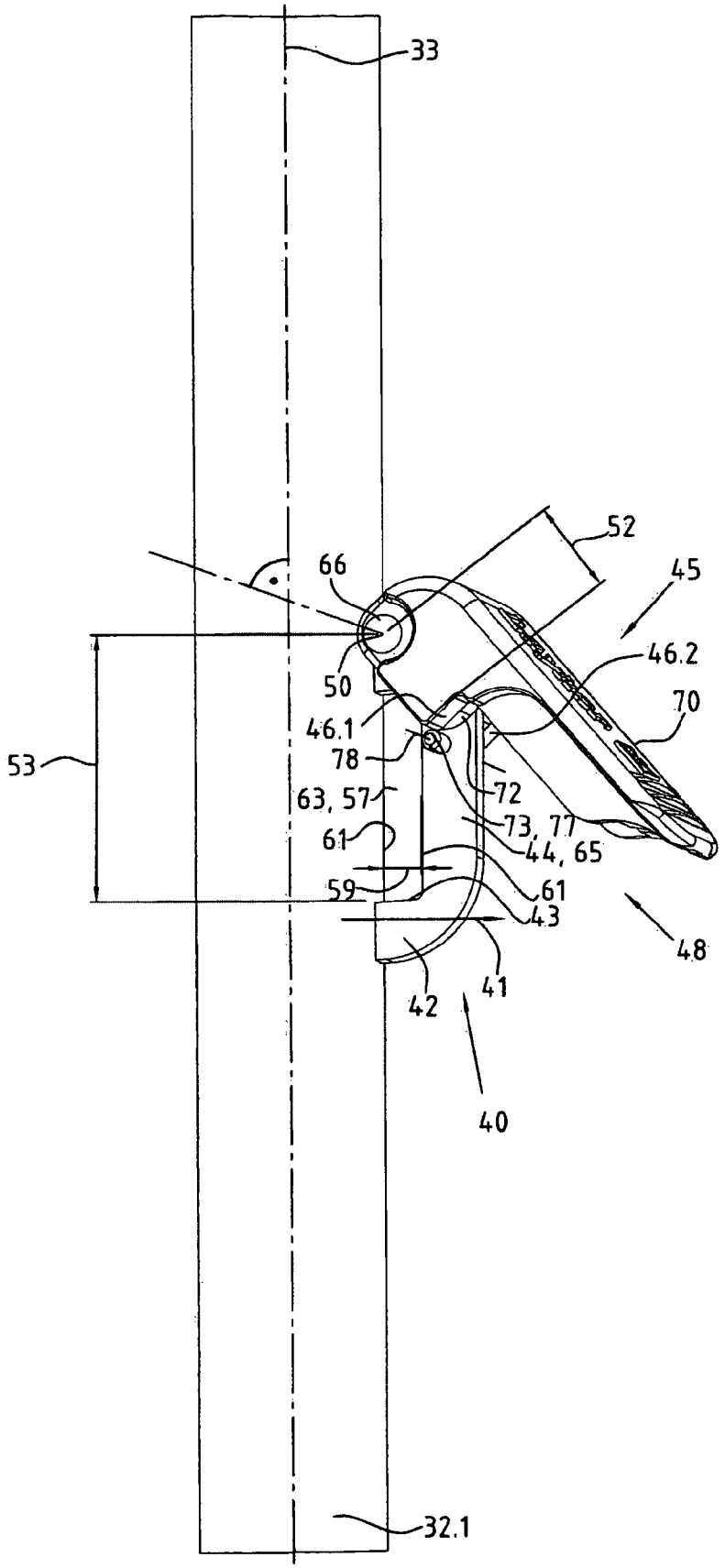
FIG. 4 shows an enlarged three-dimensional view of a prop according to the invention, which is formed with a fastening device according to the invention with a pivotable locking element according to a first exemplifying embodiment, which here is disposed in an open or unlocking setting.

As apparent particularly from FIG. 4, in the exemplifying embodiment the pivot axis 50 extends perpendicularly to the longitudinal axis 33 of the prop 32.1 and also perpendicularly to the first direction 41 by which the rest element 42 extends away from the prop 32.1.

Figure 5:
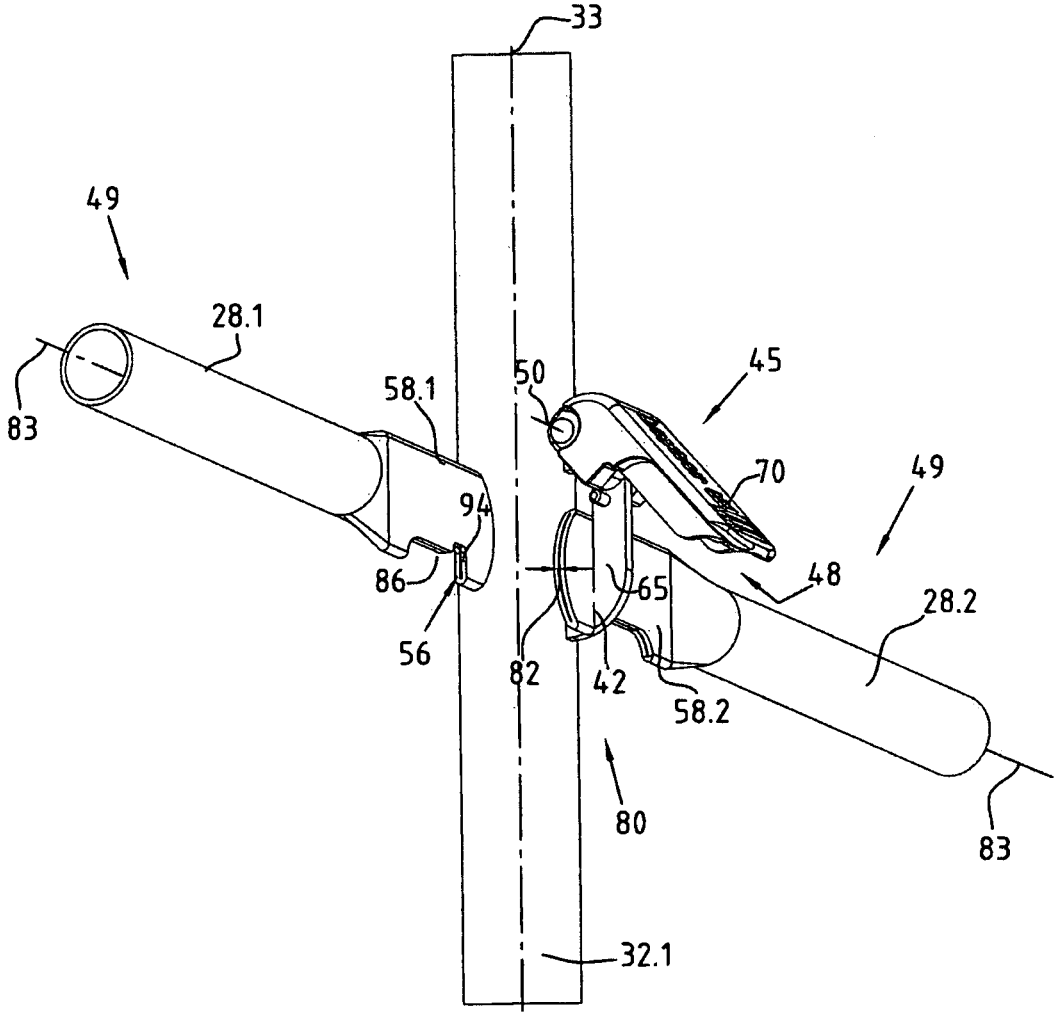
FIG. 5 shows a view, which corresponds with FIG. 4, of a prop according to the invention with the fastening device, in the mount of which an end of a first railing rod according to the invention in accordance with a first exemplifying embodiment is hung, whilst a second railing rod according to the invention, here shown on the left, is not yet hung in the same mount, wherein the locking lever is here again disposed in an open or unlocking setting.
Figure 6:
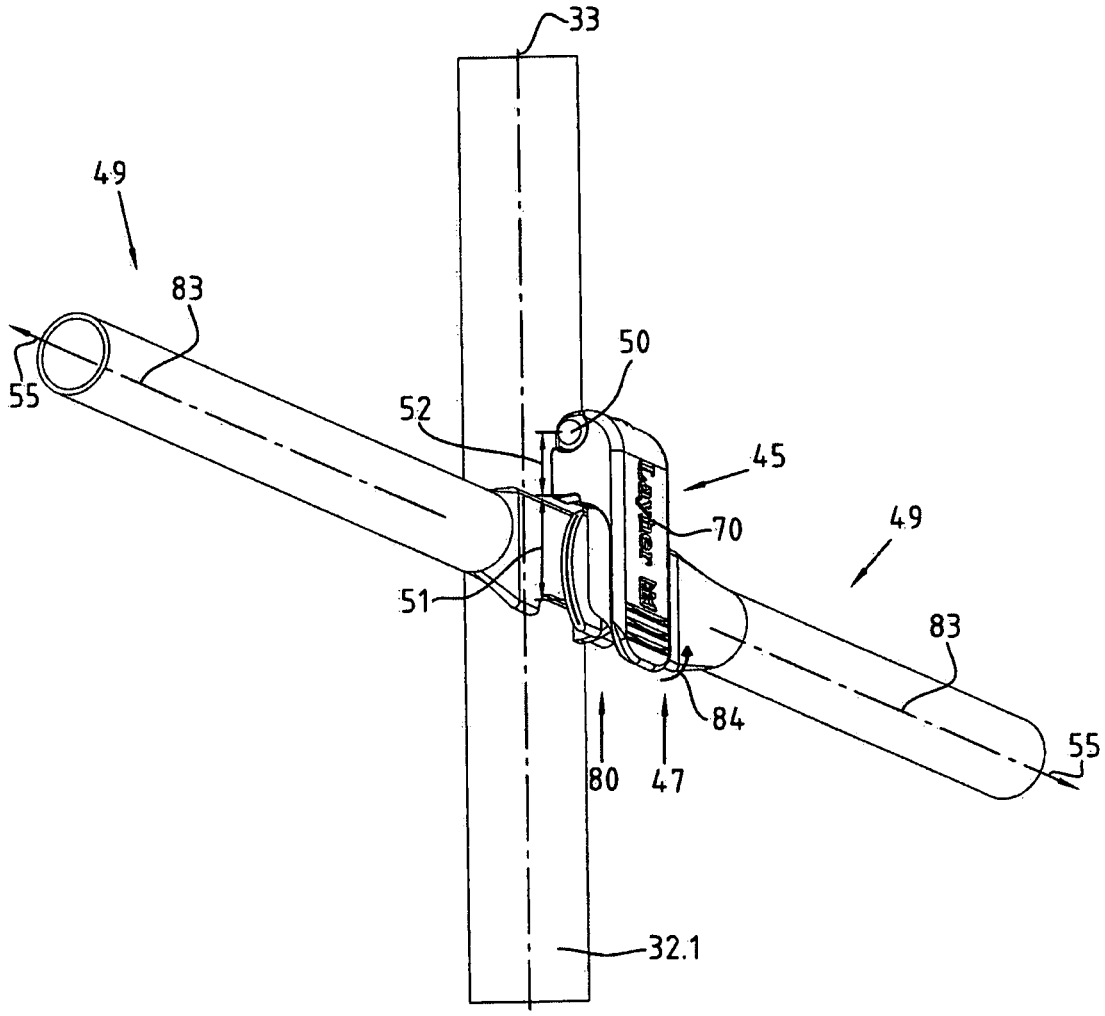
FIG. 6 shows a view, which corresponds with FIG. 5, of a prop according to the invention with a fastening device according to the invention, in the mount of which now not only the end of a first railing rod according to the invention, but also the end of a second railing rod according to the invention—which extends in an opposite direction—is hung, wherein the locking lever is now disposed in a locking setting in which the two railing rods are mechanically positively secured, free of clamping force, against removal in any directions from the mount and consequently from the prop.

The mount 40 has a passage opening 57, which is closed at the full circumference, for insertion of an end 58.1, 58.2 of the at least one railing device 28, particularly of the railing rod 28.1, 28.2, which is bounded by a support element 44, which here extends parallel to the longitudinal axis 33 of the prop 32.1 in the use setting 34 thereof and here is integrally fastened to the rest element 42, of the mount 40 for lateral support of the rest part 56 of the railing device 28 (see, in particular, FIGS. 4 to 6).

The opening edge 61 of the passage opening 57, which here is formed by the mount 40—which is profiled to be U-shaped and formed as a stirrup 65—on the one hand and the outer surface of the prop 32.1 on the other hand, spans a vertical opening plane, which here contains the longitudinal axis 33 of the prop 32.1, when the prop 32 is in the use setting 34. Accordingly, the passage opening 57 in use setting 34 of the prop 32.1 is here formed as a vertical receiving slot 63 extending in a direction parallel to the longitudinal axis 33 of the prop 32.1. The mount 40 is formed with a stirrup 65 of flat material, which is here a punched part, but which can also be formed as, in particular, a cast part or forged part of metal. This stirrup 65 thus has the passage opening 57, which is formed as a receiving slot 63, for reception of the rest part 56 of the railing device 28 or bounds this passage opening 57.

The stirrup 65 is arranged parallel to the longitudinal axis 33 of the prop 32.1 and the limbs thereof are welded to the prop 32.1.

Figure 7A:
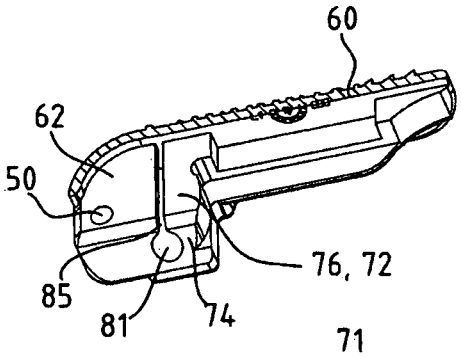
FIGS. 7*a* to 7*d* show different three-dimensional views of the locking lever according to the invention in accordance with a first exemplifying embodiment.
Figure 7B:
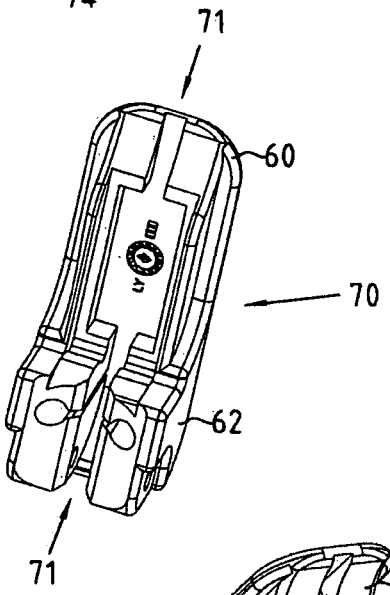
Figure 7C:
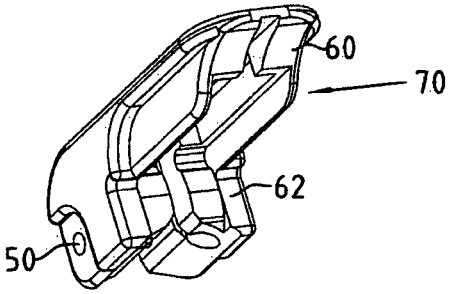
Figure 7D:
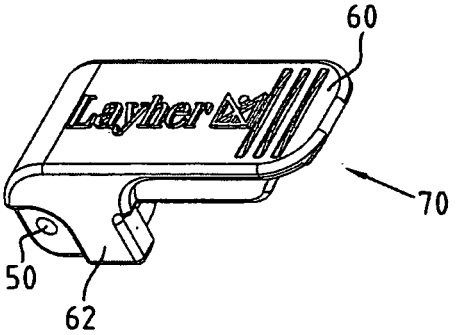

The locking element 45 is here designed with a manually actuable locking lever 70, which here is fastened to the limb, which is upper in use setting 34 of the prop 32.1, of the mount 40 with the help of fastening means which here is formed as a rivet 66 and contains the pivot axis 50. The locking lever 70 is preferably formed from plastics material. As apparent particularly from FIGS. 7*a* to 7*c* as well as 8*a* and 8*e* in conjunction with FIGS. 4 to 6, the locking lever 70 has a longitudinal slot 71 which extends perpendicularly to the pivot axis 50 and in which in the locking setting 40 of the locking lever 70 a major part of the vertical support element 44 of the mount 40 or of the stirrup 65 is received. The locking lever 70 consists of an articulation and locking part 62 and an actuating part 60 which is connected with this as one part or integrally. The part 60 tapers towards its free end to be concavely radiussed in order in this manner to be able to achieve an advantageous gripping by a finger of a hand of an actuating person for the purpose of simple transfer of the locking lever 70 from its locking setting 47 upwardly into its unlocking setting or open setting 48.

The articulation and locking part 62 of the locking lever 70 comprises an opening which in mounting setting contains the pivot axis 50 and through which a part of the rivet 60 is inserted. The articulation and locking part 62 further comprises a pressing body 72 which is formed as an eccentric body 76 and which on pivotation of the locking lever 70 from the unlocking setting 48 into the locking setting 47 goes into engagement or is in engagement with a counter-body 73 which is here formed as a cylindrical pin 77. The counter-body 73 is firmly fastened, preferably permanently, to the support element 44 in such a manner that it extends on both sides of the side surfaces of the stirrup 65 beyond this. In that case the longitudinal axis 78 of the pin 77 is arranged perpendicularly to the longitudinal axis 33 of the prop 32.1 and parallel to the pivot axis 50. The longitudinal axis 78 of the pin 77 further extends perpendicularly to the first direction 41 by which the rest element 42 extends away from the prop 32.1.

The pressing body 72 designed as an eccentric body 76 and the counter-body 73 designed as a cylindrical pin 77 are formed to be matched to one another in such a manner that on pivotation of the locking element 70 from the unlocking setting 48 into the locking setting 47 a pressing force, which hinders unintended unlocking of the locking lever 70, is formed between the pressing body 72 and the counter-body 73. In that case the pressing body 72 of the locking lever 70 is designed as an eccentric body 76 arranged eccentrically with respect to the pivot axis 50.

Figure 8A:
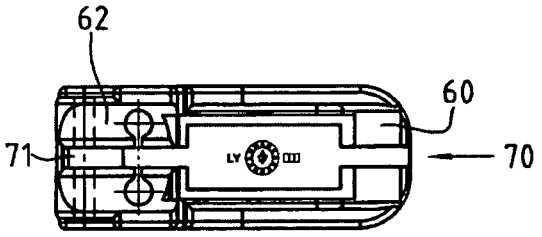
FIG. 8*a* shows an underneath view of the locking lever according to the first exemplifying embodiment.
Figure 8B:
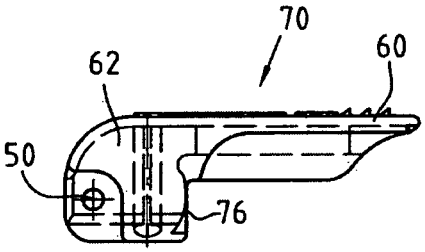
FIG. 8*b* shows a side view from the left of the locking lever.
Figure 8F:
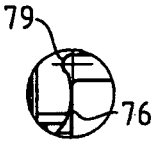
FIG. 8*f* shows a substantially enlarged view of a detail, which is bounded by a circle, of the longitudinal section of the locking lever according to FIG. 8*c*.
Figure 8C:
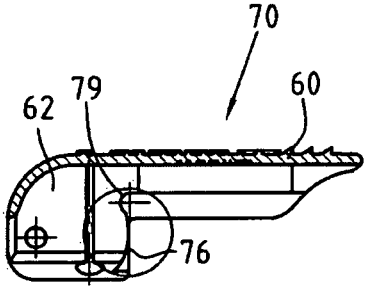
FIG. 8*c* shows a longitudinal section of the locking lever along the section line A-A in FIG. 8*d;*
Figure 8D:
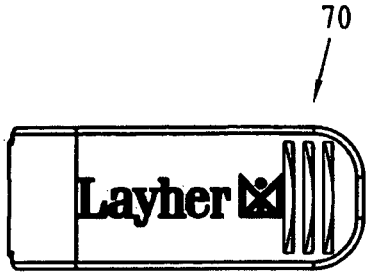
FIG. 8*d* shows a top view or plan view of the locking lever.
Figure 8E:
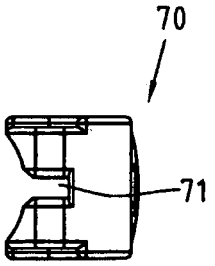
FIG. 8*e* shows a view of the locking lever according to FIG. 8*d* from behind.

As apparent from, for example, FIGS. 8*c* and 8*f*, the locking lever 70 has in the region of its transition between the actuating part 60 and the articulation and locking part 62 a detent recess 79 which outwardly adjoins the eccentric body 76 and in which the pin 77, which is fastened to the support element 44 of the mount 40, engages in detenting manner in the locking setting 47.

The invention also relates to a connecting arrangement for a railing device 28, which comprises at least one prop 32.1 for scaffolding 20, particularly facade scaffolding, a stage, a staircase or like three-dimensional framework and a railing device 28, which is formed particularly as a single or double railing and preferably designed with or as a railing rod 28.1, 28.2 and which is fastenable to the prop 32.1 with the help of the fastening device 38.

In this connecting arrangement 80 the locking surface 46 of the locking element 45 in the locking setting 47 is opposite the rest surface 43 of the rest element 42 and the locking surface 46 is, in the locking setting 47 as well as in use setting 34 of the prop 32.1, arranged at a vertical spacing 51 above the rest surface 43 of the rest element 42 which is greater than the height 67 of the rest part 56, which rests on a rest surface 43 of the rest element 42 of the mount 40, of the railing device 28. In addition, the pivot axis 50 in use setting 34 of the prop 32 is arranged at a vertical spacing 52 above the locking surface 46 disposed in the locking setting 47 and also at a vertical spacing 53 above the rest surface 43 of the rest element 42. This spacing 53 is greater than the height 67 of a or the rest part 56, which rests on the rest surface 43 of the rest element 42 of the mount 40, of the railing device 28.

The invention also comprises a connecting arrangement 80 for a railing device 28, which comprises at least one prop 32.1 according to the invention, particularly a vertical post, of metal, for scaffolding 20, particularly facade scaffolding, a stage, a staircase or like three-dimensional framework and at least one railing device 28, which is formed as, in particular, a single or double railing and preferably formed with or as a railing rod 28.1 and which is fastenable with the help of a fastening device 38 to the prop 32.1, wherein the prop 32.1 comprises a mount 40 for the railing device 28, wherein the mount 40 is connected or fastened, preferably captively, especially permanently, for example by welding, with or to the prop 32 and wherein the mount 40 comprises a rest element 42, which extends in a first direction 41 transversely, preferably perpendicularly, to the longitudinal axis 33 of the prop 32 and away therefrom, with a rest surface 43, which is horizontal in use setting 34 of the prop 32.1, for vertical support of the railing device 28, on which rest surface a rest part 56, which is preferably arranged in the region of an end 58.1, 58.2 of the railing device 28 or of the railing rod 28.1, 28.2, of the railing device 28 can be supported, and wherein the fastening device 38 further comprises a locking element 45, which is firmly connected, preferably captively, with the prop 32, with a locking surface 46 for mechanically positive locking, preferably free of clamping force, of the railing device 28 against vertical removal thereof in upward direction when the prop 32 is in use setting 34, wherein the locking element 45 is pivotable, preferably manually, about a pivot axis 50 from an unlocking setting 48, in which the railing device 28 can be placed on the rest surface 43 of the rest element 42 of the mount 40 or removed from the mount 40, into a locking setting 47, and conversely, in which the railing device 28 is locked by means of the locking element 45 against removal from the mount 40 in at least one direction and in which the railing device 28 is secured against removal from the mount in any directions, wherein the locking element 45 is transferable from a locking setting 47, in which the railing device 28 is mechanically positively locked, preferably free of clamping force, against removal from the mount 40 in—when the prop 32.1 is in use setting 34—upward direction, preferably parallel to the longitudinal axis 53 of the prop 32.1, into an unlocking setting 48, and conversely, in which the railing device 28, without prior lifting-off in the first direction 41 from the rest surface 43 of the rest element 42, is—in use setting 34 of the prop 32—removable from the mount at least horizontally in a second direction 55 transversely, preferably perpendicularly, to the longitudinal axis 33 of the prop 32, and also transversely, preferably perpendicularly, to the first direction 41, preferably after prior vertical lifting-off, in a given case carried out within the limits predetermined by the mount 40 and especially only lightly or slightly, from the rest surface 43 of the rest element 42 in upward direction.

In the exemplifying embodiment the fastening device 38 and the railing device 28 are designed to be matched to one another in such a manner that the railing device 28 can—even though the locking element 45 is disposed in the locking setting 47—when the prop 32 is in use setting 34 be placed from below, particularly obliquely from below, on the rest surface 43 of the rest element 42 of the mount 40 or hung there, and starting from this setting is pivotable upwardly and transferable to an installation setting 49 in which the railing device 28 is secured against removal from the mount 40 in any directions.

Figure 10:
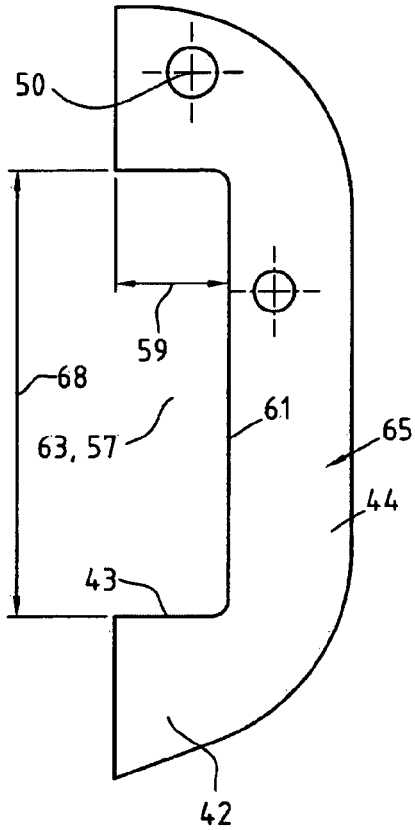
FIG. 10 shows an enlarged side view of a mount according to the invention in accordance with a first exemplifying embodiment.

As apparent from, for example FIG. 10, the mount 40 has a passage opening 57, which is enclosed at the full circumference, in the form of a receiving slot 63 for insertion of an end 58.1, 58.2 of the at least one railing device 28 or railing rod 28.1, 28.2, through which the end 58.1, 58.2 of the railing device 28 or railing rod 28.1, 28.2 is inserted (cf. FIGS. 5 and 6).

The passage opening 57 is, in use setting 34 of the prop 32, formed as a vertical receiving slot 63 which extends parallel to the longitudinal axis 33 of the prop 32 and into or through which the rest part 56 of the railing device 28, here the end 58.1, 58.2 of a railing rod 28.1, 28.2 or the two railing rods 28.1, 28.2, is inserted (FIGS. 5 and 6).

The receiving slot 63 has a height 68 which is greater than the width or the height 67 of at least one end 58.1, 58.2 of the ends 58.1, 58.2 of the railing device 28 or of the railing rod 28.1, 28.2. In addition, the passage opening 57 has a width 59 which is greater than the thickness or width 82 of the rest part 56 of the railing device 28 or of the railing rod 28.1, 28.2. In the exemplifying embodiment the passage opening 57 has a width 59 which is slightly greater than twice the thickness or width 82 of the rest part 56 of the railing device 28 or railing rod 28.1, 28.2, so that up to two railing devices 28, 28 or railing rods 28.1, 28.2 of that kind can thus be hung in the mount 40 and locked by means of the locking lever 40.

The ends 58.1, 58.2, which are intended for support on the rest element 42 of the mount 40, of the railing device 28, which is preferably formed as or with a railing rod 28.1, 28.2, are formed to be flattened.

Figure 9:
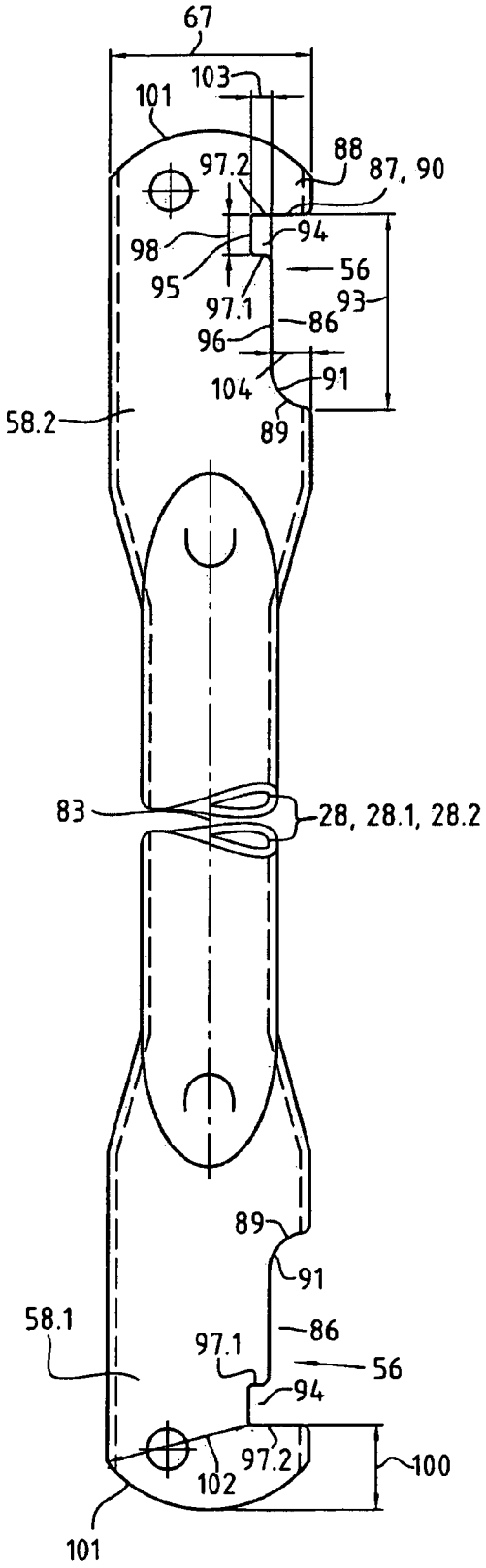
FIG. 9 shows a side view of end sections of one of the railing rods according to the invention, which are shown in FIGS. 5 and 6, in accordance with a first exemplifying embodiment.

The detail design of a railing element according to the invention, here a railing rod 28.1 or 28.2 according to the invention, is described in the following with reference to FIG. 9.

The railing device 28 has in the region of at least one end 58.1, 58.2, here in the region of its two flattened ends 58.1, 58.2, a respective first recess 86 which extends parallel to the longitudinal axis 83 of the end 58.1, 58.2 or of the railing rod 28.1, 28.2 and is bounded inwardly by the rest part 56 for support on the rest surface 43 of the rest element 42 of the mount 40 and which is open outwardly or transversely or perpendicularly to the longitudinal axis 83 of the railing device 28. This recess is bounded by a first wall part 87, which extends transversely, here approximately perpendicularly, to the longitudinal axis 83 of the end 58.1, 58.2 or of the railing device 28, here the railing rod 28.1, 28.2, and which here is defined in the form of a hook-shaped lug 88.

The first recess 86 is bounded in the direction of the longitudinal axis 83 by two spaced-apart wall parts 87 and 89. The wall part 89 is concavely rounded (at 91) and the wall part 87 bounding the lug 88 is formed with an entry chamfer 92. A second recess 94 adjoins the first wall part 87 or the lug 88 in the region of the first recess 86. This recess 94 is bounded by a rest surface 95, which here extends parallel to the longitudinal axis 83 of the railing device 28 or of the railing rod 28.1, 28.2 and which is deepened by comparison with the first recess 86, of the rest part 56 and two support surfaces 97.1, 97.2 which here are parallel and have a support surface spacing 98 from one another. These support surfaces 97.1, 97.2 here extend perpendicularly t o the longitudinal axis 83 of the end 58.1, 58.2 or of the railing device 28 or of the railing rod 28.1, 28.2. The support surface spacing 98 of these support surfaces 97.1, 97.2 is greater than the width 99 of the rest element 42 of the mount 40 in the region of the rest surface 43 of the rest element 42, so that the railing device 28 or the respective railing rod 28.1, 28.2 can there mechanically positively detent by its second recess 94.

The support surface spacing 98 is preferably approximately 1.5 to 3 times the width 99 of the rest element 42 in the region of the rest surface 43 thereof so as to be able to provide compensation for production and, in particular, assembly tolerances, so that it is always ensured that the railing device 28 or the railing rod 28.1, 28.2 can in every case be reliably and securely hung in the region of its two ends 58.1, 58.2 in a respective mount 40 of a prop 32.1 according to the invention in installed or use setting 49.

The length 93 of the first recess 86 extending in the direction of the longitudinal axis 83 of the end 58.1, 58.2 or of the railing rod 28.1, 28.2 is very much greater than the spacing 100, which is measured in the same direction, between the support surface 97.2, which is associated with the free end 101 of the respective end 58.1, 58.2 of the railing device 28 or of the railing rod 28.1, 28.2, of the second recess 94 and this free end 101 of the railing device or of the railing rod 28.1, 28.2.

A significant feature of the connecting arrangement according to the invention is also that the spacing 51 between the rest surface 43 of the rest element 42 and the locking surface 46 of the locking element 45 in the locking setting 47 is greater than the greater spacing between the surface 90, which faces away from the free end 101 of the railing device 28 or of the railing rod 28.1, 28.2 and which bounds the first recess 86, of the first wall part 87 or of the lug 88 this free end 101 of the railing device 28 or of the railing rod 28.1, 28.2, in particular is greater than the greatest spacing 102 between the support surface 97.2, which faces away from the free end 101 of the railing device 28 or of the railing rod 28.1, 28.2 and which bounds the second recess 94, and this free end 101 of the radial device 28 or of the railing 28.1, 28.2.

A second exemplifying embodiment of a prop or fastening device according to the invention for fastening railing devices is illustrated together with its parts in FIGS. 11 to 18. In that case, parts which are the same by comparison with the previously discussed exemplifying embodiments are denoted by the same reference numerals. In this second exemplifying embodiment the mount 140 or the stirrup 165, the locking element 145 or the locking lever 170, the fastening means 66 containing the pivot axis 50 and also the railing device 128; 128.1, 128.2 are designed slightly differently from the afore-described parts 40 or 65, 45 or 70, or 166 and 28; 28.1, 28.2. However, it will be obvious that, in particular, the fastening means and/or the railing device can also be designed the same as in the afore-described exemplifying embodiments.

The exact form of the locking lever 170, which functions as locking element 145, according to the second exemplifying embodiment is shown in, in particular, FIGS. 12*a* to 12*d* and 13*a* to 13*f*. This exemplifying embodiment differs from the first exemplifying embodiment, which is shown in particular in FIGS. 7*a* to 7*d* and 8*a* and 8*f*, in that a recess 210, which is here delimited approximately at right angles, is provided in the region of the articulation and locking part 162 facing the post 32.1 in the opening setting 48 and between the pivot axis 50 and the locking surface 46; 46.1, 46.2. The inner contour of this recess 210 corresponds with the inner contour of the passage opening 57 of the mount 140 in the region of the upper end thereof. This has the consequence in the open setting of the locking lever 170 shown in FIG. 11 that the receiving slot 63 or the passage opening 57 is not covered or concealed by parts of the locking lever 170. As a result, it is achieved in this open setting 48 that the complete opening cross-section of the passage opening 57 or of the receiving slot 63 remains free for hanging railing devices or railing rods 28 or 128 in place or removing them from being hung. In this manner the hanging in place of the railing devices or removal thereof from being hung can be facilitated, because in that case obstructions cannot arise due to any parts of the locking lever protruding into the passage opening 57 or receiving slot 63.

Figure 11:
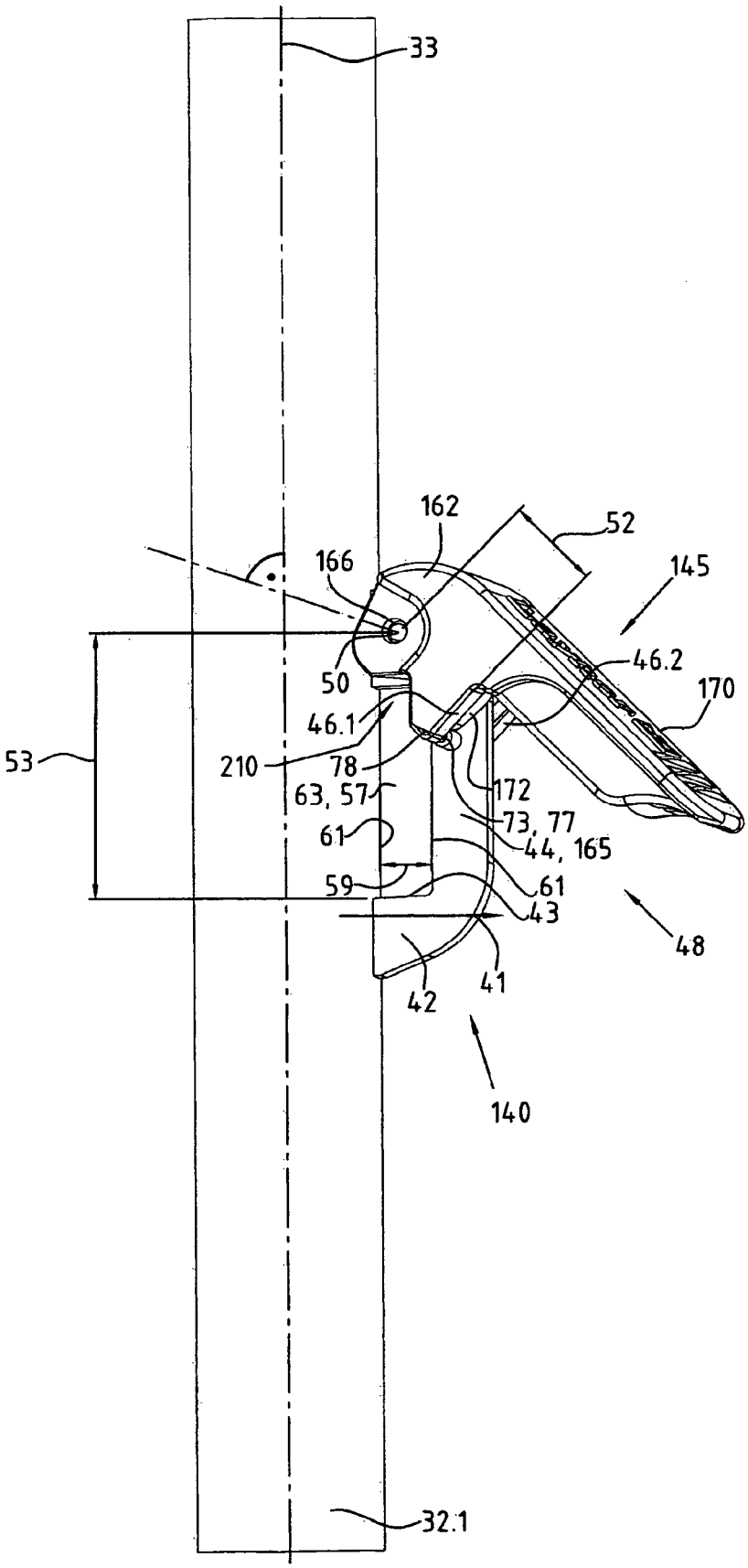
FIG. 11 shows an enlarged three-dimensional view of a prop according to the invention, which is formed with a fastening device according to the invention with a pivotable locking lever in accordance with a second exemplifying embodiment, which lever is here disposed in an open or unlocking setting.
Figure 12A:
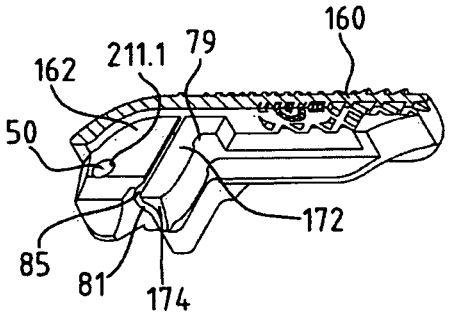
FIGS. 12*a* to 12*d* show different three-dimensional views of the locking lever according to the invention in accordance with a second exemplifying embodiment.
Figure 12B:
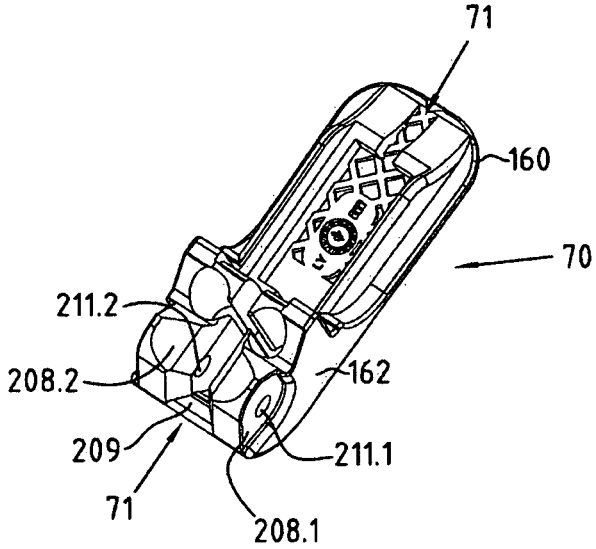
Figure 12C:
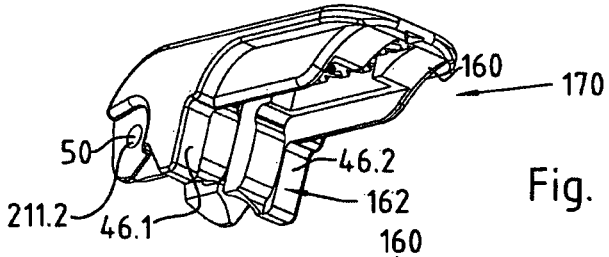
Figure 12D:
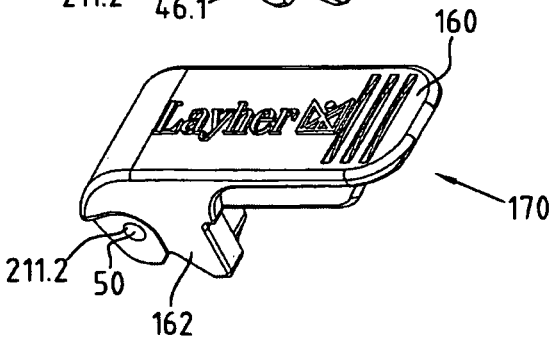
Figure 13A:
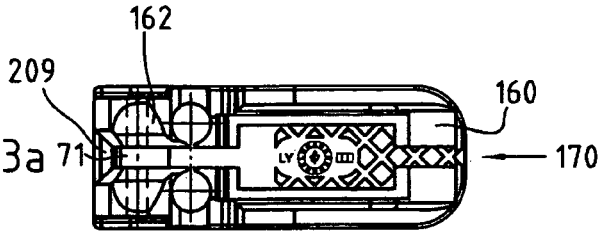
FIG. 13*a* shows an underneath view of the locking lever in accordance with the second variant of embodiment.
Figure 13B:
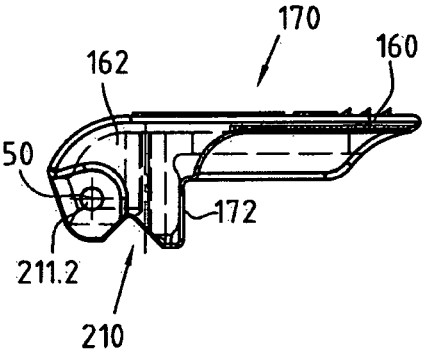
FIG. 13*b* shows a side view from the left of the locking lever.
Figure 13F:
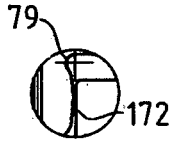
FIG. 13*f* shows a strongly enlarged view of a detail, which is bounded by a circle, of the longitudinal section of the locking lever according to FIG. 13*c;*
Figure 13C:
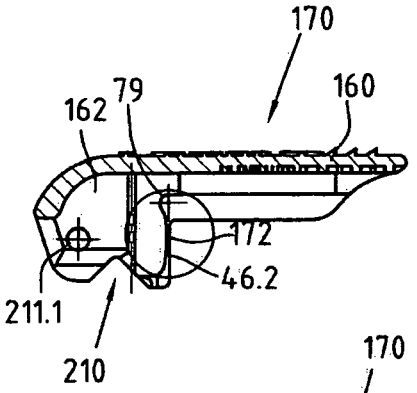
FIG. 13*c* shows a longitudinal section of the locking lever along the section line
Figure 13D:
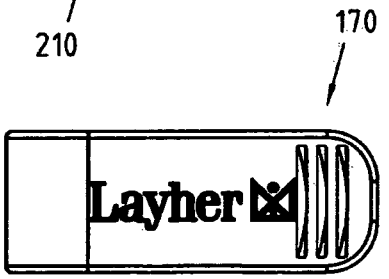
FIG. 13*d* shows a top view or plan view of the locking lever.
Figure 13E:
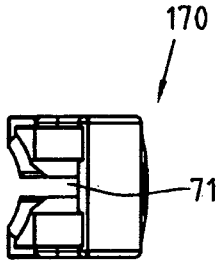
FIG. 13*e* shows a view of the locking lever according to FIG. 13*d* from behind.
Figure 16:
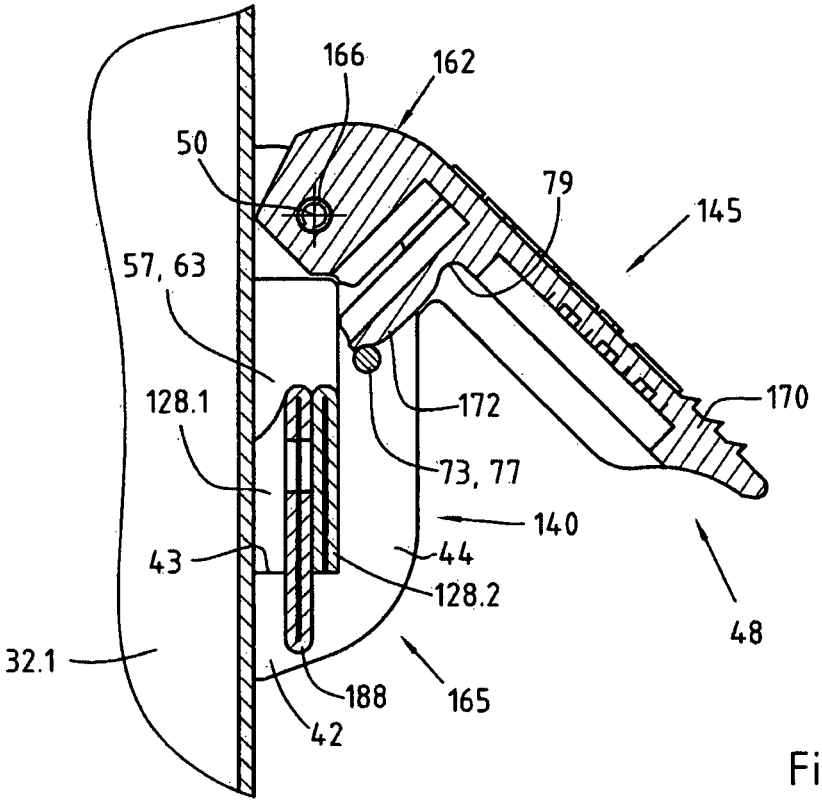
FIG. 16 shows an enlarged part section of a detail of a prop according to the invention parallel to the longitudinal axis thereof, which is formed with the fastening device, which is shown in FIG. 11, with a pivotable locking lever in accordance with the second exemplifying embodiment, which lever is here disposed in an open or unlocking setting in which the opening or slot for reception of railing rods is not covered by parts of the locking lever.

In order to ensure that the locking lever 170 in the open setting 48 shown in FIG. 11 does not nevertheless partly protrude into the passage opening 57 or the receiving slot 63 due to gravitational force the form or contour of the pressing body 172 is slightly changed in the locking lever 170 by comparison with the locking lever 70. The pressing body 177 is now shaped in such a manner that, as shown in FIG. 16, in the said or desired open setting 48 it bears against the counter-body 73, which is formed as a pin. In this manner, in this open setting 48 a (further) pivotation of the locking lever 170 in downward direction due to gravitational force is prevented. For this purpose the pressing body 172 is here no longer shaped as an eccentric body. Nevertheless, the pressing body 172 is also formed in this exemplifying embodiment with a convexly outwardly curving pressing wall which is separated from a slot 85 from the rest of the rearward part of the articulation and locking part 162. In this manner the pressing body 172 in the course of a desired manual pivotation of the locking lever 170 can also be resiliently pressed back from the open or unlocking setting shown in FIGS. 11, 16 and 17 into the closing or locking setting 47 shown in FIG. 18 with exertion of a defined pivoting force, so that it can pass the pin 77 functioning as counter-body 73.

Figure 17:
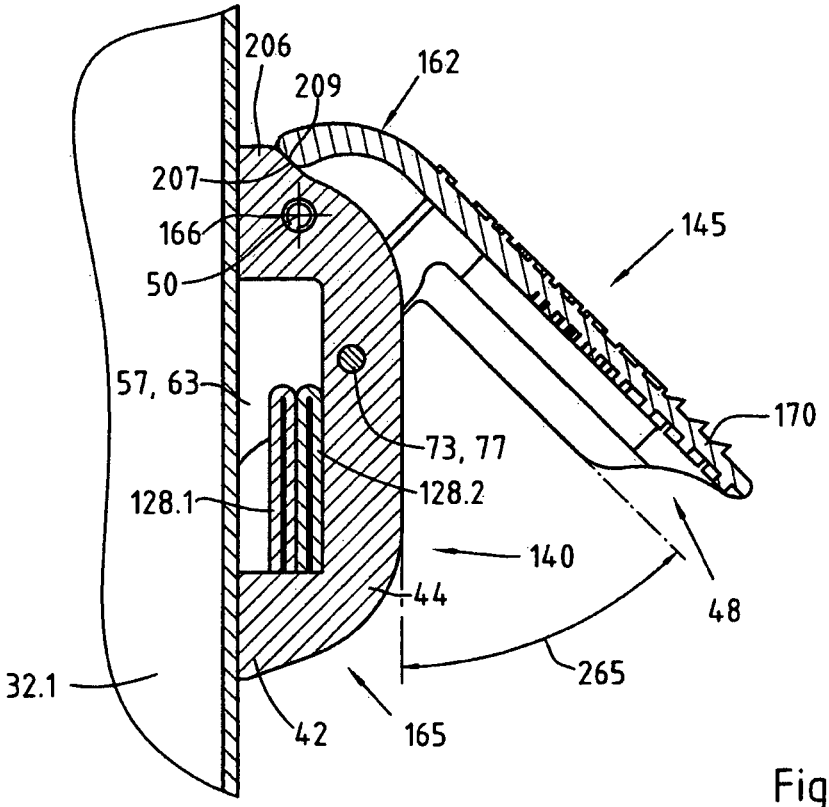
FIG. 17 shows a enlarged section of a detail of a prop according to the invention in accordance with FIG. 16, wherein now also the mount is shown in section, for illustration of a pivotation of the locking lever through an opening angle of not more than, here, approximately 45 degrees from upwardly bounding elements.
Figure 18:
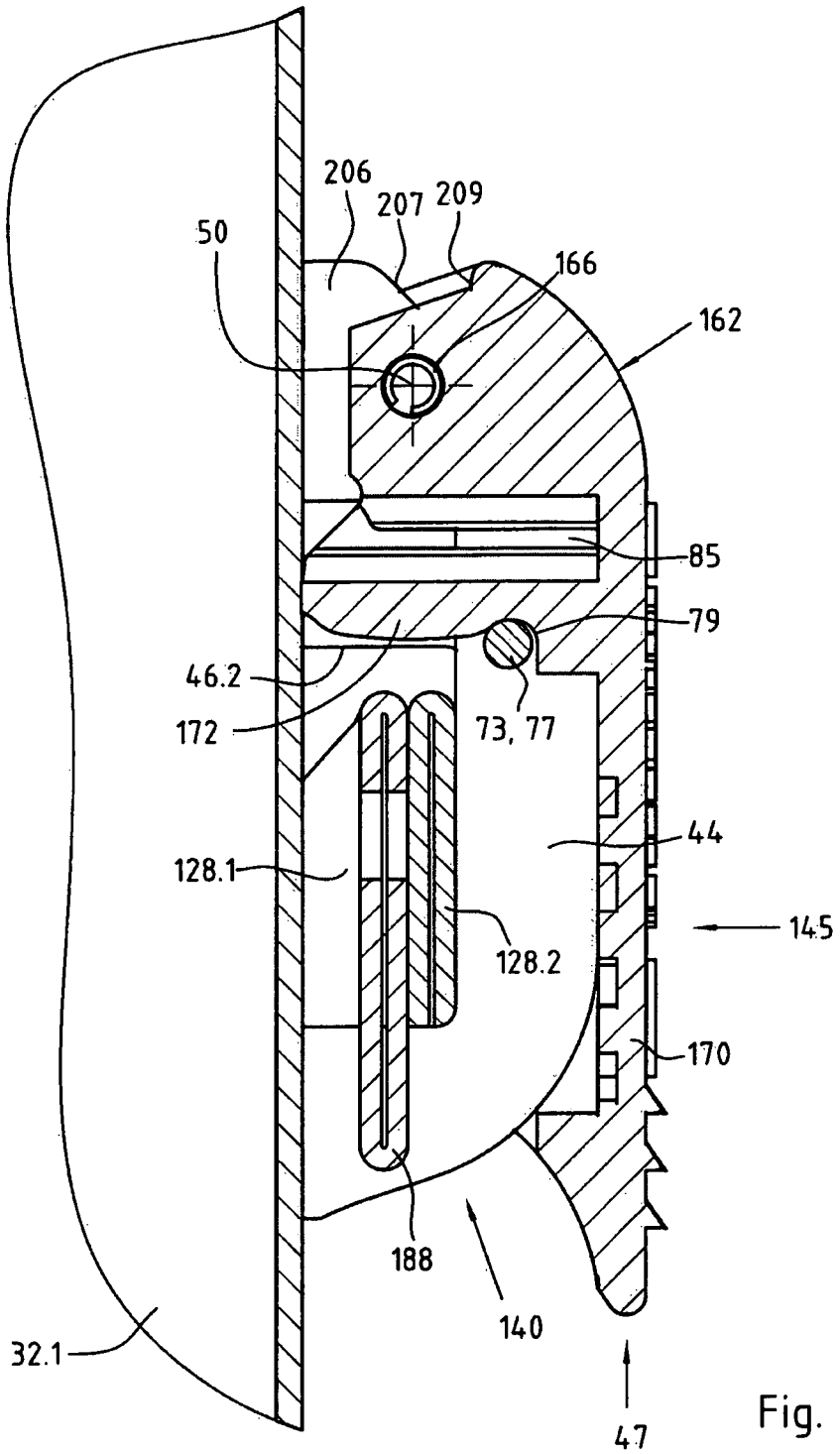
FIG. 18 shows a part section corresponding with FIG. 16, wherein the locking lever is now disposed in its closed or locking setting.

Apart from the afore-described measures, in this second exemplifying embodiment further measures are also provided by which it is ensured that the locking lever 170, considered from its closing or locking setting 47, can be pivoted upwardly about its pivot axis 50 only through a specific maximum opening angle 265. This maximum opening angle 265 is preferably smaller than 60 degrees, particularly smaller than or equal to approximately 45 degrees (see, in particular, FIG. 17). As a result, excessive jutting-out of the locking lever 170 in its open setting 48 can be avoided, whereby the risk of persons possibly being caught at the locking lever 170 disposed in the open or unlocking setting 48 can accordingly be reduced. As a further measure of that kind it is initially provided that the locking lever 170 has an abutment body 209 which extends horizontally between the bearing bodies 208.1 and 208.2 separated by the longitudinal slot 71. In addition, it is provided that the mount 140 has at its upper end a lug 206 which—or the outer surface of which facing away from the post 32.1—forms an abutment 207 for the abutment body 209 of the locking lever 170 (FIG. 17). The abutment 207 of the mount 140 and the abutment body 209 of the locking lever 170 are formed to be matched to one another in such a manner that the locking lever 170, as previously explained, can be pivoted upwardly about its pivot axis 50 only through a specific maximum opening angle 265, which here is approximately 45 degrees.

According to the second exemplifying embodiment the locking lever 170 is no longer fastened and mounted on the mount 140 with the help of a rivet functioning as fastening means, but with the help of a pin 166 which similarly functions as fastening means and which here is formed as a dowel pin 166, which—preferably over its entire length—is, in particular, slotted and preferably hollow or sleeve-shaped. This can be seen particularly readily in FIG. 18. The dowel pin 166 is clamped in force-locking manner at a bore, which receives this, of the mount 140. The locking lever 170 is mounted on the thus-clamped dowel pin 166 to be rotatable about its pivot axis 50. For this purpose the two bearing bodies 208.1 and 208.2 of the locking lever 170 each have a bearing bore or bore 211.1 and 211.2, the inner diameter of which is slightly greater than the outer diameter of the dowel pin 166 in these regions. It will be obvious that other pins or bolts can also be provided instead of a dowel pin, for example a grooved pin. This can be provided centrally with a thickening which when knocked into the bore of the mount 140 is then clamped there with a press fit. Constructions of that kind can be more simply produced by comparison with a fastening by a rivet and in a given case even releasable again and moreover are also more economic.

Figure 14:
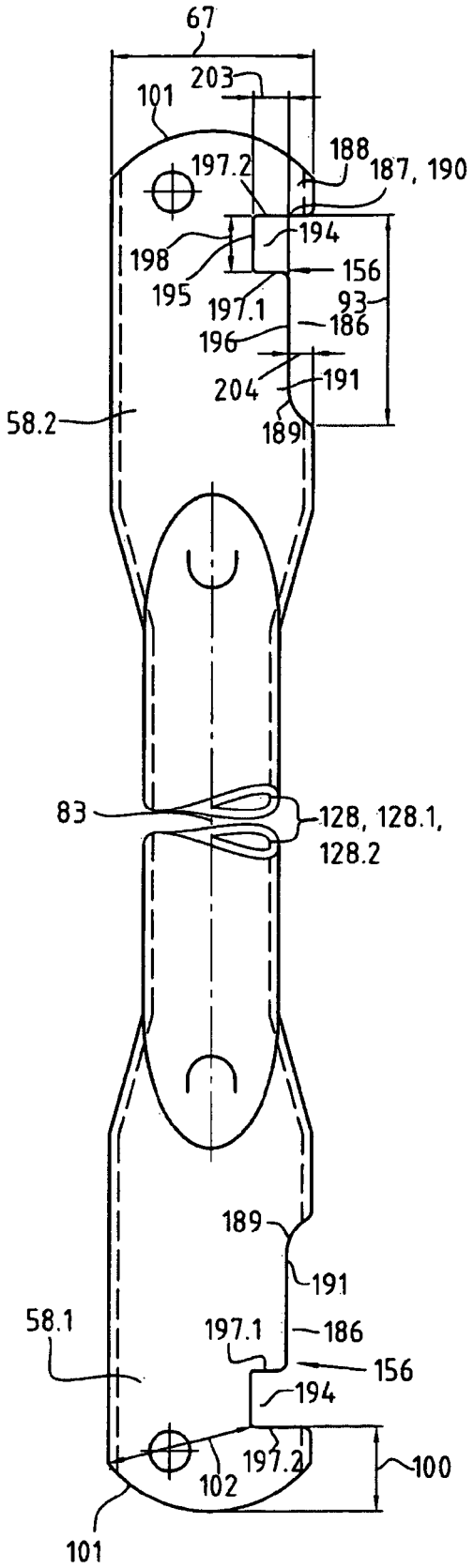
FIG. 14 shows a side view of end sections of a railing rod in accordance with a second exemplifying embodiment.

A second exemplifying embodiment of a railing device 128; 128.1, 128.2 is illustrated in, in particular, FIG. 14. The railing rod 128; 128.1, 128.2 shown there differs from the railing rod 28; 28.1, 28.2 shown in FIG. 9 essentially by a deeper and wider recess 194. This thus has a greater width or a greater support surface spacing 198 and a greater depth 103. By comparison with the railing rod 28; 28.1, 28.2 shown in FIG. 9 the greater depth 103 of the second recess 194 of the railing rod 128; 128.1, 128.2 was achieved in that the depth 204 of the rest surface 196 was correspondingly reduced. The greater width or the greater support surface spacing 198 was, starting from the railing rod 28; 28.1, 28.2 shown in FIG. 9, achieved in that material was removed in the region of the support surface 97.1 there so that the position of the support surface 97.1 has thus changed with the railing rod 128; 128.1, 128.2. Due to the greater depth 104 of the notch or of the second recess 94 a user can now better or more easily sense, when hanging the railing rods 128; 128.1, 128.2 in place, whether or that or if the railing sits in the correct position during introduction or insertion. In other words, the detenting or notching of the railing rod 128; 128.1, 128.2 at the desired detent position is now better and more securely possible. Due to the greater width of the notch or greater to the greater support surface spacing 198 of the support surfaces 97.1 and 97.2, which bound the second recess, a greater tolerance is achieved relative to any different spacings, which may occur during setting up of the props 32; 32.1, 32.2, between two props 32.32 or scaffolding frames 21-21, at or between which a railing rod 128; 128.1, 128.2 is hung, so that jamming or a possibility of hanging in place the railing rods only by a greater exertion of force cannot arise. The railing rod 128; 128.1, 128.2 is otherwise unchanged by comparison with the railing rod 28; 28.1, 28.2 shown in FIG. 9.

Figure 19:
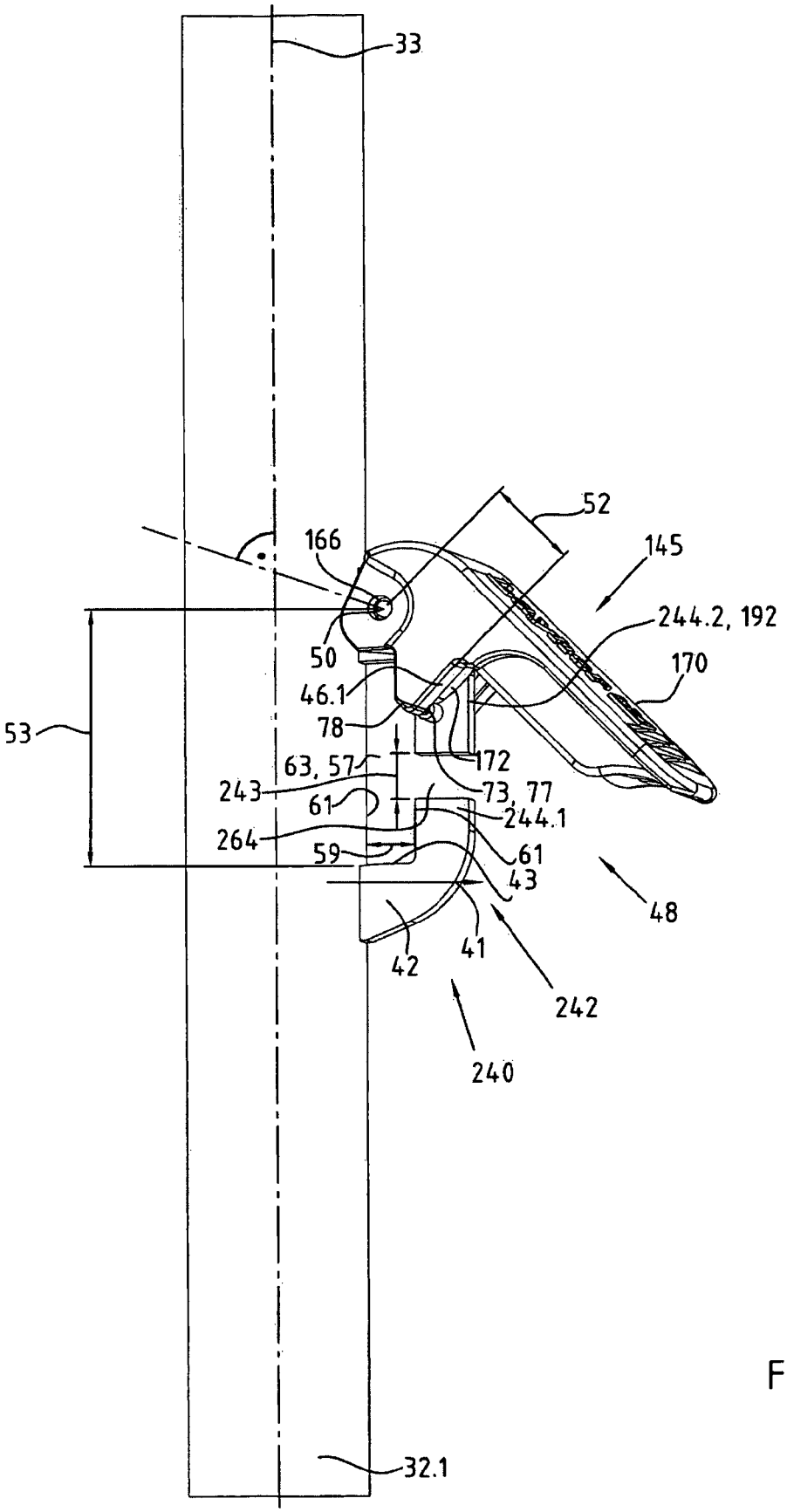
FIG. 19 shows a view, which corresponds with FIGS. 4 and 11, of a prop according to the invention, which is formed with a fastening device—which has a pivotable locking lever in accordance with the second exemplifying embodiment—in accordance with a third exemplifying embodiment with a mount in accordance with a third exemplifying embodiment.

A further prop according to the invention in shown in FIG. 19, which is designed with a fastening device according to the invention in accordance with a third exemplifying embodiment, which fastening device has a pivotable locking lever 170 in accordance with the second exemplifying embodiment, with a mount 240 according to a third exemplifying embodiment. By contrast to the second exemplifying embodiment, which is shown in, in particular, FIG. 11, of a mount 140 the mount 240 according to FIG. 19 is designed to be slotted (horizontal slot or gap 264), but nevertheless has a passage opening 57 (receiving slot 63), which is closed or surrounded substantially at the whole circumference, for insertion of an end (58.1, 58.2) of the at least one railing device (28 or 128). The mount 240 is designed to be matched by its slot 264 to the railing device in such a manner that the railing device 28, 128 inserted into or hung in place in the passage opening 57 also cannot be unhung or withdrawn or removed from the mount 240 through the slot 264 when the locking element or the locking lever is disposed in an or its open or unlocking setting.

The slot or gap 264 separates the stirrup, which in the first and second exemplifying embodiment is continuous without slotting or interruption, into two parts, namely into a lower element, which comprises the rest element 42 and a lower support element 244.1, and an upper element, which comprises an upper support element 244.2 and a fastening body 192. The mutually opposite ends of the support elements 244.1 and 244.2 have a mutual spacing 243 corresponding with the width of the slot or gap 264. The mount 240 is formed with a lower receiving profile 242, which includes the lower support element 244.1, for reception and support of the railing device 28; 128. The receiving profile 242 is fastened permanently, preferably by welding, to the post 32.1 at the end of the receiving profile facing away from the end of the support element 244.1 bounding the slot or gap 243. The fastening body 192 here integrally connected with the other or upper support element 244.2 is similarly fastened permanently, preferably by welding, to the post 32.1 at the end of the fastening body facing away from the end of the support element 244.2 bounding the slot or gap 243. In this manner the locking lever 170 is, by contrast to the aforesaid exemplifying embodiments of a mount 40, 140, now fastened not to the part of the mount 240 containing the receiving element 24 and also not to a support element of the support elements 244.1, 244.2 of the mount 240, but to a or the separate fastening body 192 here preferably integrally connected with an or the upper support element 244.2. It will be obvious that for a mount designed in accordance with or similar to the third exemplifying embodiment of a mount 240 it is also possible to provide a locking lever 70 designed in accordance with the first exemplifying embodiment or a similarly designed locking lever.

The invention also relates to a scaffolding frame, particularly a standing scaffolding frame 21; 21.1, 21.2, with at least one prop 32.1 according to the invention and with at least one transverse arm 35; 35.1, 35.2, which is fastened, preferably captively, in particular permanently, for example by welding, to the at least one prop 32.1.

The invention further relates to a scaffolding frame, particularly a standing scaffolding frame 21; 21.2, 21.2, with at least one connecting arrangement 80 according to the invention, wherein at least one transverse arm 35; 35.1, 35.2 is fastened, preferably captively, in particular permanently, for example by welding, to the at least one prop 32.1.

The invention also relates to scaffolding 20, particularly building scaffolding, with at least four vertical props 32; 32.1, 32.2; 32.4, 32.5, on which preferably at least one covering unit, for example a scaffolding floor 31, horizontal rod elements 24, 25 and/or at least one diagonal element 26 for stiffening of the scaffolding 20, are mounted, and with at least one prop 32.1, 32.3 according to the invention and/or with at least one connecting arrangement 80 according to the invention and/or with at least one vertical frame element 105.1, 105.2 according to the invention and/or with at least one scaffolding frame according to the invention.

Figure 20:
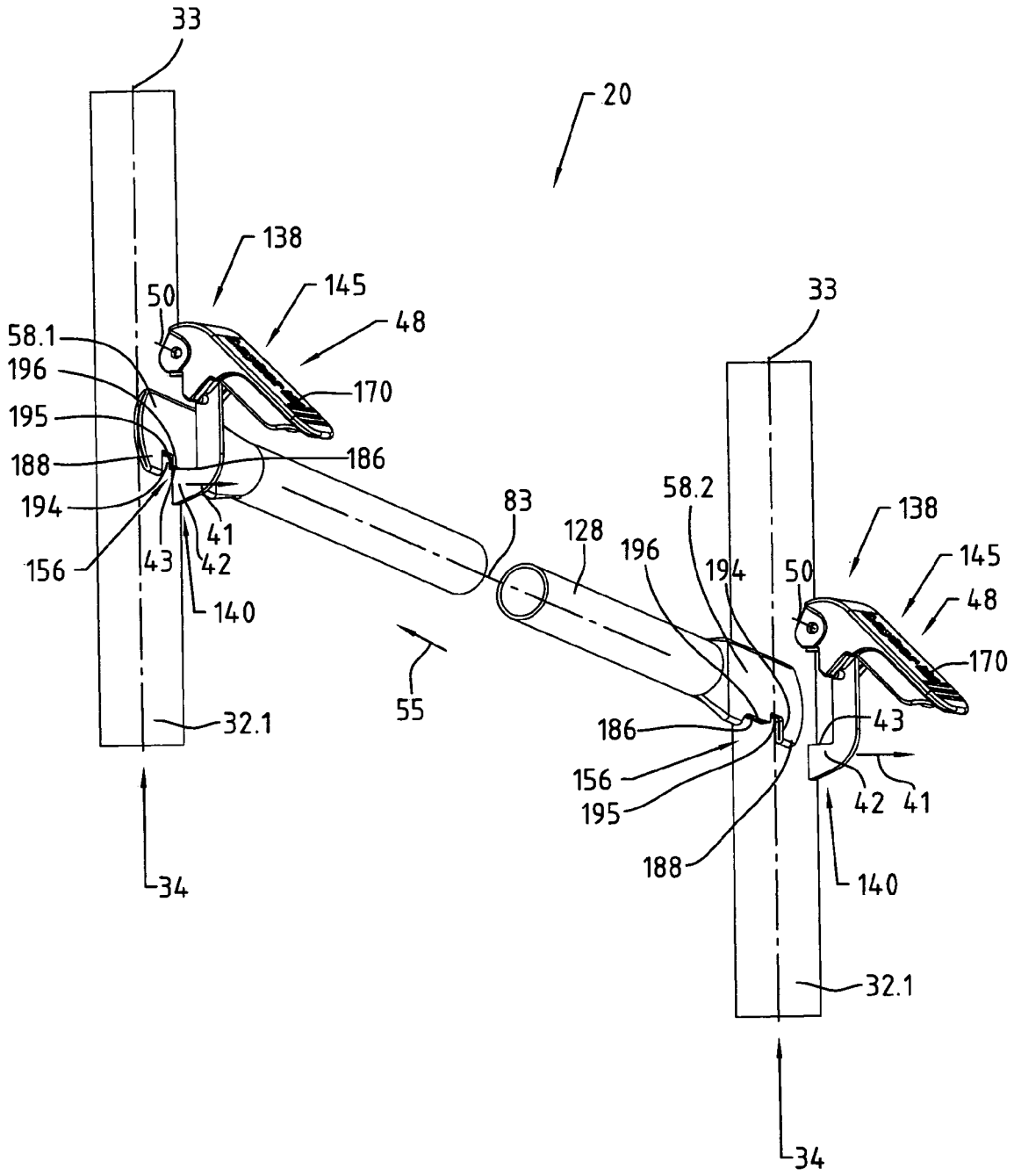
FIGS. 20 to 22 three-dimensional views of scaffolding components of a scaffolding, to illustrate an assembly sequence in which, according to a first method variant, a method according to the invention, for installation or fastening of a railing device according to the invention, from a same scaffolding tier or story, is illustrated.
Figure 21:
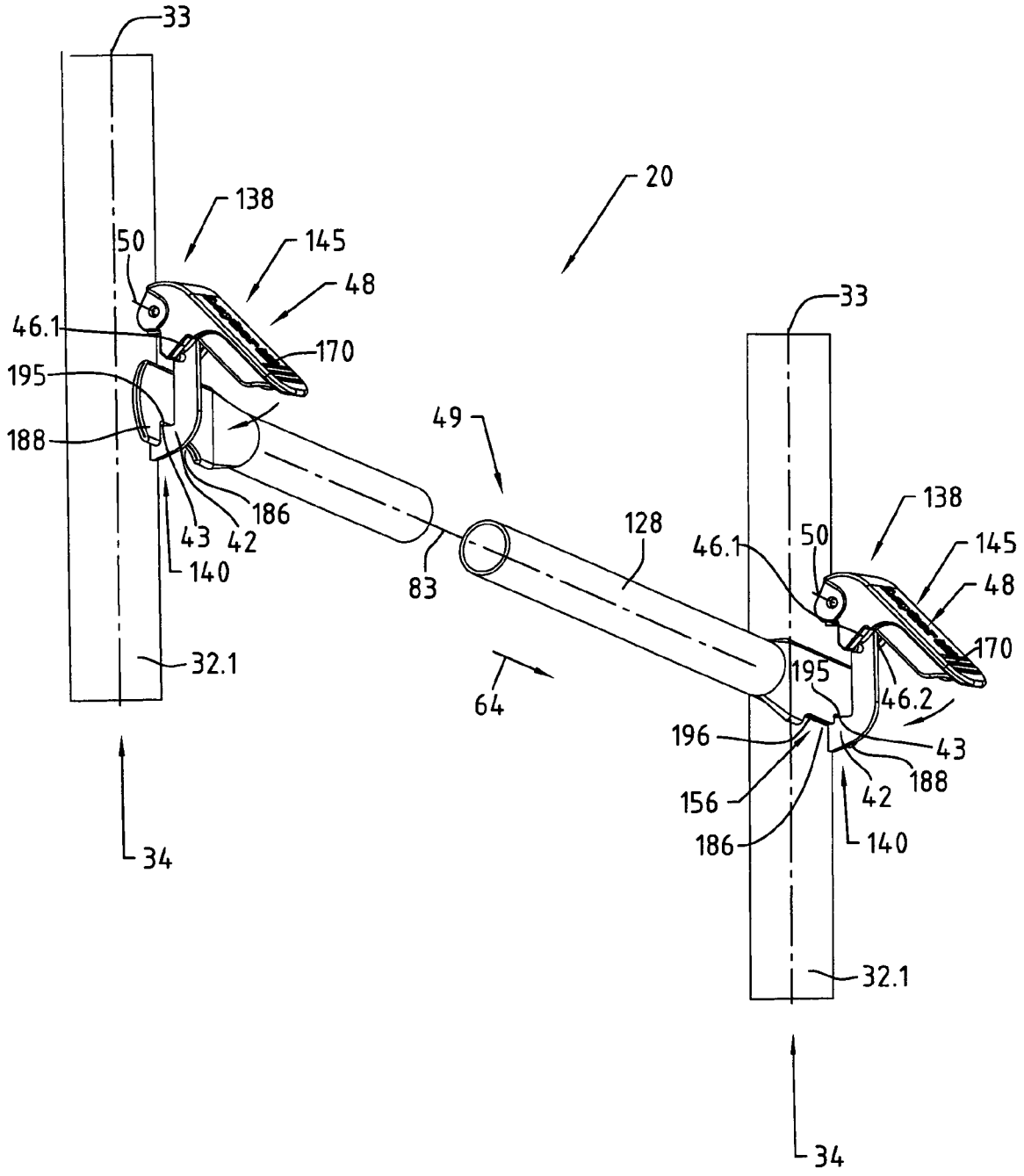
Figure 22:
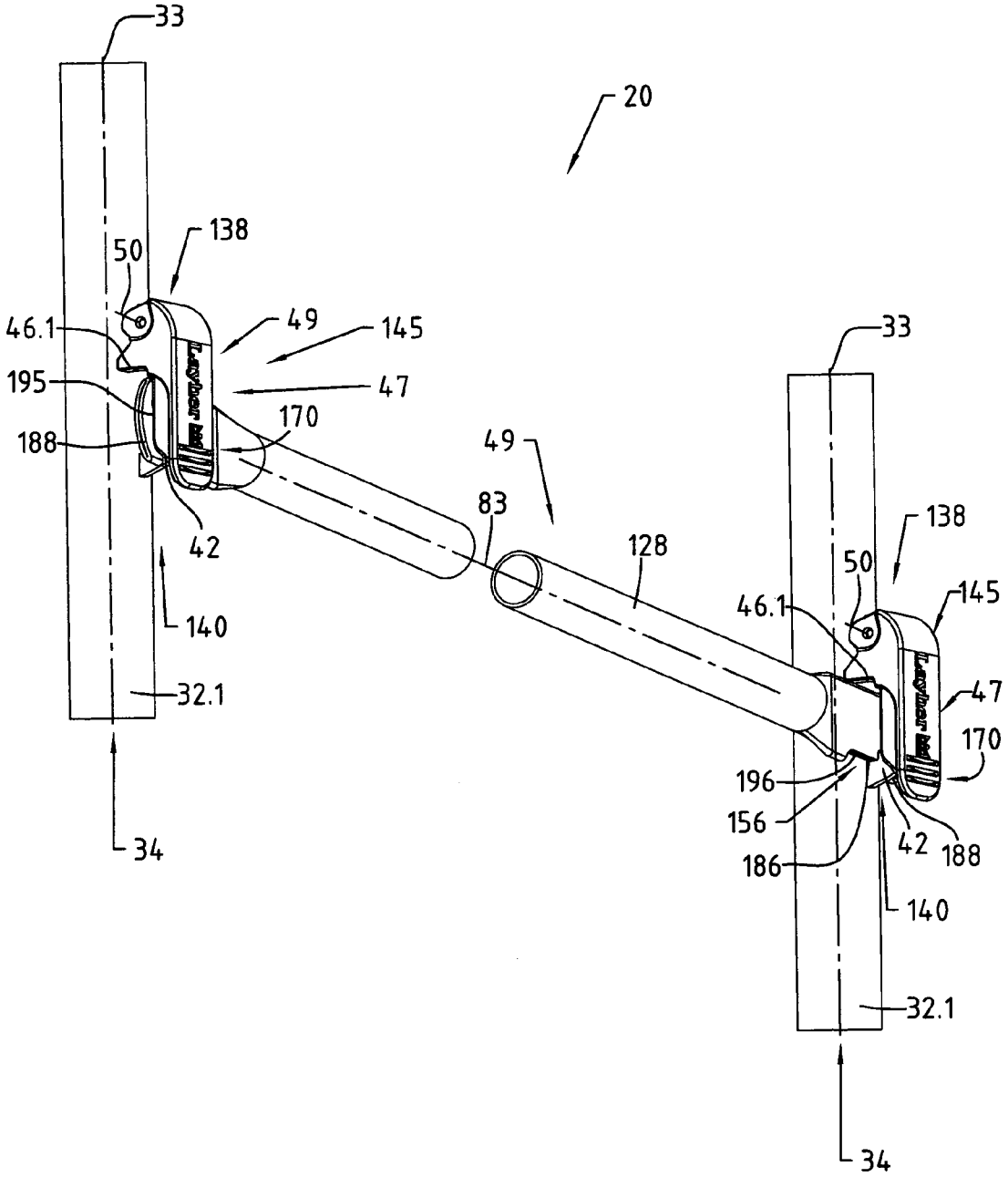

It is a further important feature of the invention that the railing device 28, 128, particularly the railing rods 28.1, 28.2, 128.1, 128.2 can be installed not only from the same scaffolding tier or storey 22.1 to 22.4 as shown in FIGS. 20 to 22, but also if needed—in order to create an advance railing—from a or the scaffolding tier or storey disposed thereunder, as shown in FIGS. 23 to 30.

A method according to the invention for installation of a railing device 28, 128 from the same scaffolding tier can be defined as follows:

Method of fastening at least one railing device 28, 128 with the help of a fastening device 38 to a prop 32.1, 32.3 for scaffolding 20, a stage, a staircase or like three-dimensional framework, wherein the fastening device 38 comprises a mount 40, 140, 240 for the railing device 28, 128 and wherein the mount 40, 140, 240 is connected or fastened, preferably captively, in particular permanently, preferably by welding, with or to the prop 32.1, 32.3, particularly a prop 32.1, 32.3 according to the invention, preferably a vertical post, of metal, which mount comprises a rest element 42, which extends in a first direction 41 transversely, preferably perpendicularly, to the longitudinal axis 33 of the prop 32.1, 32.3 away therefrom, with a rest surface 43 for vertical support of the railing device 28, 128, which is formed in particular as a single or double railing and preferably with or as a railing rod 28.1, 28.2; 128.1, 128.2 and which preferably forms a part of a connecting arrangement 80, particularly a connecting arrangement 80 according to the invention, wherein a rest part 56, 156, which is preferably arranged in the region of an end 58.1, 58.2 of the railing device 28, 128 or of the railing rod 28.1, 28.2; 128.1, 128.2, of the railing device 28, 128 can be supported on the rest surface 43 of the rest element 42, and wherein the fastening device 38 further comprises a locking element 45, 145, which is firmly, preferably captively, connected with the prop 32.1, 32.3 and preferably formed with or as a locking lever 70, 170, with a locking surface 46 for mechanically positive locking, preferably free of clamping force, of the railing device 28, 128 against vertical removal thereof in upward direction when the prop 32.1, 32.3 is in use setting 34, and wherein the locking element 45, 145 is pivotable, preferably manually, in particular in downward direction in use setting 34 of the prop 32, about a pivot axis 50 from an unlocking setting 48, in which the railing device 28, 128 can be placed on the rest surface 43 of the rest element 42 of the mount 40, 140, 240 or removed from the mount 40, 140, 240, into a locking setting 47, and conversely, in which the railing device 28, 128 is locked by means of the locking element 45, 145 against removal from the mount 40, 140, 240 at least in one direction and in which the railing device 28, 128 is secured against removal in any directions from the mount 40, 140, 240, wherein the railing device 28, 128 is placed or plugged—before the locking element 45, 145 has been transferred into its locking setting 47, or in unlocking setting 48—horizontally in a second direction 55 transversely, preferably perpendicularly, to the longitudinal axis 33 of the prop 32.1, 32.3 and also transversely, preferably perpendicularly, to the first direction 41 on or onto the rest surface 43 of the rest element 42 of the mount 40, 140, 240 and subsequently the locking element 45, 145 is transferred to its locking setting 47 in which the railing device 28, 128 is mechanically positively locked, preferably free of clamping force, by means of the locking element 45 against removal from the mount 40, 140, 240 upwardly in the direction of, preferably parallel to, the longitudinal axis 33 of the prop 32 when the prop 32 is in use setting 34 (see FIGS. 20 to 22).

For installation of the railing device 28, 128 or the railing rods 28.1, 28.2; 128.1, 128.2 from the same scaffolding tier the locking levers 70, 170 at the props 32.1 or at the standing frames 21; 21.1, 21.2 are thus to be opened or transferred to their unlocking setting 48, insofar as this is not the case.

The installation of a railing device 28, 128 at the mounts 40, 140, 240 of two adjacent props 32.1, 32.3 can then be carried out in such a manner that the railing device 28, 128 or the railing rod 28.1, 28.2; 128.1, 128.2 is initially placed in the region of a rest surface 96, 196 of the first recess 86, 186 of a first end 58.1 of its ends 58.1, 58.2 on the rest surface 43 of the rest element 42 of the mount 40, 140, 240 of a first prop 32.1, 32.3, preferably horizontally in the use setting 34 thereof, wherein the locking element 45, 145 of the fastening device 38 of the first prop 32 is disposed in its unlocking setting 48 (see FIG. 20), and that subsequently the railing device 28, 128 or the railing rod 28.1, 28.2; 128.1, 128.2 is displaced in the direction 64 of the mount 40, 140, 240 of the adjacent second prop 32.1, 32.3 until the respective rest surface 95, 195 of the respective second recess 94, 194 of the other end 58.2 of this railing device 28, 128 or this railing rod 28.1, 28.2; 128.1, 128.2 comes to lie on the associated rest surface 43 of the respective rest element 42 of the respective mount 40, 140, 240 with formation of a mechanically positive connection between the railing device 28, 128 and the two props 32.1, 32.3; 32.1, 32.3 (see FIG. 21), and that subsequently the locking elements 45-45; 145-145 of the fastening device 38-38 of the two props 32.1, 32.3; 32.1, 32.3 are pivoted into their locking setting 47 (see FIG. 22). The railing device 28, 128 is thus installed in that it is pushed on one side into the cut-out or first recess 86, 186 over the suspension point defined by the second recess 94, 194 (see FIG. 20 and there the arrow 55), then inserted on the other side and subsequently then pulled back until the railing device 28, 128 then locks or detents at its two suspension points or at its two second recesses 94, 194 at the rest elements 42 of the mounts 40, 140, 240, so that subsequently the rest surfaces 95, 195 of the two second recesses 94, 194 of the railing device 28, 128 lie on the rest surfaces 43 of the rest elements 42 of the mounts 40, 140, 240 of the two adjacent props 32.1, 32.3; 32.1, 32.3 (see FIG. 21). After installation of this railing device 28, 128 or after installation of all railing devices 28 of a scaffolding tier or story 22.1 to 22.4 the locking levers 70, 170 are then to be closed, i.e. to be transferred to the respective locking settings 47 thereof, preferably in that they are pivoted downwardly about their pivot axes 50 from their unlocking or open settings 48, as for example, depicted in FIG. 22.

For installation of the railing device 28, 128 or the railing rods 28.1, 28.2; 128.1, 128.2 from the or a scaffolding tier or story disposed thereunder it does not matter whether the locking lever 70, 170 is disposed in open or unlocked state or in closed or locked state. For introduction or hanging in place of the railing device 28, 128 or of the railing rods 28.1, 28.2; 128.1, 128.2 from below, particularly obliquely from below, it is ensured, when the locking lever 70, 170 is closed, thus disposed in its locking setting 47, that due to the geometry of the cut-outs or recesses, particularly in the region of the second recess 94, 194 of the ends 58.1, 58.2 of the railing device 28, 128 or of the railing rod 28.1, 28.2; 128.1, 128.2 in conjunction with the geometry of the mount 40, 140, 240 and of the locking lever 70, 170, that no collisions occur here, but that the railing device 28, 128 or the railing rods 28.1, 28.2; 128.1, 128.2 can then be readily brought, by way of an upward displacement or upward pivotation, into a level or horizontal position and then also equally secured there (see FIGS. 23 to 26). This can thus be carried out particularly simply and economically if a locking lever 70, 170 is already closed, thus already disposed in its locking setting 47. Accordingly, the invention also relates to a method of fastening at least one railing device 28, 128 with the help of a fastening device 38 to a prop 32 for scaffolding 20, a stage, a staircase or like three-dimensional framework, wherein the fastening device 38 comprises a mount 40, 140, 240 for the railing device 28, 128 and wherein the mount 40, 140, 240 is connected, preferably captively, in particular permanently, for example by welding, with the prop 32, in particular a prop 32.1 according to the invention, preferably a vertical post, of metal, which mount 40, 140, 240 comprises a rest element 42, which extends in a first direction 41 transversely, preferably perpendicularly, to the longitudinal axis 33 of the prop 32 away therefrom, with a rest surface 43 for vertical support of the railing device 28, 128, which is formed in particular as a single or double railing and preferably with or as a railing rod 28.1, 28.2; 128.1, 128.2 and which preferably forms a part of a connecting arrangement , particularly a connecting arrangement 80 according to the invention, wherein a rest part 56, 156, which is preferably arranged in the region of an end 58.1, 58.2 of the railing device 28, 128 or of the railing rod 28.1, 28.2; 128.1, 128.2, of the railing device 28, 128 can be supported on the rest surface 43 of the rest element 42, and wherein the fastening device 38 further comprises a locking element 45, 145, which is firmly, preferably captively, connected with the prop 32 and preferably formed with or as a locking lever 70, 170, with a locking surface 46 for mechanically positive locking, preferably free of clamping force, of the railing device 28, 128 against vertical removal thereof in upward direction when the prop 32 is in use setting 34, and wherein the locking element 45, 145 is pivotable, preferably manually, in particular in downward direction in use setting 34 of the prop 32, about a pivot axis 50 from an unlocking setting 48, in which the railing device 28, 128 can be placed on the rest surface 43 of the rest element 42 of the mount 40, 140, 240 or removed from the mount 40, 140, 240, into a locking setting 47, and conversely, in which the railing device 28, 128 is locked by means of the locking element 45, 145 against removal from the mount 40, 140, 240 at least in one direction and in which the railing device 28, 128 is secured against removal in any directions from the mount 40, 140, 240, wherein the railing device 28, 128 is—when the locking element 45, 145 is disposed in its locking setting 47 and when the prop 32.1, 32.3 is in use setting 34—placed or hung in place on the rest surface 43 of the rest element 42 of the mount 40, 140, 240 from below, particularly obliquely from below, in a direction transverse, preferably perpendicular, to the first direction 41, preferably approximately in a mounting plane containing a parallel to the longitudinal axis 33 of the prop 32 and a notional normal to the first direction 41, and is subsequently pivoted upwardly and transferred to a horizontal installation setting 49 in which the railing device 28, 128 is mechanically positively locked, preferably free of clamping force, by means of the locking element 45, 145 against removal from the mount 40, 140, 240 upwardly in the direction of, preferably parallel to, the longitudinal axis 33 of the prop 32 when the prop 32 is in use setting 34 and in which the railing device 28, 128 is secured against removal in any directions from the mount 40, 140, 240 (see FIGS. 23 to 26).

Figure 23:
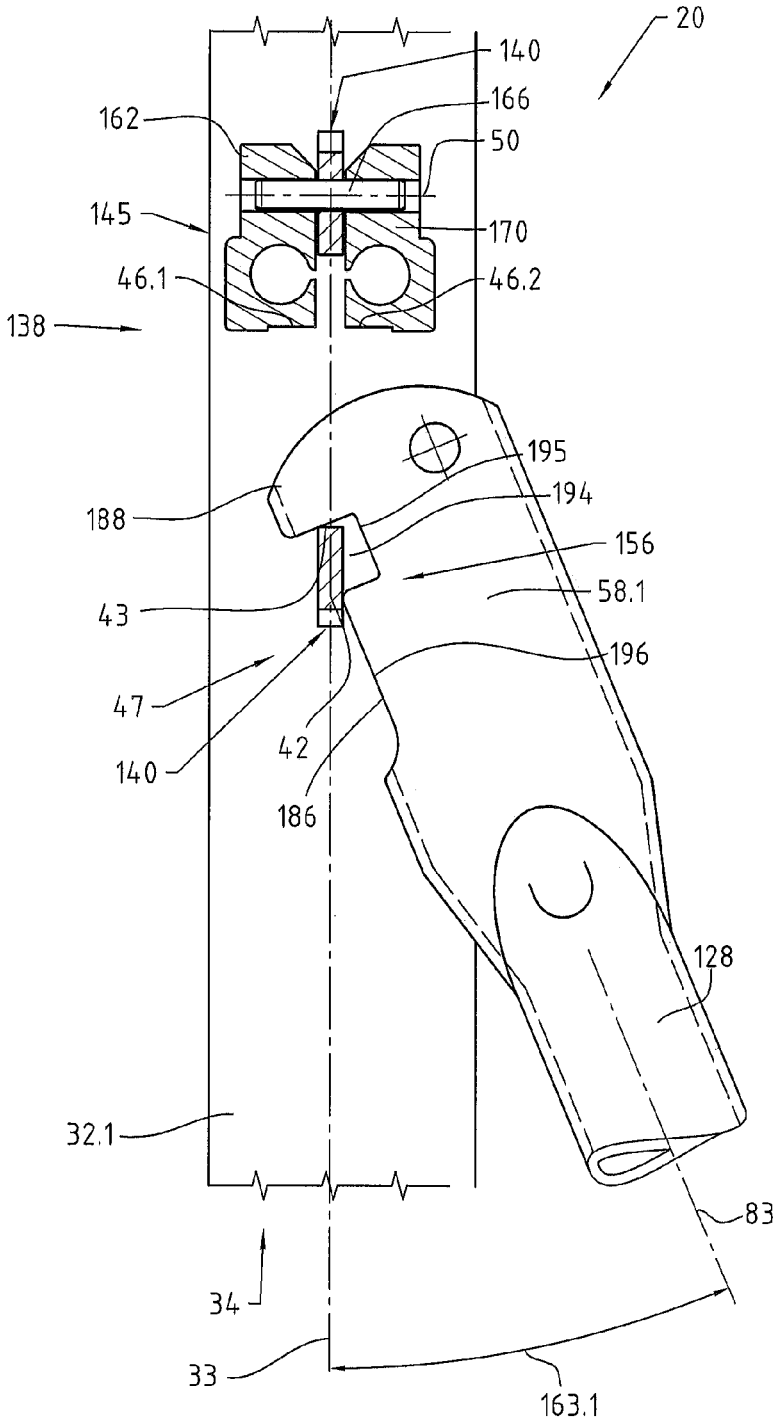
FIG. 23 a side view of a prop according to the invention, whose fastening device is shown in longitudinal section and partly with broken lines, whose locking element is in a locking setting, and whereby a railing device according to the invention is laid onto or suspended into the rest element of the mount of the fastening device, at a slant from below and at an angle to the longitudinal axis of the prop.

FIG. 23 shows a side view of a prop 32.1 according to the invention, whose fastening device 138 is shown in longitudinal section and partly with broken lines, whose locking element 145 is in a locking setting 47, and whereby a railing device 128 according to the invention is laid onto or suspended into the rest element 42 of the mount 140 of the fastening device 128, at a slant from below and at an angle 163.1 to the longitudinal axis 33 of the vertical prop 32.1.

Figure 24:
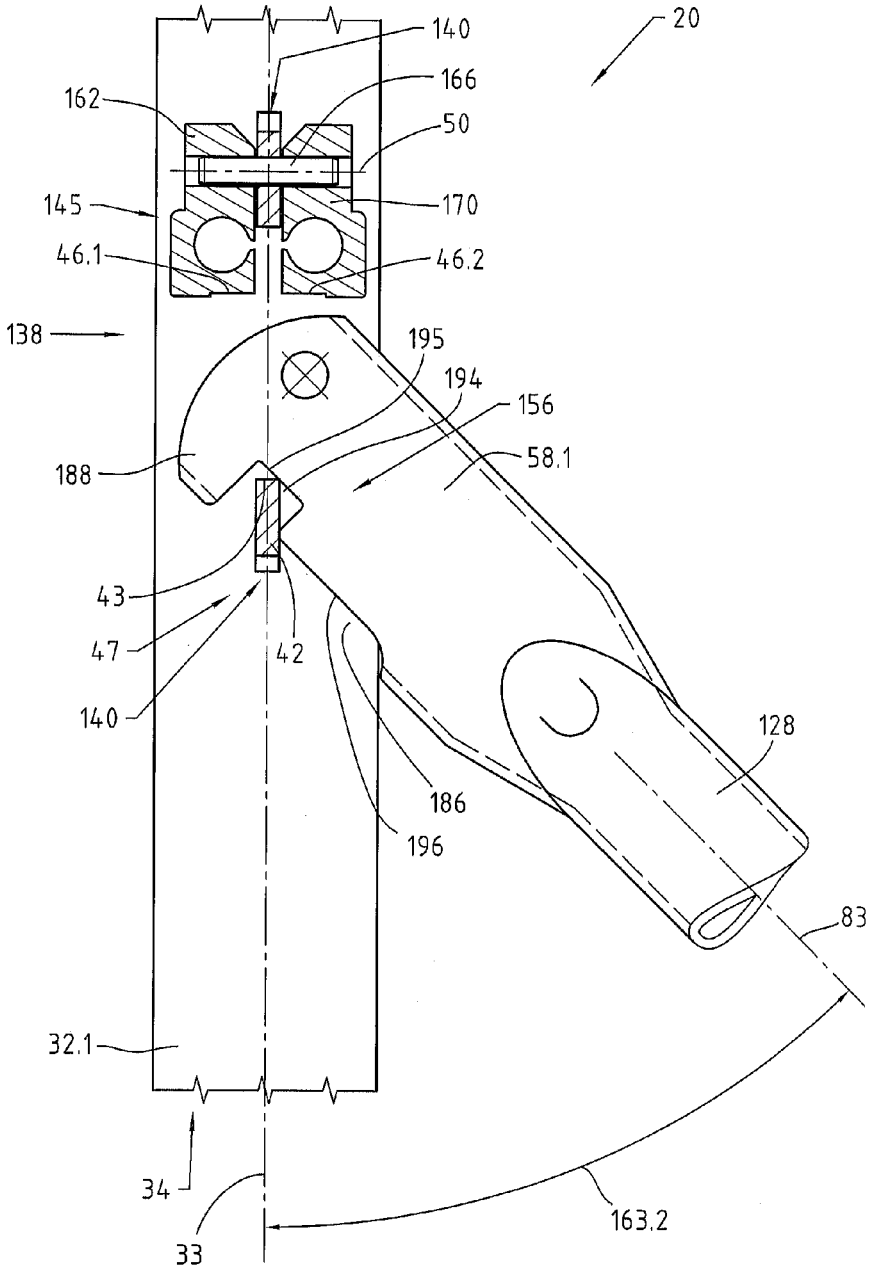
FIG. 24 a view corresponding to FIG. 23, whereby the railing device is now pivoted upward, proceeding from the diagonal setting shown in FIG. 23, counterclockwise, into a second diagonal setting.

FIG. 24 shows a view corresponding to FIG. 23, whereby the railing device 128 is now pivoted upward, proceeding from the diagonal setting shown in FIG. 23, counterclockwise, into a second diagonal setting, whereby the railing device 128 is still laid onto or suspended into the rest element 42 of the mount 140 of the fastening device 128, now at an angle 163.2 to the longitudinal axis 33 of the prop 32.1.

Figure 25:
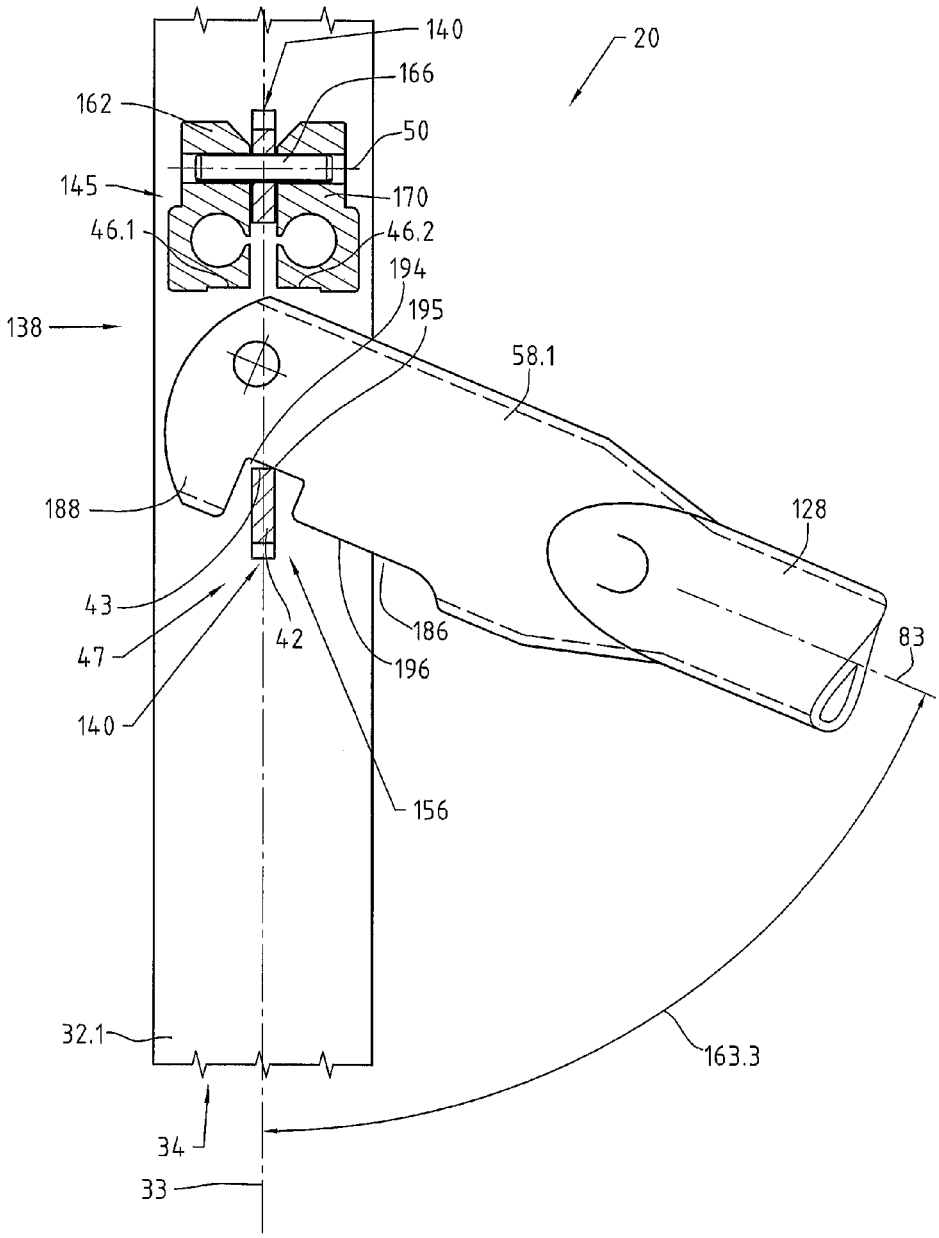
FIG. 25 a view corresponding to FIG. 24, whereby the railing device is now pivoted upward further, proceeding from the diagonal setting shown in FIG. 24, into a third diagonal setting, in which setting a vertical play or a vertical distance between the upper end of the railing element and the locking surfaces of the locking element that is in its locking position is minimal but still present.

FIG. 25 shows a view corresponding to FIG. 24, whereby the railing device 128 is now pivoted upward further, proceeding from the diagonal setting shown in FIG. 24, into a third diagonal setting, in which setting a vertical play or a vertical distance between the upper end of the railing element 128 and the locking surfaces 46.1, 46.2 of the locking element 145 that is in its locking position 47 is minimal but still present, and in which the railing device 128 is still laid onto or suspended into the rest element 42 of the mount 140 of the fastening device 128, now at an angle 163.3 to the longitudinal axis 33 of the prop 32.1.

Figure 26:
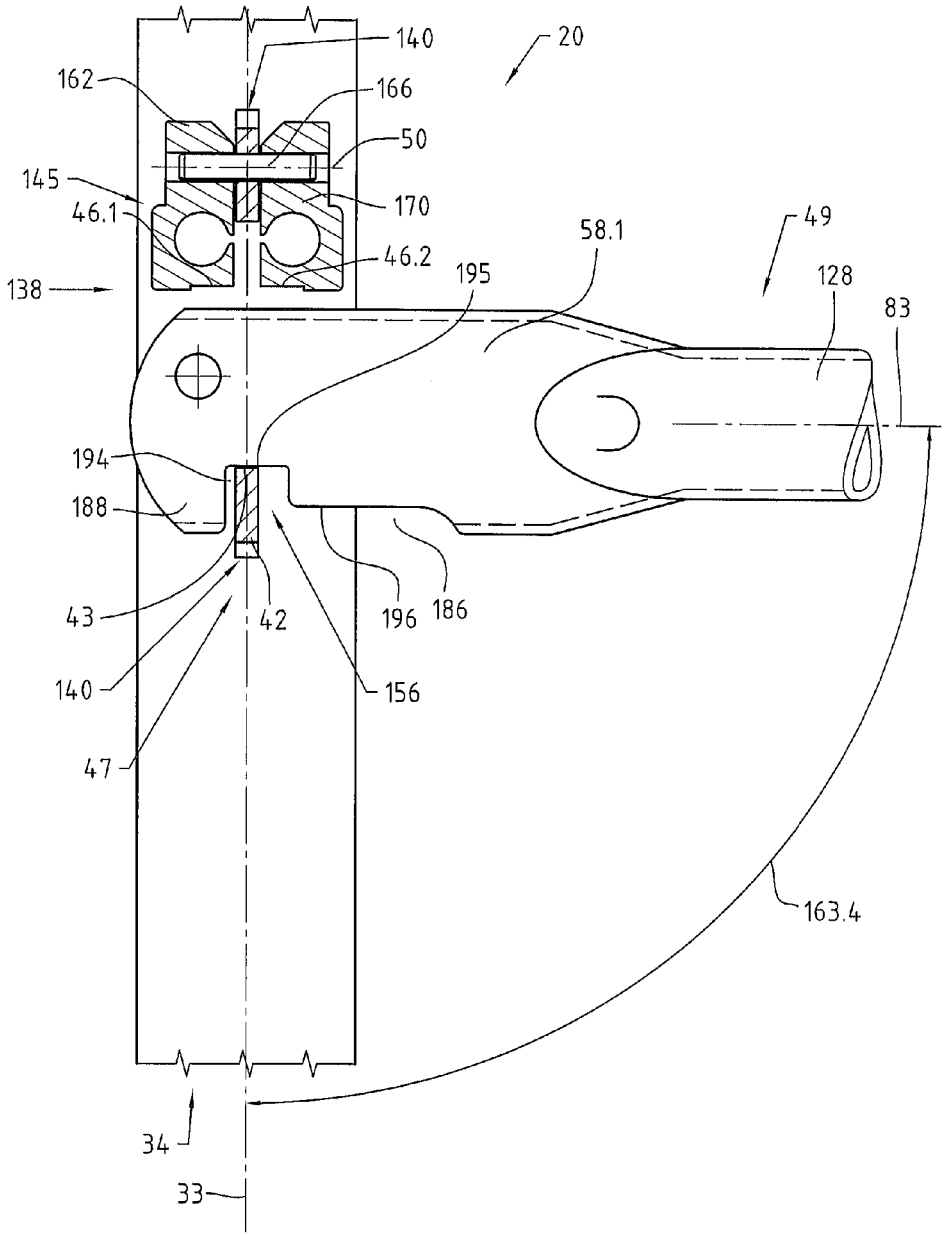
FIG. 26 a view corresponding to FIG. 25, whereby the railing device is now pivoted upward further, proceeding from the diagonal setting shown in FIG. 25, counterclockwise, into a horizontal installation setting, in which the railing element and the prop are disposed at an angle of about 90 degrees relative to one another.

FIG. 26 shows a view corresponding to FIG. 25, whereby the railing device 128 is now pivoted upward further, proceeding from the diagonal setting shown in FIG. 25, counterclockwise, into a horizontal installation setting 49, in which the railing element 128 and the prop 32.1 are disposed at an angle 163.4 of about 90 degrees relative to one another.

The invention also relates to a method of fastening at least one railing device 28, 128 with the help of a fastening device 38 to a prop 32 for scaffolding 20, a stage, a staircase or like three-dimensional framework, wherein the fastening device 38 comprises a mount 40, 140, 240 for the railing device 28, 128 and wherein the mount 40, 140, 240 is connected, preferably captively, in particular permanently, for example by welding, with the prop 32, preferably with a prop 32. 1 according to the invention, in particular with a vertical post, of metal, which mount 40, 140, 240 comprises a rest element 42, which extends in a first direction 41 transversely, preferably perpendicularly, to the longitudinal axis 33 of the prop 32 away therefrom, with a rest surface 43 for vertical support of the railing device 28, 128, which is formed in particular as a single or double railing and preferably with or as a railing rod 28.1, 28.2; 128.1, 128.2 and which preferably forms a part of a connecting arrangement, particularly a part of a connecting arrangement 80 according to the invention, wherein a rest part 56, 156, which is preferably arranged in the region of an end 58.1, 58.2 of the railing device 28, 128 or of the railing rod 28.1, 28.2; 128.1, 128.2, of the railing device 28, 128 can be supported on the rest surface 43 of the rest element 42, and wherein the fastening device 38 further comprises a locking element 45, 145, which is firmly, preferably captively, connected with the prop 32 and preferably formed with or as a locking lever 70, 170, with a locking surface 46 for mechanically positive locking, preferably free of clamping force, of the railing device 28, 128 against vertical removal thereof in upward direction when the prop 32 is in use setting 34, and wherein the locking element 45, 145 is pivotable, preferably manually, in particular in downward direction in use setting 34 of the prop 32, about a pivot axis 50 from an unlocking setting 48, in which the railing device 28, 128 can be placed on the rest surface 43 of the rest element 42 of the mount 40, 140, 240 or removed from the mount 40, 140, 240, into a locking setting 47, and conversely, in which the railing device 28, 128 is locked by means of the locking element 45, 145 against removal from the mount 40, 140, 240 at least in one direction and in which the railing device 28, 128 is secured against removal in any directions from the mount 40, 140, 240, wherein the railing device 28, 128, which rests on the rest surface 43 of the rest element 42 of the mount 40, 140, 240 in use setting 34 of the prop 32; 32.1, 32.3, is removed from the mount 40, 140, 240 after pivotation of the locking element 45, 145 into an or the unlocking setting 48, without previous removal of the railing device 28, 128 in the first direction 41 from the rest element 42, in a second direction 55 transversely, preferably perpendicularly, to the longitudinal axis 33 of the prop 32 and also transversely, preferably perpendicularly, to the first direction 41, preferably after prior vertical lifting-off, in a given case carried out within the limits predetermined by the mount 40, 140 and especially only lightly or slightly, from the rest surface 43 of the rest element 42 in upward direction.

For demounting of the railing devices 28 in the normal case the locking levers 70, 170 are to be opened. The railing devices 28, 128 can then be demounted by lifting upwardly and subsequently by a lateral displacement relative to the mounts 40, 140, 240 of the adjacent props 32.1, 32.3; 32.1, 32.3. However, it is also possible, similarly to the case of the afore-described mounting of the advance railing, to proceed only in reverse sequence. Then, for this purpose in a given case only one of the locking levers 70, 170 of two adjacent props 32.1, 32.1 has to be opened and the other locking lever 70, 170 can remain closed, wherein after a downward pivotation of the railing device 28, 128 or of the railing rod 28.1, 28.2; 128.1, 128.2, this can then be removed from being hung in the mount 40, 140, 240, with the closed locking lever 70, 170.

The preceding description applies in the same manner to the props 32.3 which are provided in the uppermost scaffolding tier or storey 22.4 of the first scaffolding bay 23.1 and which are here plugged onto the props 32.1 of the standing scaffolding frame 21. These props 32.3 can, as shown in FIG. 1, have a shorter length than, preferably a length approximately half as large as, the props 32.1. However, it will be obvious that the props of the uppermost scaffolding tier or storey 22.4 can also have a different, particularly a greater, length, preferably a length corresponding with the length of the props 32.1. It will further be obvious that, for constructing a scaffolding, use can also be made of only or additional separate props 32.1, 32.3 according to the invention and/or of vertical frame elements 105 formed from or by at least one prop 32.1, 32.3 according to the invention and at least one transverse arm 35.

The method illustrated in FIGS. 23 to 26, for installation or fastening of a railing device 128, in order to implement a leading railing, will be explained in another exemplary embodiment using FIGS. 27 to 30, in which H-shaped standing frames 21.3 are used.

Figure 15:
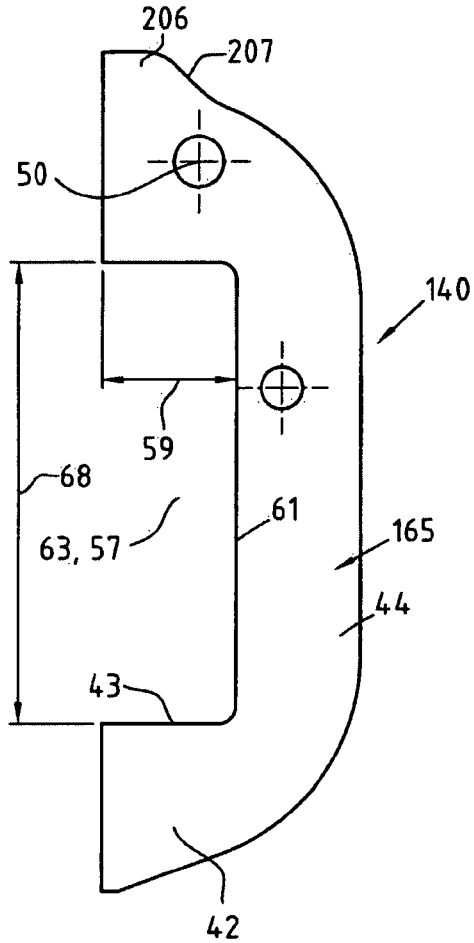
FIG. 15 shows an enlarged side view of a mount according to the invention in accordance with a second exemplifying embodiment.
Figure 30:
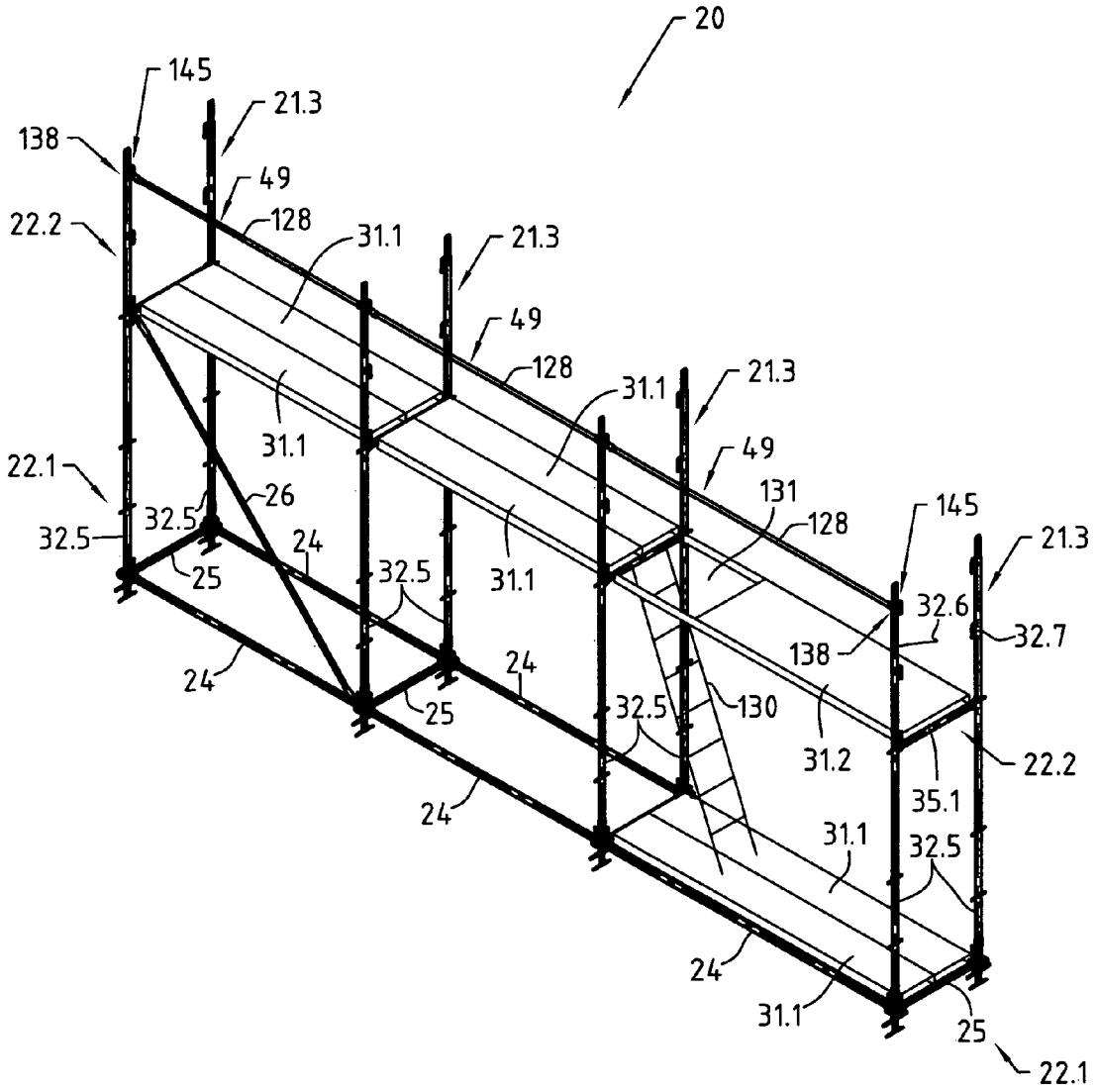
Figure 31:
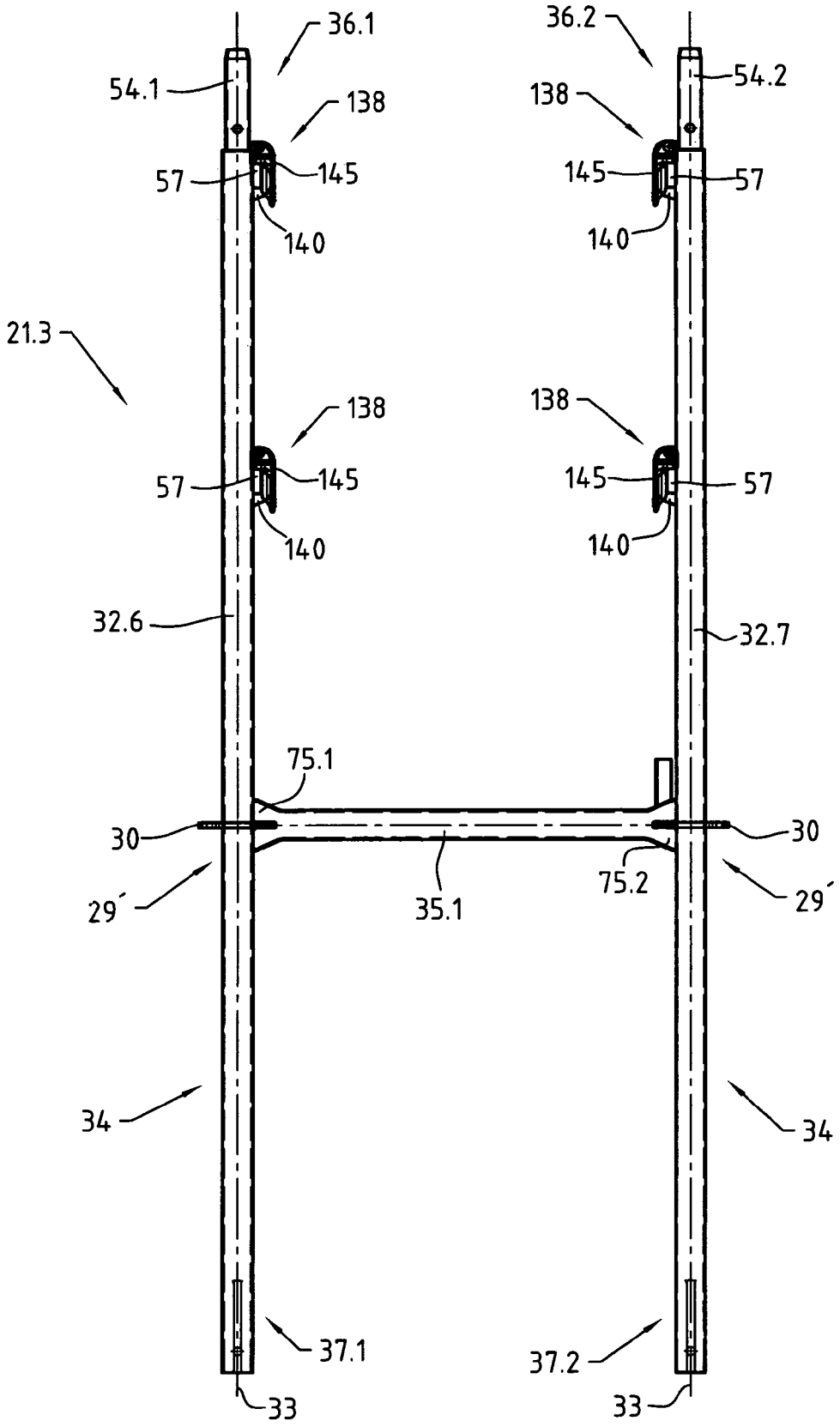
FIG. 31 an H-shaped standing frame according to another exemplary embodiment of the invention.

One of these scaffolding standing frames 21.3 according to the invention is shown in an enlarged representation in FIG. 31. This standing frame 21.3 differs from the standing frame 21.1 shown in FIG. 2 in that now, the two apertured discs 30 and the transverse arm 35.1 welded to them are not disposed in the region of the upper ends of the props, but rather in a center region, so that instead of a U-shaped standing frame 21.1 according to FIG. 2, now an H-shaped standing frame 21.3 is formed. For the remainder, the scaffolding standing frame 21.3 differs from the scaffolding standing frame 21.1 shown in FIG. 2 only in that not just one prop or one post, but rather each prop or each post 32.5, 32.6 has two fastening devices that are configured with mounts 140 and locking elements 145, as they are shown in FIG. 15 and in FIGS. 11 to 18. For the remainder, the scaffolding standing frames 21.3 shown in FIGS. 27 to 31 are configured the same as the scaffolding standing frames 21.1 according to FIG. 2. However, it is understood that according to the invention, H standing frames can also be used, in which only one prop or one post of the two props or posts is provided with at least one fastening device according to the invention, preferably with two fastening devices according to the invention.

In order to set up the scaffolding 20 shown in FIGS. 27 to 30, one can proceed as follows:

First, in a manner similar to what was described above in connection with FIG. 1, a first story or scaffolding tier 22.1 can be set up, whereby in contrast to FIG. 1, individual props 32.5 are set onto the starting members 27, as the lowermost vertical props or posts. The length of these props or posts 32.5, which can also be rigidly connected with at least one transverse arm, is only about half as great as the length of the props or posts 32.1, 32.2, 32.4.

Figure 27:
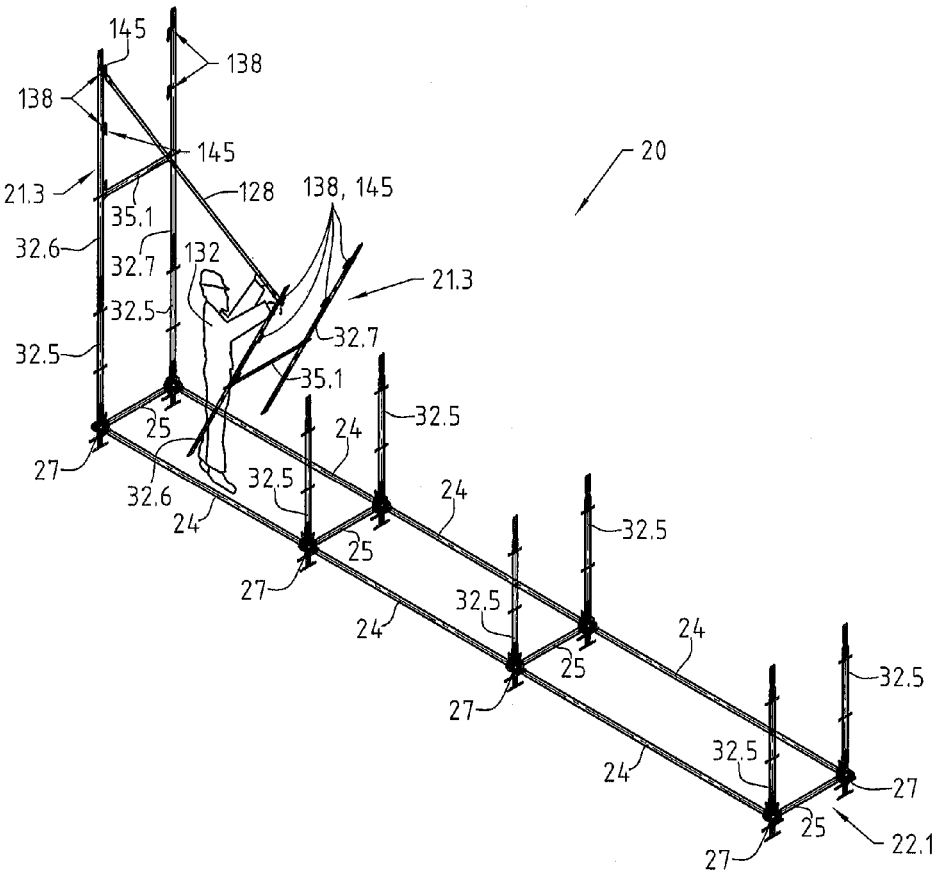
FIGS. 27 to 30 three-dimensional views of scaffolding components, to illustrate an assembly sequence during set-up of a scaffolding, in which, according to a second method variant, a method according to the invention, for installation or fastening of a railing device according to the invention, corresponding to FIGS. 23 to 26, from a scaffolding tier or story that lies below it, is illustrated.

As illustrated in FIG. 27, in order to set up a second scaffolding tier or story, first an H-shaped scaffolding standing frame 21.3 is set onto two of the lowermost vertical posts 32.5. In this connection, as shown, the locking elements 145 of the fastening devices 138 can be in their locking setting 47. In similar or the same manner as already illustrated in FIG. 23, an installer 132 can now suspend a railing device 128 into the uppermost mount 140 of a prop 32.6 of the props 32.6, 32.7 of the H-shaped standing frame 21.3, whereby, as mentioned, according to the invention the related locking element 145 can be or is in its locking setting 47, in other words the locking lever can be or is closed.

Subsequently, an operator or installer 132 can suspend the said railing device 128, which is suspended into the uppermost mount 140 of the fastening device 138 of the first prop 32.6 of the first standing frame 21.3 into the uppermost mount 140 of a second prop 32.6 of a second scaffolding standing frame 21.3 that is horizontally spaced apart from the first. For this purpose, it is practical, for simplified assembly, if the locking element 145 of the fastening device 138 of the second standing frame 21.3 is in its unlocking setting or open setting (not shown in FIG. 27). Before moving the second standing frame 21.3 upward, together with the railing device 128, it is practical if the installer 132 brings the locking element 145 of this second scaffolding standing frame 21.3 into its locking setting 47, and thereby locks the railing device 128, which has been suspended with its other or right end, in place there, as well.

However, it is understood that during or for suspension of the railing device 128 onto the mount 140 of the second standing frame 21.3, the locking element 145 assigned to this mount 140 can already be or have been changed to its locking setting.

However, it is also possible to leave the locking element 145 of the second standing frame 21.3 in its open or unlocked setting when moving the second standing frame 21.3 upward, together with the railing device 128, and to only lock the locking element 145 of the mount 140 of the second standing frame 21.3 once the railing device 128 is in its horizontal installation setting 49.

Proceeding from the intermediate setting shown in FIG. 27, the installer 132 can guide the second scaffolding standing frame 21.3, together with the railing device 128 fastened to it on its uppermost mount 140 of its prop 32.6, upward beyond the top ends of the adjacent "free" vertical props 32.5, so that in this connection, the railing device 128 suspended on the uppermost mount 140 of the prop 32.6 of the first scaffolding standing frame 21.3 is pivoted upward, counterclockwise (see also FIGS. 23 to 26).

After the second standing frame 21.3 has been set onto the props 32.5, the railing device 128 suspended on the second standing frame 21.3 and on the first standing frame 21.3 is in a horizontal installation setting 49. In this installation setting 49, the railing device 128 is locked in place with shape fit, preferably without clamping force, by means of the locking element 145 of the first prop 32.6 of the first standing frame 21.3, which is already in its locking setting 47, to prevent removal from its mount 140, in the use setting 34 of the first prop 32.6 of the first standing frame 21.3, upward, in the direction of the longitudinal axis 33 of the first prop 32.6, and in this installation setting 49, the railing device 128 lies on the rest surfaces 43 of the rest elements 42 of the mounts 140 of the props 32.6 of the two standing frames 21.3 with its rest surfaces 195, and is locked in place, by means of the two locking elements 145 of the fastening devices 138 of the props 32.6 of the two standing frames 21.3, which are in their locking setting 47, in such a manner that the railing device 128 is secured to prevent removal in any direction from the mounts 140 of the props 32.6 of the two adjacent standing frames 21.3.

Figure 28:
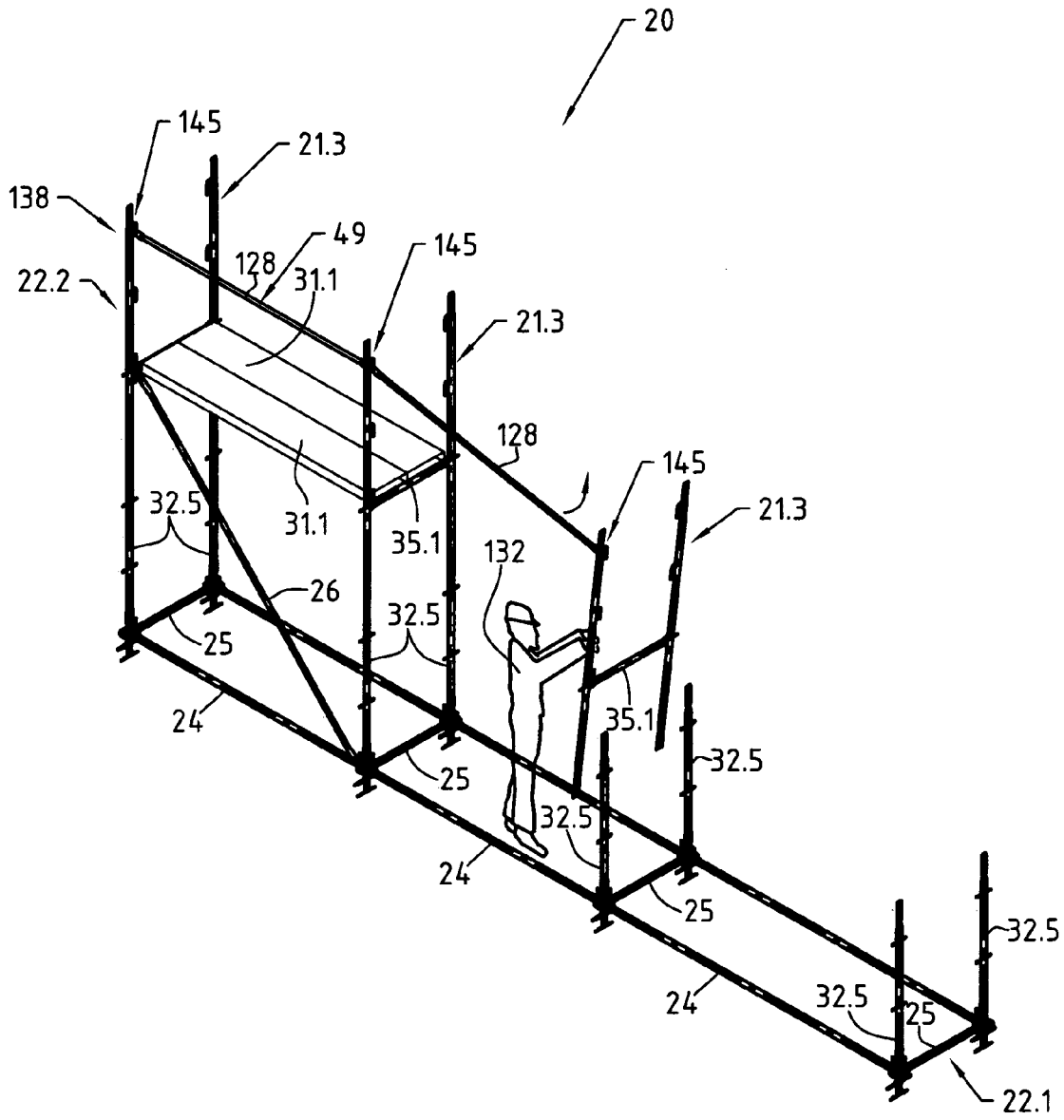

Subsequently, as shown in FIG. 28, covering units or scaffolding floors 31.1, which define or delimit the second scaffolding tier or story 22.2, can be laid onto or suspended into the transverse arm or transverse railing 35.1 of the two adjacent scaffolding standing frames 21.3.

Figure 29:
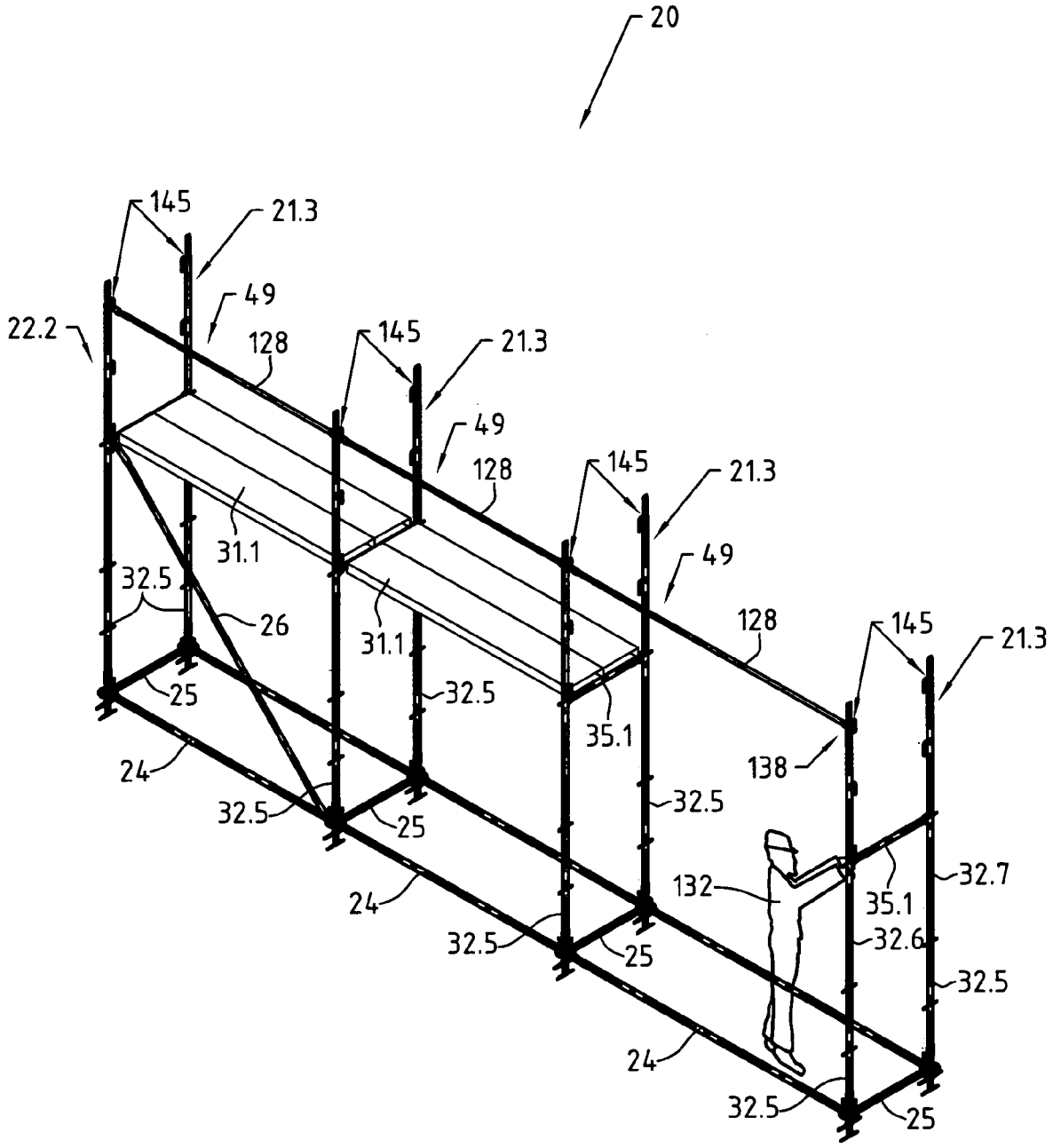

Proceeding from this, the scaffolding 20 can be built up further, in the same manner as described above and as is evident from the sequence according to FIGS. 28 to 30. In this connection, as shown in FIG. 30, at least one of the covering units or at least one of the scaffolding floors of the second scaffolding tier or story 22.2 can be installed in the form of a pass-through scaffolding floor or a pass-through covering unit 31.2, which allows a person, particularly an installer 132, to pass through a pass-through opening 131 from a first scaffolding tier or story 22.1 to the second scaffolding tier or story 22.2, and vice versa. For this purpose, a ladder 130 can be provided. It is practical if the pass-through scaffolding floor 31.2 has a lid (not shown in the figures), preferably attached by means of a hinge. The lid can be moved from an open setting that allows passage to a closed setting, in which it is assured that a person located on the second scaffolding tier or story 22.2 cannot fall down through the pass-through opening 131 of the pass-through covering unit or through the pass-through scaffolding floor 31.2.

Proceeding from the scaffolding 20 set up in FIG. 30, other scaffolding tiers or stories can be set up, in an upward direction, specifically in accordance with the set-up sequence shown in FIGS. 27 to 30 and described above.

For disassembly of the scaffolding 20, the steps can be carried out in the reverse sequence.

REFERENCE NUMERAL LIST

20 scaffolding
21 standing scaffolding frame
21.1 standing scaffolding frame
21.2 standing scaffolding frame
21.3 standing scaffolding frame/H-standing frame
22.1 scaffolding tier/storey
22.2 scaffolding tier/storey
22.3 scaffolding tier/storey
22.4 scaffolding tier/storey
23.1 first scaffolding bay
23.2 second scaffolding bay
24 rod element/longitudinal railing
25 rod element/transverse railing
26 diagonal element
27 starting member
28 railing device/means safeguarding against falling down
28.1 railing rod
28.2 railing rod
28.3 side railing
28.4 railing bar
29 connecting junction
29' connecting junction
29" connecting junction
30 apertured disc
31 covering unit/scaffolding floor
31.1 covering unit/scaffolding floor

31.2 covering unit/scaffolding floor/pass-through scaffolding floor
32 prop/post
32.1 prop/post
32.2 prop/post
32.3 prop/post
32.4 prop/post
32.5 prop/post
33 longitudinal axis of 32
34 use setting
35 transverse arm/transverse railing
35.1 transverse arm/0-transverse railing/round tube
35.2 transverse arm/U-transverse railing/U-profile tube
36.1 upper end of 32.1
36.2 upper end of 32.2
37.1 lower end of 32.1
37.2 lower end of 32.2
38 fastening device
39 toe board
40 mount
41 first direction
42 rest element
43 rest surface
44 support element
45 locking element
46 locking surface
46.1 locking surface
46.2 locking surface
47 locking setting
48 unlocking setting/open setting
49 installation setting/use setting
50 pivot axis
51 spacing
52 spacing
53 spacing
54.1 tube connector of 32.1
54.2 tube connector of 32.2
55 second direction
56 rest part
57 passage opening
58.1 first end
58.2 second end
59 transverse spacing/width
60 actuating part of 70
61 opening edge
62 articulation and locking part of 70
63 receiving slot
64 direction
65 stirrup
66 fastening means/rivet
67 height
68 height
69 height/width
70 locking lever
71 longitudinal slot
72 pressing body
73 counter-body
74 web
75.1 connecting head
75.2 connecting head
76 eccentric body
77 pin
78 longitudinal axis of 77
79 detent recess
80 connecting arrangement
81 transverse opening
82 width of 56
83 longitudinal axis
84 opening force
85 slot
86 first recess
87 first wall part
88 lug
89 second wall part
90 surface of 87
91 concave rounding
93 length of 86
94 second recess
95 rest surface
96 rest surface
97.1 support surface
97.2 support surface
98 support surface spacing
99 width of 42
100 spacing
101 free end
102 greatest spacing
103 depth of 94
104 depth of 86
105.1 vertical frame element
105.2 vertical frame element
128 railing device/railing rod
128.1 railing rod
128.2 railing rod
130 ladder
131 pass-through opening of 31.2
132 operator/installer
138 fastening device
140 mount
145 locking element
156 rest part
160 actuating part of 170
162 articulation and locking part of 170
163.1 angle
163.2 angle
163.3 angle
163.4 angle
165 stirrup
166 fastening means/pin, dowel pin
170 locking lever
172 pressing body
174 web
175.1 connecting head
175.2 connecting head
186 first recess
187 first wall part
188 lug
189 second wall part
190 surface of 187
191 concave rounding
192 fastening body
194 second recess
195 rest surface
196 rest surface
197.1 support surface
197.2 support surface
198 support surface spacing
203 depth of 194
204 depth of 186
206 lug
207 abutment
208.1 bearing body of 145
208.2 bearing body of 145
209 abutment body

210 recess
211.1 bore
211.2 bore
240 mount
242 receiving profile
243 spacing
244.1 (lower) support element
244.2 (upper) support element
264 slot, gap
265 opening angle
275 connecting head

What is claimed is:

1. An assembly for scaffolding, for a stage, for a staircase, or for a three-dimensional framework, the assembly comprising:

a prop composed of metal and having a longitudinal axis; and a fastening device for fastening at least one railing device to the prop, the fastening device comprising:

a fastening connector containing a pivot axis;

a locking element firmly connected with the prop and formed as a locking lever, the locking element having a locking surface for mechanically positive locking the at least one railing device to prevent vertical removal of the at least one railing device in an upward direction when the locking element is in a locking setting; and a mount for the at least one railing device, the mount being formed as a stirrup, the stirrup:

extending in a direction of the longitudinal axis of the prop, being permanently fastened to the prop, having or bounding a passage opening, the passage opening having a circumference, being closed or surrounded at the whole circumference or substantially at the whole circumference, being formed as a vertical receiving slot, and extending in the direction of the longitudinal axis of the prop, comprising a rest element extending in a first direction transversely to the longitudinal axis of the prop away from the prop, the rest element having a horizontal rest surface for vertical support of the at least one railing device, and having a support element bounding the passage opening, the support element extending at a transverse spacing from the prop and being connected with the rest element, the support element being for lateral support of a rest part of the at least one railing device; and wherein the locking lever is fastened to the prop via the fastening connector, is pivotable downwardly about the pivot axis of the fastening connector from an unlocking setting into the locking setting, and is pivotable upwardly about the pivot axis of the fastening connector from the locking setting into the unlocking setting;

wherein in the locking setting, the locking surface of the locking element lies opposite the horizontal rest surface of the rest element;

wherein in the locking setting, the locking surface of the locking element is arranged at a vertical spacing above the horizontal rest surface of the rest element;

wherein in the locking setting, the pivot axis of the fastening connector is arranged at a vertical spacing above the locking surface of the locking element; and wherein an end of the at least one railing device can be inserted into the passage opening of the stirrup and a rest part of the at least one railing device can be received by the passage opening of the stirrup.

2. The assembly according to claim 1, wherein on pivotation of the locking element about the pivot axis of the fastening connector from the unlocking setting into the locking setting, the locking surface of the locking element is pivoted downwardly.

3. The assembly according to claim 1, wherein the pivot axis of the fastening connector extends transversely to the longitudinal axis of the prop and also transversely to the first direction.

4. The assembly according to claim 1, wherein the support element of the stirrup extends vertically;

wherein the locking lever can be manually actuated and has a longitudinal slot; and wherein in the locking setting, the longitudinal slot receives a part of the support element of the stirrup.

5. The assembly according to claim 4, wherein the locking lever and the mount are formed to be so matched to one another that the locking lever in the locking setting is releasably detented at the mount or at a counter-body fastened to the mount so that the locking lever is pivotable from the locking setting to an open setting or to the unlocking setting only by application of an increased opening force.

6. The assembly according to claim 1, further comprising a counter-body;

wherein the counter-body is firmly connected to the prop or to the mount;

wherein the locking element comprises a pressing body;

wherein on pivotation of the locking element from the unlocking setting to the locking setting, the pressing body comes into engagement or stands in engagement with the counter-body; and wherein the pressing body and the counter-body are formed to be so matched to one another such that at least one of the following two conditions occurs:

on pivotation of the locking element from the unlocking setting to the locking setting, a pressing force opposing unintended unlocking of the locking element is formed between the pressing body and the counter-body, and in the locking setting, a pressing force opposing unintended unlocking of the locking element is formed between the pressing body and the counter-body.

7. The assembly according to claim 6, wherein at least one of the pressing body and the counter-body is constructed as an eccentric body.

8. The assembly according to claim 6, wherein the counter-body is formed as a pin or bolt fastened firmly to the prop or to the mount.

9. The assembly according to claim 8, wherein the pin or the bolt has a longitudinal axis extending transversely to the longitudinal axis of the prop and transversely to the first direction.

10. The assembly according to claim 8, wherein the locking lever has a detent recess and the pin or the bolt engages in the detent recess in detenting manner in the locking setting.

11. The assembly according to claim 1, further comprising an abutment;

wherein the locking lever on pivotation about the pivot axis of the fastening connector is pivotable upwardly from the locking setting into an open setting only through a maximum opening angle limited by the abutment and smaller than 60 degrees, the maximum opening angle being measured around the pivot axis of the fastening connector and being measured between:

a position of the locking lever in the locking setting, and a position of the locking lever in the open setting.

12. The assembly according to claim 1, further comprising a counter-body fastened to the mount;

wherein the locking element comprises a pressing body; and wherein in a maximum opening setting, the locking lever bears via the pressing body against the counter-body so that a gravitational force-induced downward pivotation of the locking lever about the pivot axis is prevented.

13. The assembly according to claim 1, wherein the fastening connector is a member selected from the group consisting of a rivet, a bolt, and a pin.

14. A connecting arrangement for scaffolding, for a stage, for a staircase, or for a three-dimensional framework, the connecting arrangement comprising:

a railing device formed as a single railing or as a double railing and having an end and a rest part;

a prop composed of metal and having a longitudinal axis; and a fastening device for fastening the railing device to the prop, the fastening device comprising:

a fastening connector containing a pivot axis;

a locking element firmly connected with the prop and formed as a locking lever, the locking element having a locking surface for mechanically positive locking the railing device to prevent vertical removal of the railing device in an upward direction when the locking element is in a locking setting; and a mount for the railing device, the mount being formed as a stirrup, the stirrup:

extending in a direction of the longitudinal axis of the prop, being permanently fastened to the prop, having or bounding a passage opening, the passage opening having a circumference, being closed or surrounded at the whole circumference or substantially at the whole circumference, being formed as a vertical receiving slot, and extending in the direction of the longitudinal axis of the prop, comprising a rest element extending in a first direction transversely to the longitudinal axis of the prop away from the prop, the rest element having a horizontal rest surface for vertical support of the railing device, and having a support element bounding the passage opening, the support element extending at a transverse spacing from the prop and being connected with the rest element, the support element being for lateral support of the rest part of the railing device; and wherein the locking lever is fastened to the prop via the fastening connector, is pivotable downwardly about the pivot axis of the fastening connector from an unlocking setting into the locking setting, and is pivotable upwardly about the pivot axis of the fastening connector from the locking setting into the unlocking setting;

wherein in the locking setting, the locking surface of the locking element lies opposite the horizontal rest surface of the rest element;

wherein in the locking setting, the locking surface of the locking element is arranged at a vertical spacing above the horizontal rest surface of the rest element;

wherein in the locking setting, the pivot axis of the fastening connector is arranged at a vertical spacing above the locking surface of the locking element; and wherein the end of the railing device can be inserted into the passage opening of the stirrup and the rest part of the railing device can be received by the passage opening of the stirrup.

15. A connecting arrangement for scaffolding, for a stage, for a staircase, or for a three-dimensional framework, the connecting arrangement comprising:

a railing device having an end and a rest part;

at least one prop composed of metal and having a longitudinal axis; and a fastening device for fastening the railing device to the at least one prop, the fastening device comprising:

a fastening connector containing a pivot axis;

a locking element firmly connected with the at least one prop and formed as a locking lever, the locking element having a locking surface for mechanically positive locking the railing device to prevent vertical removal of the railing device in an upward direction when the locking element is in a locking setting; and a mount for the railing device, the mount:

extending in a direction of the longitudinal axis of the at least one prop, being permanently fastened to the at least one prop, having or bounding a passage opening, the passage opening having a circumference, being closed or surrounded at the whole circumference or substantially at the whole circumference, being formed as a vertical receiving slot, and extending in the direction of the longitudinal axis of the at least one prop, comprising a rest element extending transversely to the longitudinal axis of the at least one prop away from the at least one prop, the rest element having a horizontal rest surface for vertical support of the railing device, and having a support element bounding the passage opening, the support element extending at a transverse spacing from the at least one prop and being connected with the rest element, the support element being for lateral support of the rest part of the railing device; and wherein the locking lever is fastened to the at least one prop via the fastening connector, is pivotable about the pivot axis of the fastening connector from an unlocking setting into the locking setting, and is pivotable about the pivot axis of the fastening connector from the locking setting into the unlocking setting;

wherein in the locking setting, the locking surface of the locking element lies opposite the horizontal rest surface of the rest element;

wherein in the locking setting, the locking surface of the locking element is arranged at a vertical spacing above the horizontal rest surface of the rest element; and wherein the railing device is fastenable to the at least one prop with the help of the fastening device as the rest part of the railing device is inserted into or through the vertical receiving slot of the mount.

16. The connecting arrangement according to claim 15, wherein the fastening device and the railing device are formed to be so matched to one another that the railing device, although the locking element is disposed in the locking setting, is placeable, in a first position, obliquely from below on the horizontal rest surface of the rest element of the mount, or can be suspended in a first position on the horizontal rest surface of the rest element, and, from the first position, is pivotably upwardly and transferrable to an installation setting; and wherein, in the installation setting, the railing device is secured against removal from the mount in any direction.

17. The connecting arrangement according to claim 15, wherein the railing device further comprises a first wall part comprising a lug;

wherein the railing device has ends and in a region of at least one end of the ends has an outwardly open first recess:

extending in a direction of a longitudinal axis of the at least one end or of the railing device, bounded by the rest part for support on the horizontal rest surface of the rest element of the mount, and bounded by the lug; and wherein the lug extends transversely to the longitudinal axis of the at least one end or of the railing device.

18. The connecting arrangement according to claim 17, wherein the outwardly open first recess of the railing device has a first recess rest surface;

wherein the railing device has two transverse support surfaces separated by a support surface spacing and extending transversely to the longitudinal axis of the at least one end of the railing device or of the railing device;

wherein the railing device has a second recess:

adjoining the lug in a region of the outwardly open first recess, bounded by a longitudinal second recess rest surface extending in a direction of the longitudinal axis of the at least one end or of the railing device, deepened relative to the outwardly open first recess or to the first recess rest surface, and bounded by the two transverse support surfaces;

wherein the rest element of the mount has a width in a region of the horizontal rest surface of the rest element of the mount; and wherein the support surface spacing is greater than the width of the rest element of the mount in the region of the horizontal rest surface of the rest element of the mount.

19. The connecting arrangement according to claim 18, wherein the outwardly open first recess of the railing device has a recess length extending in the direction of the longitudinal axis of the at least one end of the railing device or of the railing device;

wherein the railing device has a free end spacing, the free end spacing being measured:

in the direction of the longitudinal axis of the at least one end of the railing device or of the railing device, and between:

a second support surface of the two transverse support surfaces, the second support surface being associated with a free end of the railing device and belonging to the second recess, and the free end of the railing device; and wherein the recess length is greater than the free end spacing.

20. The connecting arrangement according to claim 18, wherein the vertical spacing between the horizontal rest surface of the rest element and the locking surface of the locking element in the locking setting is greater than the greatest spacing between:

a second support surface of the two transverse support surfaces, and the free end of the railing device; and wherein the second support surface faces away from a free end of the railing device and bounds the second recess.

21. A scaffolding standing frame comprising:

at least one assembly; and at least one transverse arm fastened to the at least one assembly;

wherein the at least one assembly comprises:

at least one prop composed of metal and having a longitudinal axis; and a fastening device for fastening at least one railing device to the at least one prop, the fastening device comprising:

a fastening connector containing a pivot axis;

a locking element firmly connected with the at least one prop and formed as a locking lever, the locking element having a locking surface for mechanically positive locking the at least one railing device to prevent vertical removal of the at least one railing device in upward direction when the locking element is in a locking setting; and a mount for the at least one railing device, the mount being formed as a stirrup, the stirrup:

extending in a direction of the longitudinal axis of the at least one prop, being permanently fastened to the at least one prop, having or bounding a passage opening, the passage opening having a circumference, being closed or surrounded at the whole circumference or substantially at the whole circumference, being formed as a vertical receiving slot, and extending in the direction of the longitudinal axis of the at least one prop, comprising a rest element extending in a first direction transversely to the longitudinal axis of the at least one prop away from the at least one prop, the rest element having a horizontal rest surface for vertical support of the at least one railing device, and having a support element bounding the passage opening, the support element extending at a transverse spacing from the at least one prop and being connected with the rest element, the support element being for lateral support of a rest part of the at least one railing device; and wherein the at least one transverse arm is fastened at least to the at least one prop;

wherein the locking lever is fastened to the at least one prop via the fastening connector, is pivotable downwardly about the pivot axis of the fastening connector from an unlocking setting into the locking setting, and is pivotable upwardly about the pivot axis of the fastening connector from the locking setting into the unlocking setting;

wherein in the locking setting, the locking surface of the locking element lies opposite the horizontal rest surface of the rest element;

wherein in the locking setting, the locking surface of the locking element is arranged at a vertical spacing above the horizontal rest surface of the rest element;

wherein in the locking setting, the pivot axis of the fastening connector is arranged at a vertical spacing above the locking surface of the locking element; and wherein an end of the at least one railing device can be inserted into the passage opening of the stirrup and the rest part of the at least one railing device can be received by the passage opening of the stirrup.

22. Building scaffolding comprising:

at least four vertical assemblies; and mounted to the at least four vertical assemblies at least one member selected from the group consisting of a scaffolding floor, a horizontal rod element, and a diagonal element for stiffening the building scaffolding;

wherein at least one assembly of the at least four vertical assemblies comprises:

a prop composed of metal and having a longitudinal axis; and a fastening device for fastening at least one railing device to the prop, the fastening device comprising:

a fastening connector containing a pivot axis;

a locking element firmly connected with the prop and formed as a locking lever, the locking element having a locking surface for mechanically positive locking the at least one railing device to prevent vertical removal of the at least one railing device in an upward direction when the locking element is in a locking setting; and a mount for the at least one railing device, the mount being formed as a stirrup, the stirrup:

extending in a direction of the longitudinal axis of the prop, being permanently fastened to the prop, having or bounding a passage opening, the passage opening having a circumference, being closed or surrounded at the whole circumference or substantially at the whole circumference, being formed as a vertical receiving slot, and extending in the direction of the longitudinal axis of the prop, comprising a rest element extending in a first direction transversely to the longitudinal axis of the prop away from the prop, the rest element having a horizontal rest surface for vertical support of the at least one railing device, and having a support element bounding the passage opening, the support element extending at a transverse spacing from the prop and being connected with the rest element, the support element being for lateral support of a rest part of the at least one railing device; and wherein the locking lever is fastened to the prop via the fastening connector, is pivotable downwardly about the pivot axis of the fastening connector from an unlocking setting into the locking setting, and is pivotable upwardly about the pivot axis of the fastening connector from the locking setting into the unlocking setting;

wherein in the locking setting, the locking surface of the locking element lies opposite the horizontal rest surface of the rest element;

wherein in the locking setting, the locking surface of the locking element is arranged at a vertical spacing above the horizontal rest surface of the rest element;

wherein in the locking setting, the pivot axis of the fastening connector is arranged at a vertical spacing above the locking surface of the locking element; and wherein an end of the at least one railing device can be inserted into the passage opening of the stirrup and the rest part of the at least one railing device can be received by the passage opening of the stirrup.

23. A method of fastening at least one railing device with the help of fastening devices to horizontally spaced-apart vertical props for scaffolding, for a stage, for a staircase, or for a three-dimensional framework, the method comprising steps of:

providing an assembly comprising:

the at least one railing device, the at least one railing device having rest surfaces, ends, and rest parts arranged, respectively, in regions of the ends;

the fastening devices; and the horizontally spaced-apart vertical props, the horizontally spaced-apart vertical props being composed of metal and having respective longitudinal axes;

wherein each fastening device of the fastening devices comprises:

a fastening connector containing a pivot axis;

a locking element:

firmly connected with a respective prop of the horizontally spaced-apart vertical props, fastened to the respective prop with the help of the fastening connector, pivotable about the pivot axis of the fastening connector from an unlocking setting into a locking setting, and having a locking surface for mechanically positive locking the at least one railing device to prevent vertical removal of the at least one railing device in an upward direction; and a mount for the at least one railing device, the mount:

being permanently fastened to the respective prop, and comprising a rest element extending in a first direction transversely to the respective longitudinal axis of the respective prop and away from the respective prop, the rest element having a horizontal rest surface;

while the locking elements are in the unlocking setting, plugging the at least one railing device horizontally in a second direction transversely to the longitudinal axes of the horizontally spaced-apart vertical props and also transversely to the first direction onto the horizontal rest surfaces of the rest elements of the mounts, respectively;

placing the rest surfaces of the at least one railing device, respectively, on the horizontal rest surfaces of the rest elements of the mounts; and subsequently transferring the locking elements to the locking settings by pivotation of the locking elements about the pivot axes such that as the rest surfaces of the at least one railing device rest on the horizontal rest surfaces of the rest elements of the mounts the at least one railing device is mechanically positively locked against removal from the mounts upwardly in a direction of the longitudinal axes of the horizontally spaced-apart vertical props and is secured against removal from the mounts in any direction.

24. The method according to claim 23, wherein in a region of a rest surface of a first recess of a first end of the ends of the at least one railing device the at least one railing device is initially placed on the horizontal rest surface of the rest element of the mount of a first prop of the horizontally spaced-apart vertical props when the locking element of the fastening device of the first prop is disposed in the unlocking setting;

wherein subsequently the at least one railing device is displaced in the direction of the mount of an adjacent second prop of the horizontally spaced-apart vertical props until the rest surfaces of second recesses of the two ends of the at least one railing device come to lie on the respectively associated horizontal rest surfaces of the respective rest elements of the respective mounts with formation of a mechanically positive connection between the at least one railing device and the first and second props; and wherein subsequently the locking elements of the fastening devices of the first and second props are pivoted into the locking settings of the locking elements.

25. A method of fastening at least one railing device with the help of a fastening device to a prop for scaffolding, for a stage, for a staircase, or for a three-dimensional framework, the method comprising steps of:

providing an assembly comprising:

the at least one railing device, the at least one railing device having a rest part;

the fastening device; and the prop, the prop being composed of metal and having a longitudinal axis;

wherein the fastening device comprises:

a fastening connector containing a pivot axis;

a locking element:

firmly connected with the prop, fastened to the prop with the help of the fastening connector, pivotable downwardly about the pivot axis of the fastening connector from an unlocking setting into a locking setting, pivotable upwardly about the pivot axis of the fastening connector from the locking setting into the unlocking setting, and having a locking surface for mechanically positive locking the at least one railing device to prevent vertical removal of the at least one railing device in an upward direction; and a mount for the at least one railing device, the mount:

being permanently fastened to the prop, and comprising a rest element extending in a first direction transversely to the longitudinal axis of the prop and away from the prop, the rest element having a horizontal rest surface for vertical support of the at least one railing device;

wherein in the locking setting, the at least one railing device can be placed on the horizontal rest surface of the rest element of the mount or can be removed from the mount;

while the locking element is in the locking setting, placing the at least one railing device on the rest element of the mount or hanging the at least one railing device in place at the rest element of the mount obliquely from below in a direction transverse to the first direction; and subsequently pivoting the at least one railing device upwardly and transferring the at least one railing device to a horizontal installation setting;

wherein in the horizontal installation setting, the at least one railing device is mechanically positively locked via the locking element against removal from the mount upwardly in a direction of the longitudinal axis of the prop; and wherein in the horizontal installation setting, the at least one railing device is secured against removal in any direction from the mount.

26. A method of fastening at least one railing device with the help of fastening devices to horizontally spaced-apart vertical props for scaffolding, for a stage, for a staircase, or for a three-dimensional framework, the method comprising steps of:

providing an assembly comprising:

the at least one railing device, the at least one railing device having ends, having rest parts arranged, respectively, in regions of the ends, and having rest surfaces;

the fastening devices; and the horizontally spaced-apart vertical props, the horizontally spaced-apart vertical props being composed of metal and having respective longitudinal axes;

wherein each fastening device of the fastening devices comprises:

a fastening connector containing a pivot axis;

a locking element:

firmly connected with a respective prop of the horizontally spaced-apart vertical props, fastened to the respective prop with the help of the fastening connector, pivotable downwardly about the pivot axis of the fastening connector from an unlocking setting into a locking setting, pivotable upwardly about the pivot axis of the fastening connector from the locking setting into the unlocking setting, and having a locking surface for mechanically positive locking the at least one railing device to prevent vertical removal of the at least one railing device in an upward direction; and a mount for the at least one railing device, the mount:

being permanently fastened to the respective prop, and comprising a rest element extending in a first direction transversely to the longitudinal axis of the respective prop and away from the respective prop, the rest element having a horizontal rest surface for vertical support of the at least one railing device;

while the locking element of a first prop of the horizontally spaced-apart vertical props is disposed in the locking setting, placing the at least one railing device on the rest element of the mount of the first prop or hanging the at least one railing device in place at the rest element of the mount of the first prop obliquely from below, in a direction transverse to the first direction; and subsequently pivoting the at least one railing device upwardly and transferring the at least one railing device to a horizontal installation setting;

wherein in the horizontal installation setting, the rest surfaces of the at least one railing device rest on the horizontal rest surfaces of the rest elements of the mounts;

wherein in the horizontal installation setting, the at least one railing device is mechanically positively locked via the locking element of the first prop against removal from the mount upwardly in a direction of the longitudinal axis of the first prop; and wherein in the horizontal installation setting, the at least one railing device is secured against removal from the mount in any direction from the mount.

* * * * *